US006306574B1

(12) United States Patent
Yamada et al.

(10) Patent No.: US 6,306,574 B1
(45) **Date of Patent: *Oct. 23, 2001**

(54) PHOTOTHERMOGRAPHIC MATERIAL

(75) Inventors: Kohzaburoh Yamada; Toshiaki Kubo; Shigeo Hirano, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/857,459

(22) Filed: May 16, 1997

(30) Foreign Application Priority Data

| | | |
|---|---|---|
| May 17, 1996 | (JP) | 8-148111 |
| May 17, 1996 | (JP) | 8-148113 |
| May 17, 1996 | (JP) | 8-148115 |
| May 17, 1996 | (JP) | 8-148116 |
| Sep. 30, 1996 | (JP) | 8-280356 |

(51) Int. Cl.[7] ..... G03C 1/498; G03C 1/06
(52) U.S. Cl. ..... 430/619; 430/264
(58) Field of Search ..... 430/619, 264, 430/620

(56) References Cited

U.S. PATENT DOCUMENTS

| | | | | |
|---|---|---|---|---|
| 3,152,904 | | 10/1964 | Sorensen et al. . | |
| 3,457,075 | | 7/1969 | Morgan et al. . | |
| 3,667,958 | | 6/1972 | Evans . | |
| 3,672,904 | | 6/1972 | de Mauriac . | |
| 3,782,949 | | 1/1974 | Olivares et al. . | |
| 4,283,479 | * | 8/1981 | Hamaoka et al. | 430/264 |
| 4,792,514 | * | 12/1988 | Nakamura et al. | 430/138 |
| 4,882,261 | * | 11/1989 | Kojima et al. | 430/264 |
| 4,960,672 | * | 10/1990 | Okada et al. | 430/264 |
| 5,030,546 | * | 7/1991 | Takamuki et al. | 430/264 |
| 5,037,719 | * | 8/1991 | Nakamura | 430/138 |
| 5,061,594 | * | 10/1991 | Okamura et al. | 430/264 |
| 5,262,295 | | 11/1993 | Tanaka et al. . | |
| 5,382,504 | * | 1/1995 | Shor et al. | 430/619 |
| 5,427,891 | * | 6/1995 | Hirano et al. | 430/264 |
| 5,496,681 | * | 3/1996 | Ezoe et al. | 430/264 |
| 5,496,695 | | 3/1996 | Simpson et al. . | |
| 5,558,983 | * | 9/1996 | Simpson et al. | 430/619 |
| 5,677,121 | | 10/1997 | Tsuzuki . | |

FOREIGN PATENT DOCUMENTS

| | | |
|---|---|---|
| 0741320A1 | 11/1996 | (EP) . |
| 0761296 | 3/1997 | (EP) . |
| 96/21174A2 | 7/1996 | (WO) . |

OTHER PUBLICATIONS

Thermally Processed Silver Systems, Imaging Processes and Matearials, Neblette, 8th Ed., compiled by Sturge, V. Walworth, p. 2, 1969.

* cited by examiner

*Primary Examiner*—Thorl Chea
(74) *Attorney, Agent, or Firm*—Birch, Stewart, Kolasch & Birch, LLP

(57) ABSTRACT

In a photothermographic material comprising an organic silver salt, a silver halide, and a reducing agent, a specific hydrazine derivative is contained as a nucleating agent. The material has high sensitivity, high Dmax and good image quality.

24 Claims, No Drawings

PHOTOTHERMOGRAPHIC MATERIAL

BACKGROUND OF THE INVENTION

This invention relates to a photothermographic material and more particularly, to a photothermographic material suited for the manufacture of printing plates.

Nowadays, it is strongly desired in the printing art from the standpoints of environmental protection and space saving to reduce the amount of waste solution used in the processing of conventional photographic photosensitive materials. There is a need for the technology relating to photothermographic photosensitive material for graphic printing application which can be effectively exposed by means of a laser image setter and form a clear black image having high resolution and sharpness. The photothermographic photosensitive material can provide the customer with a thermographic process system which eliminates a need for solution system processing chemicals and is thus more simple and environment friendly.

Photothermographic materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), a toner for controlling the tonality of silver, and a reducing agent, typically dispersed in a binder matrix. Photothermographic materials are stable at room temperature. When they are heated at an elevated temperature (e.g., 80° C. or higher) after exposure, redox reaction takes place between the reducible silver source (functioning as an oxidizing agent) and the developing agent to form silver. This redox reaction is promoted by the catalysis of a latent image produced by exposure. Silver formed by reaction of the organic silver salt in exposed regions provides black images in contrast to unexposed regions, forming an image.

Such photothermographic materials have been used as microphotographic and medical photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has so high sensitivity and Dmax that it may comply with such output devices. A demand for a simple dry process is also increasing.

U.S. Pat. No. 3,667,958 describes that a photothermographic material comprising a polyhydroxybenzene combined with a hydroxylamine, reductone or hydrazine has high image quality discrimination and resolving power. It was found that this combination of reducing agents is likely to increase fog. U.S. Pat. No. 5,496,695 discloses a photothermographic material comprising an organic silver salt, a silver halide, a hindered phenol and a certain hydrazine derivative. Undesirably, these hydrazine derivatives fail to provide a fully satisfactory maximum ultimate density or ultrahigh contrast and allow black pepper to generate, resulting in poor image quality.

A photothermographic material having high Dmax and high contrast can be obtained by adding a hydrazine derivative to a photosensitive material as disclosed in Japanese Patent Application No. 228627/1995. This photothermographic material has somewhat high Dmax and ultrahigh contrast, but allows black pepper to generate at dot edges, exacerbating image quality.

SUMMARY OF THE INVENTION

Therefore, a first object of the present invention is to provide a novel and improved photothermographic material having high sensitivity, high Dmax, ultrahigh contrast and improved image quality.

A second object of the present invention is to provide a novel and improved printing plate-forming photosensitive material producing an image of quality and processable on a fully dry basis without a need for wet process.

According to the present invention, there is provided a photothermographic material comprising an organic silver salt, a silver halide, a reducing agent, and at least one member selected from hydrazine derivatives of the following general formulae (I) to (VIII).

A first class of hydrazine derivatives are of the general formula (I):

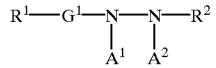

(I)

wherein $R^2$ is an aliphatic group, $G^1$ is selected from the group consisting of —COCO—, —$SO_2$—, —SO—, —P(=O)(—$R^3$)—, thiocarbonyl and iminomethylene group, $R^1$ is selected from the group consisting of an alkyl, aryl, heterocyclic, alkoxy, aryloxy, amino, alkylamino, arylamino, heterocyclic amino, and hydrazino group, with the proviso that $R^1$ is not an unsubstituted arylamino group where $G^1$ is a thiocarbonyl group, $A^1$ and $A^2$ are both hydrogen atoms, or one of $A^1$ and $A^2$ is a hydrogen atom and the other is a substituted or unsubstituted alkylsulfonyl, arylsulfonyl or acyl group, and $R^3$ is a group selected from the same range as defined for $R^1$ and may be identical with or different from $R^1$.

A second class of hydrazine derivatives are of the general formula (II):

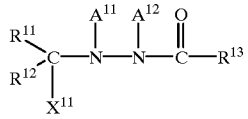

(II)

wherein $R^{11}$ and $R^{12}$ are independently selected from the group consisting of an alkyl, alkenyl, alkynyl, aryl and heterocyclic group, $X^{11}$ is selected from the group consisting of a hydrogen atom, alkyl, alkenyl, alkynyl, acyl, oxycarbonyl, carbamoyl, heterocyclic, cyano, a group having a bonding oxygen atom, a group having a bonding nitrogen atom, and a group having a bonding sulfur atom, $R^{13}$ is selected from the group consisting of a hydrogen atom, alkyl, aryl, heterocyclic, alkoxy, aryloxy, amino and hydrazine group, and $A^{11}$ and $A^{12}$ are both hydrogen atoms, or one of $A^{11}$ and $A^{12}$ is a hydrogen atom and the other is an alkylsulfonyl, arylsulfonyl or acyl group.

A third class of hydrazine derivatives are of the general formula (III):

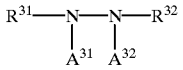

(III)

wherein $R^{32}$ is an aliphatic group, $R^{31}$ is an alkyl, aryl or heterocyclic group having at least one electron attractive or donative group, $A^{31}$ and $A^{32}$ are both hydrogen atoms, or one of $A^{31}$ and $A^{32}$ is a hydrogen atom and the other is a substituted or unsubstituted alkylsulfonyl, arylsulfonyl or acyl group;

A fourth class of hydrazine derivatives are of the general formula (IV):

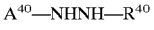

(IV)

wherein $A^{40}$ is a heterocyclic group having at least one sulfur or oxygen atom, and $R^{40}$ is selected from the group consisting of a formyl, substituted or unsubstituted acyl, sulfonyl, carbamoyl, sulfamoyl, alkoxycarbonyl, thioacyl, and —(C═O)—(C═O)—$X^{40}$ group wherein $X^{40}$ is —$NR^{41}$ $R^{42}$ or —$OR^{43}$ wherein $R^{41}$, $R^{42}$ and $R^{43}$ are independently selected from the group consisting of a hydrogen atom, substituted or unsubstituted alkyl, aryl and heterocyclic group, or $R^{41}$ and $R^{42}$, taken together, may form a ring with the nitrogen atom, A fifth class of hydrazine derivatives are of the general formula (V):

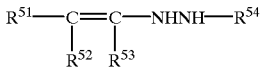

(V)

wherein $R^{51}$ is a monovalent organic group, each of $R^{52}$ and $R^{53}$ is a hydrogen atom, halogen atom or substituted or unsubstituted alkyl group, $R^{54}$ is selected from the group consisting of a formyl, substituted or unsubstituted acyl, sulfonyl, carbamoyl, sulfamoyl, alkoxycarbonyl, thioacyl, and —(C═O)—(C═O)—$X^{40}$ group wherein $X^{40}$ is —$NR^{41}R^{42}$ or —$OR^{43}$ wherein $R^{41}$, $R^{42}$ and $R^{43}$are independently selected from the group consisting of a hydrogen atom, substituted or unsubstituted alkyl, aryl and reterocyclic group, or $R^{41}$ and $R^{42}$, taken together, may form a ring with the nitrogen atom, A six class consists of polymers having a structural moiety of the general formula (VI):

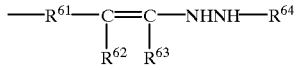

(VI)

wherein $R^{61}$ is a divalent organic group, each of $R^{62}$ and $R^{63}$ is a hydrogen atom, halogen atom or substituted or unsubstituted alkyl group, $R^{64}$ is selected from the group consisting of a formyl, substituted or unsubstituted acyl, sulfonyl, carbamoyl, sulfamoyl, alkoxycarbonyl, thioacyl, and —(C═O)—(C═O)—$X^{40}$ group wherein $X^{40}$ is —$NR^{41}R^{42}$ or —$OR^{43}$ wherein $R^{41}$, $R^{42}$ and $R^{43}$ are independently selected from the group consisting of a hydrogen atom, substituted or unsubstituted alkyl, aryl and heterocyclic group, or $R^{41}$ and $R^{42}$, taken together, may form a ring with the nitrogen atom;

A seventh class consists of polymers having a structural moiety of the general formula (VII):

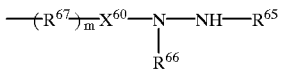

(VII)

wherein $R^{65}$ is selected from the group consisting of a hydrogen atom, formyl, substituted or unsubstituted acyl, sulfonyl, carbamoyl, sulfamoyl, alkoxycarbonyl, thioacyl, and —(C═O)—(C═O)—$X^{40}$ group wherein $X^{40}$ is —$NR^{41}$ $R^{42}$ or —$OR^{43}$ wherein $R^{41}$, $R^{42}$ and $R^{43}$ are independently selected from the group consisting of a hydrogen atom, substituted or unsubstituted alkyl, aryl and heterocyclic group, or $R^{41}$ and $R^{42}$, taken together, may form a ring with the nitrogen atom, $R^{66}$ is selected from the group consisting of a hydrogen atom, substituted or unsubstituted acyl, sulfonyl, carbamoyl, sulfamoyl, and alkoxycarbonyl group, $R^{67}$ is a divalent organic group, $X^{60}$ is a phenyl group or pyridine ring, and letter m is an integer of 0 to 6; and An eighth class of hydrazine derivatives are of the general formula (VIII):

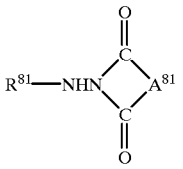

(VIII)

wherein $R^{81}$ is an aromatic group, $A^{81}$ is a substituted or unsubstituted aromaticring, and the carbon atoms of the two carbonyl groups are attached to different atoms of the aromatic ring.

In one preferred embodiment, the photothermographic material has a gradient γ of more than 5 after heat development.

DETAILED DESCRIPTION OF THE INVENTION

Hydrazine Derivative

The photothermographic material according to the invention uses a hydrazine derivative which is at least one member selected from compounds of the general formulae (I) to (VIII).

Described first is the general formula (I):

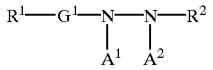

(I)

wherein $R^2$ is an aliphatic group, $G^1$ is —COCO—, —$SO_2$—, —SO—, —P(=O) (—$R^3$)—, thiocarbonyl or iminomethylene group, $R^1$ is an alkyl, aryl, heterocyclic, alkoxy, aryloxy, amino, alkylamino, arylamino, heterocyclic amino or hydrazino group, with the proviso that $R^1$ is not an unsubstituted arylamino group where $G^1$ is a thiocarbonyl group, $A^1$ and $A^2$ are both hydrogen atoms, or one of $A^1$ and $A^2$ is a hydrogen atom and the other is a substituted or unsubstituted alkylsulfonyl, substituted or unsubstituted arylsulfonyl or substituted or unsubstituted acyl group, and $R^3$ is a group selected from the same range as defined for $R^1$ and may be identical with or different from $R^1$.

The aliphatic group represented by $R^2$ in formula (I) includes, for example, substituted or unsubstituted, linear, branched or cyclic alkyl, alkenyl and alkynyl groups having 1 to 30 carbon atoms.

le;2qWhere these groups have a substituent, exemplary substituents include an alkyl group, alkenyl group, alkynyl group, aryl group, heterocyclic group, quaternized nitrogen atom-bearing heterocyclic group (e.g., pyridinio), hydroxy group, alkoxy group (inclusive of groups containing recurring ethyleneoxy or propyleneoxy units), aryloxy group, acyloxy group, acyl group, alkoxycarbonyl group, aryloxycarbonyl group, carbamoyl group, urethane group, carboxyl group, imide group, amino group, carbonamide group, sulfonamide group, ureido group, thioureido group, sulfamoylamino group, semicarbazide group, thiosemicarbazide group, hydrazino group, quaternary ammonio group, (alkyl, aryl or heterocyclic) thio group, mercapto group, (alkyl or aryl)sulfonyl group, (alkyl or aryl)sulfinyl group, sulfo group, sulfamoyl group, acylsulfamoyl group, (alkyl or aryl)sulfonylureido group, (alkyl or aryl)sulfonylcarbamoyl group, halogen atom, cyano group, nitro group, phosphoric acid amide group, phosphate structure-bearing group, acyl urea structure-bearing group, selenium or tellurium atom-containing group, and tertiary or quaternary sulfonium structure-bearing group. These substituents may further have an analogous substituent.

In formula (I), $R^2$ is preferably alkyl. For substituted alkyl groups, the substituents are preferably aryl, heterocyclic, (alkyl or aryl)thio, cyano, alkoxy, aryloxy, alkoxycarbonyl, aryloxycarbonyl and carbamoyl groups.

Also preferably $R^2$ is a tri-substituted methyl group in which the substituents are preferably aryl, heterocyclic, (alkyl or aryl)thio, cyano, alkoxy, aryloxy, alkoxycarbonyl, aryloxycarbonyl and carbamoyl groups. More preferably $R^2$ is a methyl group having two aryl groups and one substituent selected from aryl, heterocyclic, (alkyl or aryl)thio, cyano, alkoxy, aryloxy, alkoxycarbonyl, aryloxycarbonyl and carbamoyl groups. Most preferably $R^2$ is a methyl group substituted with three aryl groups.

In formula (I), each of $A^1$ and $A^2$ is a hydrogen atom, or a substituted or unsubstituted alkyl or arylsulfonyl group having up to 20 carbon atoms (preferably a phenylsulfonyl group, or a phenylsulfonyl group substituted such that the sum of Hammette's substituent constants may be −0.5 or more), or substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxyl group and sulfonate group). Most preferably, both $A^1$ and $A^2$ are hydrogen atoms.

In formula (I), $G^1$ is preferably —COCO—, —$SO_2$—, —SO—, —P(=O)(—$R^3$)— or thiocarbonyl group.

In formula (I), $R^1$ is an alkyl, aryl, heterocyclic, alkoxy, aryloxy, amino, alkylamino, arylamino, heterocyclic amino or hydrazino group, with the proviso that $R^1$ is not an unsubstituted arylamino group where $G^1$ is a thiocarbonyl group.

Where $G^1$ is a —COCO— group, the preferred groups represented by RI are alkoxy, aryloxy, amino, alkylamino, arylamino, heterocyclic amino and hydrazino groups. Substituted amino groups are especially preferred, for example, 2,2,6,6-tetramethylpiperidin-4-ylamino, propylamino, anilino, o-hydroxyanilino, 5-benzotriazolylamino, and N-benzyl-3-pyridinioamino groups.

Where $G^1$ is a —$SO_2$— or —SO— group, the preferred groups represented by $R^1$ are alkyl groups (e.g., methyl and trifluoromethyl), aralkyl groups (e.g., o-hydroxybenzyl), aryl groups (e.g., phenyl and m-nitrophenyl), heterocyclic groups (e.g., pyridyl), substituted amino groups (e.g., dimethylamino), and hydrazino groups.

Where $G^1$ is —P(=O)$R^3$—, the preferred groups represented by $R^1$ are alkoxy, aryloxy, amino, alkylamino, arylamino, heterocyclic amino and hydrazino groups.

Where $G^1$ is thiocarbonyl, the preferred groups represented by $R^1$ are alkyl, aryl, alkylamino, substituted arylamino, heterocyclic amino and hydrazino groups.

Where the groups represented by $R^1$ are substituted ones, the substituents may be selected from the same substituents mentioned for $R^2$.

$R^1$ and $R^2$ in formula (I) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^1$ and $R^2$ in formula (I) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. The silver halide adsorbing groups may take the form of precursors. Such precursors are described in JP-A 285344/1990.

$R^1$ and $R^2$ in formula (I) may contain a plurality of hydrazino groups as substituents. In this case, the compound of formula (I) is an oligomer of hydrazino groups, examples of which are described in JP-A 86134/1989, 16938/1992 and 197091/1993.

Illustrative, non-limiting, examples of the hydrazine derivative represented by formula (I) are given below.

TABLE 1
| No. | $R^2$ | —N—N— ($A^1$, $A^2$) | $G^1$ | $R^1$ |
|---|---|---|---|---|
| 1 | 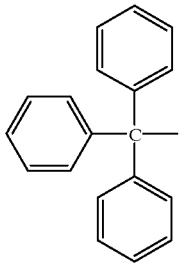 | —NHNH— | —COCO— | $—NHC_3H_7$ |
| 2 | 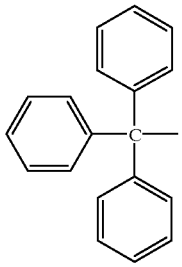 | —NHNH— | —COCO— | 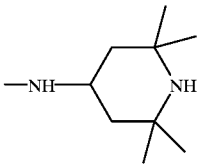 |
| 3 | 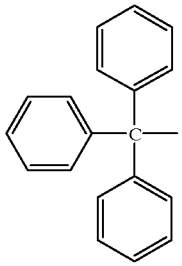 | —NHNH— | —COCO— | 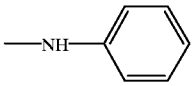 |
| 4 | 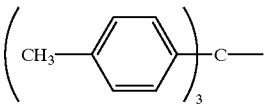 | —NHNH— | —COCO— | $—N(C_2H_5)_2$ |
| 5 | 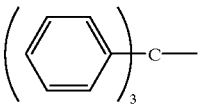 | —NHNH— | —COCO— | $—NHNH—C(C_6H_5)_3$ |
| 6 | 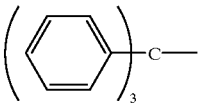 | —NHNH— | —COCO— | $—OC_2H_5$ |
| 7 | 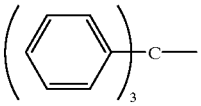 | —NHNH— | —COCO— | $—O—C(CH_3)_3$ |

TABLE 1-continued
| No. | $R^2$ | —N—N— ($A^1$, $A^2$) | $G^1$ | $R^1$ |
|---|---|---|---|---|
| 8 | 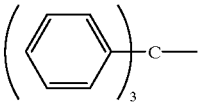 | —NHNH— | —COCO— | 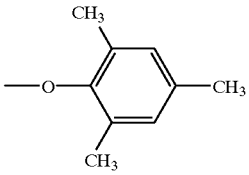 |
| 9 | 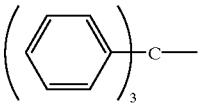 | —NHNH— | —COCO— | 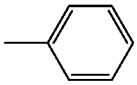 |
TABLE 2
| No. | $R^2$ | —N—N— ($A^1$, $A^2$) | $G^1$ | $R^1$ |
|---|---|---|---|---|
| 10 | 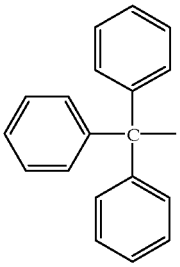 | —NHNH— | $—SO_2—$ | $—CH_3$ |
| 11 | 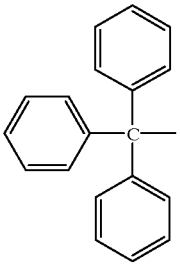 | —NHNH— | $—SO_2—$ | $—C_{12}H_{25}$ |
| 12 | 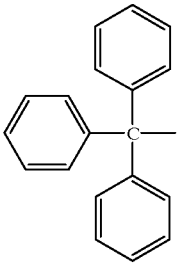 | —NHNH— | $—SO_2—$ | 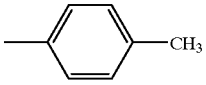 |

TABLE 2-continued
| No. | $R^2$ | —N—N— ($A^1$, $A^2$) | $G^1$ | $R^1$ |
|---|---|---|---|---|
| 13 | 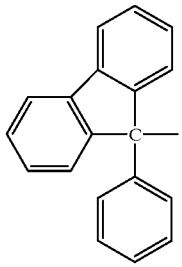 | —NHNH— | —$SO_2$— | 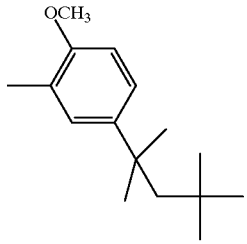 |
| 14 | 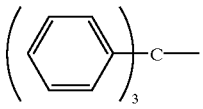 | —NHNH— | —$SO_2$— | —NHNH—$C(C_6H_5)_3$ |
| 15 | 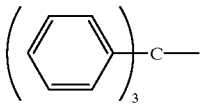 | —NHNH— | —$SO_2$— | —$NHC_8H_{17}$ (iso) |
| 16 | 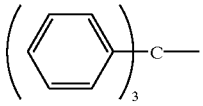 | —NHNH— | —$SO_2$— | 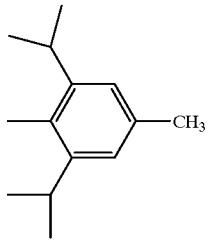 |
| 17 | 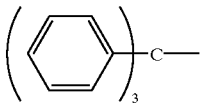 | —NHNH— | —$SO_2$— | 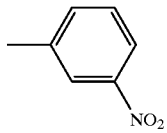 |
| 18 | 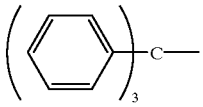 | —NHNH— | —$SO_2$— | 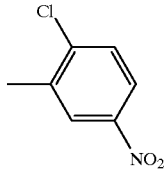 |

TABLE 3
| No. | $R^2$ | —N—N— ($A^1$, $A^2$) | $G^1$ | $R^1$ |
|---|---|---|---|---|
| 19 | 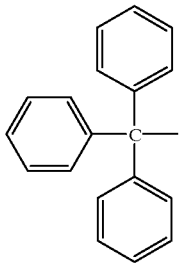 | —NHNH— | | 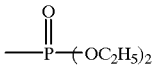 |
| 20 | 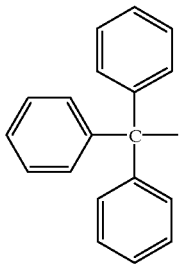 | —NHNH— | | 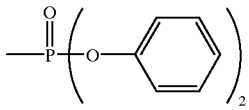 |
| 21 | 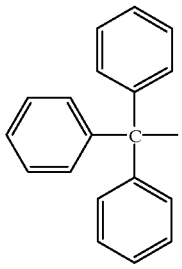 | —NHNH— | | 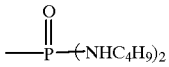 |
| 22 | 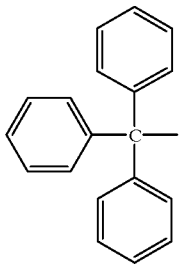 | —NHNH— | | 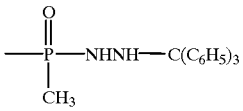 |
| 23 | 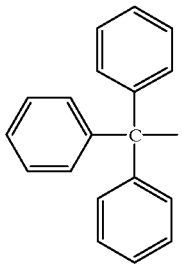 | —NHNH— | 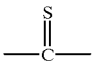 | —$NHC_8H_{17}$ |

TABLE 3-continued
| No. | $R^2$ | —N—N— ($A^1$, $A^2$) | $G^1$ | $R^1$ |
|---|---|---|---|---|
| 24 | 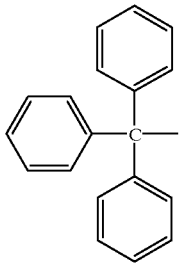 | —NHNH— | —S—C— | —NHNH—$C(C_6H_5)_3$ |
| 25 | 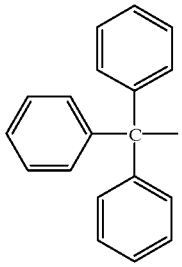 | —NHNH— | —S—C— | —NH— 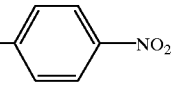 —$NO_2$ |
| 26 | 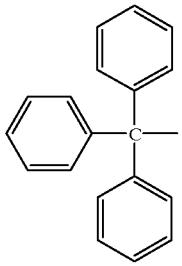 | —NHNH— | —SO— | —$CH_3$ |
| 27 | 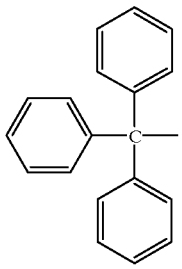 | —NHNH— | | 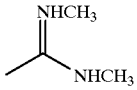 |

TABLE 4
| No. | $R^2$ | —N(A¹)—N(A²)— | $G^1$ | $R^1$ |
|---|---|---|---|---|
| 28 | $(C_6H_5)_2$—C(COOCH$_3$)— | —NHNH— | —COCO— | 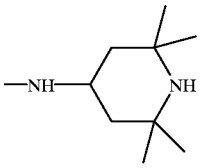 |
| 29 | $(C_6H_5)_2$—C(SCH$_3$)— | —NHNH— | —COCO— | —NHC$_3$H$_7$ |
| 30 | $(C_6H_5)_2$—C(OCH$_3$)— | —NHNH— | —COCO— | 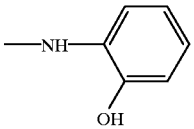 |
| 31 | $(C_6H_5)_2$—C(S—C$_6$H$_5$)— | —NHNH— | —COCO— | —OC(CH$_3$)$_3$ |
| 32 | $(C_6H_5)_2$—C(NHC$_3$H$_7$)— | —NHNH— | —COCO— | —N(C$_4$H$_9$)$_2$ |
| 33 | $(C_6H_5)_2$—C(S—C$_4$H$_9$)— | —NHNH— | —SO$_2$— | —CH$_3$ |
| 34 | $(C_6H_5)_2$—C(S—C$_6$H$_5$)— | —NHNH— | —SO$_2$— | 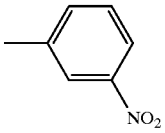 |
| 35 | $(C_6H_5)_2$—C(S—C$_6$H$_5$)— | —NHNH— | | —P(=O)—(OC$_4$H$_9$)$_2$ |
TABLE 5
| No. | $R^2$ | —N(A¹)—N(A²)— | $G^1$ | $R^1$ |
|---|---|---|---|---|
| 36 | $(C_6H_5)_2$—C(CONHC$_3$H$_7$)— | —NHNH— | —COCO— | —NHC$_3$H$_7$ |

TABLE 5-continued
| No. | $R^2$ | —N(A¹)—N(A²)— | $G^1$ | $R^1$ |
|---|---|---|---|---|
| 37 | 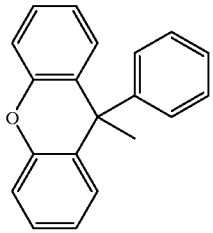 | —NHNH— | —COCO— | $—OC(CH_3)_3$ |
| 38 | 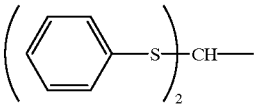 | —NHNH— | —COCO— | $—OC(CH_3)_3$ |
| 39 | 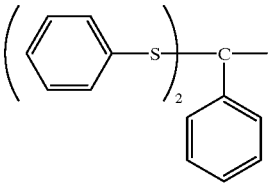 | —NHNH— | —COCO— | $—OC(CH_3)_3$ |
| 40 | 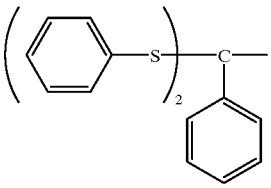 | —NHNH— | $—SO_2—$ | 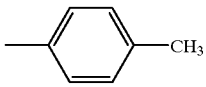 |
| 41 | 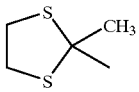 | —NHNH— | —COCO— | 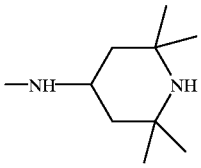 |
| 42 | 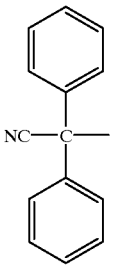 | —NHNH— | —COCO— | $—OC(CH_3)_3$ |
| 43 | $NC—C(CH_3)_2—$ | —NHNH— | —COCO— | $—OC(CH_3)_3$ |
| 44 | 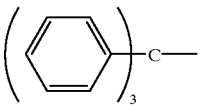 | —N(COCF₃)—NH— | $—SO_2—$ | 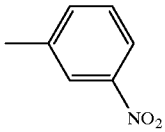 |

TABLE 6

| No. | $R^2$ | —N(A¹)—N(A²)— | $G^1$ | $R^1$ |
|---|---|---|---|---|
| 45 | 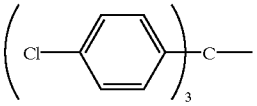 | 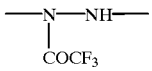 | —COCO— | $—OC(CH_3)_3$ |
| 46 | 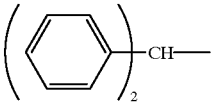 | —NHNH— | $—SO_2—$ | $—CF_3$ |
| 47 | 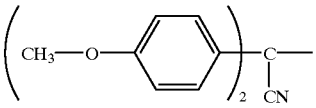 | —NHNH— | $—SO_2—$ | $—C_8F_{17}$ |
| 48 | 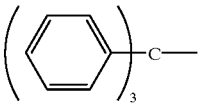 | —NHNH— | $—SO_2—$ | $—C_8F_{17}$ |
| 49 | 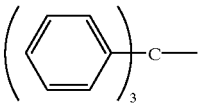 | —NHNH— | —COCO— | 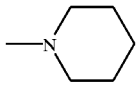 |
| 50 | 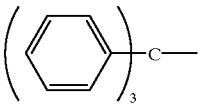 | —NHNH— | $—SO_2—$ | 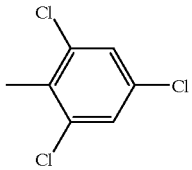 |

The compounds of the general formula (I) can be readily synthesized by well-known methods. Typical synthesis examples are given below.

Synthesis of Compound No. 1

Under ice cooling, 20 ml of an acetonitrile solution containing 5.9 grams of propylamine was added dropwise to 100 ml of an acetonitrile solution containing 19.0 grams of oxalyl diimidazole prepared from oxalyl chloride and imidazole. After the completion of dropwise addition, the solution was once heated to room temperature and ice cooled again whereupon 20 ml of an acetonitrile solution containing 3.2 grams of hydrazine anhydride was added dropwise. After the completion of dropwise addition, the solution was heated to room temperature to complete reaction.

To the reaction solution was added 14 ml of triethylamine. At room temperature, 27.8 grams of trityl chloride was added dropwise. After the completion of dropwise addition, the solution was heated to 40° C. and stirred for 1 hour. The reaction solution was poured into water whereupon the precipitated crystals were filtered, washed with water, and dried, obtaining 19.4 grams of compound No. 1.

Synthesis of Compound No. 3

The synthesis procedure of compound No. 1 was repeated except that aniline was used instead of propylamine, yielding compound No. 3.

Synthesis of Compound No. 10

By reacting methanesulfonylhydrazine with trityl chloride according to the synthesis procedure of compound No. 1, there was obtained compound No. 10.

Next, the general formula (II) is described:

(II)

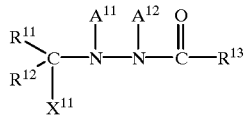

wherein each of $R^{11}$ and $R^{12}$ is an alkyl, alkenyl, alkynyl, aryl or heterocyclic group, $X^{11}$ is a hydrogen atom, alkyl, alkenyl, alkynyl, acyl, oxycarbonyl, carbamoyl, heterocyclic, cyano, a group having a bonding oxygen atom, a group having a bonding nitrogen atom or a group having a bonding sulfur atom, $R^{13}$ is a hydrogen atom, alkyl, aryl, heterocyclic, alkoxy, aryloxy, amino or hydrazine group, and $A^{11}$ and $A^{12}$ are both hydrogen atoms, or one of $A^{11}$ and $A^{12}$ is a hydrogen atom and the other is an alkylsulfonyl, arylsulfonyl or acyl group.

In formula (II), each of $R^{11}$ and $R^{12}$ is an alkyl, alkenyl, alkynyl, aryl or heterocyclic group. The alkyl groups represented by $R^{11}$ and $R^{12}$ are preferably normal, branched or cyclic alkyl groups having 1 to 16 carbon atoms, more preferably 1 to 10 carbon atoms, for example, methyl, ethyl, propyl, isopropyl, n-butyl, t-butyl, 2,4,4-trimethylpentyl, 2-butenyl, 2-hydroxyethyl, benzyl, 4-methylbenzyl, 2-methoxyethyl, cyclopentyl, and 2-acetamidoethyl. The alkenyl groups are preferably those having 2 to 18 carbon atoms, more preferably 2 to 10 carbon atoms, for example, vinyl and 2-styryl. The alkynyl groups are preferably those having 2 to 18 carbon atoms, more preferably 2 to 10 carbon atoms, for example, ethynyl and phenylethynyl.

The aryl groups represented by $R^{11}$ and $R^{12}$ are preferably those aryl groups having 6 to 24 carbon atoms, more preferably 6 to 12 carbon atoms, for example, phenyl, naphthyl, and p-methoxyphenyl. The heterocyclic groups are preferably five- or six-membered, saturated or unsaturated heterocyclic rings having 1 to 5 carbon atoms and at least one oxygen, nitrogen or sulfur atom in which the number and type of hetero atoms constituting the ring may be one or more, for example, 2-furyl, 2-thienyl, 4-pyridyl, 2-pyridyl, 2-benzothiazolyl, imidazolino, and 2-tetrahydrofuranyl.

The groups represented by $R^{11}$ and $R^{12}$ may have a substituent. Exemplary substituents include alkyl, alkenyl, alkynyl, hydroxyl, mercapto, nitro, carboxyl, cyano, halogen, aryl, heterocyclic (inclusive of quaternized nitrogen atom-bearing ones), mercapto-substituted heterocyclic, alkoxy (inclusive of groups containing recurring ethyleneoxy or propyleneoxy units), aryloxy, acylamino, thioamide, alkylamino, anilino, quaternary ammonium, ureido, thioureido, sulfamoylamino, alkylthio, arylthio, tertiary sulfonium, alkoxycarbonylamino, sulfonamide, carbamoyl, thiocarbamoyl, sulfamoyl, sulfonyl, alkoxycarbonyl, heterocyclic oxy, azo, acyloxy, carbamoyloxy, silyl, silyloxy, aryloxycarbonylamino, imide, heterocyclic thio, sulfinyl, phosphonyl, aryloxycarbonyl, acyl, and thiocarbonyl groups and combinations thereof. Preferred substituents are alkyl, alkoxy, acylamino, sulfonamide, ureido and phosphoric acid amide groups.

$R^{11}$ and $R^{12}$, taken together, may form a ring. $R^{11}$ and $R^{12}$ are preferably alkyl, aryl or heterocyclic groups, more preferably alkyl, aryl or aromatic heterocyclic groups.

$X^{11}$ is a hydrogen atom, alkyl, alkenyl, alkynyl, acyl, oxycarbonyl, carbamoyl, heterocyclic, cyano, a group having a bonding oxygen atom, a group having a bonding nitrogen atom or a group having a bonding sulfur atom. The alkyl, alkenyl, alkynyl and heterocyclic groups represented by $X^{11}$ include those described for $R^{11}$. The acyl groups represented by $X^{11}$ are preferably those having 1 to 18 carbon atoms, for example, acetyl and benzoyl. The oxycarbonyl groups are typically alkoxycarbonyl and aryloxycarbonyl groups, preferably alkoxycarbonyl groups having 2 to 18 carbon atoms, for example, methoxycarbonyl and benzyloxycarbonyl and aryloxycarbonyl groups having 7 to 18 carbon atoms, for example, phenoxycarbonyl. The carbamoyl groups are preferably those having 1 to 18 carbon atoms, for example, carbamoyl, N-ethylcarbamoyl, N-octylcarbamoyl and N-phenylcarbamoyl.

The groups having a bonding oxygen atom represented by $X^{11}$ include alkoxy, aryloxy, heterocyclic oxy, acyloxy and carbamoyloxy groups. The alkoxy groups are those having 1 to 16 carbon atoms, preferably having 1 to 10 carbon atoms, for example, methoxy and 2-methoxyethoxy. The aryloxy groups are those having 6 to 24 carbon atoms, for example, phenoxy and p-methoxyphenoxy. The heterocyclic oxy groups are five- or six-membered, saturated or unsaturated heterocyclic oxy groups having 1 to 5 carbon atoms and at least one oxygen, nitrogen or sulfur atom in which the number and type of hetero atoms constituting the ring may be one or more, for example, 2-thiazolyloxy, 2-tetrahydropyranyloxy and 2-pyridyloxy. The acyloxy groups are those having 1 to 16 carbon atoms, preferably 1 to 10 carbon atoms, for example, acetoxy and benzoyloxy. The carbamoyloxy groups are those having 1 to 16 carbon atoms, preferably having 1 to 10 carbon atoms, for example, N,N-dimethylcarbamoyloxy, N-hexylcarbamoyloxy and N-phenylcarbamoyloxy.

The groups having a bonding nitrogen atom represented by $X^{11}$ include acylamino, mono- or dialkylamino, arylamino, and heterocyclic amino groups. The acylamino groups are those having 1 to 16 carbon atoms, preferably having 1 to 10 carbon atoms, for example, acetamide and p-chlorobenzoylamide. The alkylamino groups are those having 1 to 16 carbon atoms, preferably having 1 to 10 carbon atoms, for example, N,N-dimethylamino. The arylamino groups are those having 6 to 24 carbon atoms, for example, anilino. The heterocyclic amino groups are five- or six-membered, saturated or unsaturated heterocyclic amino groups having 1 to 5 carbon atoms and at least one oxygen, nitrogen or sulfur atom in which the number and type of hetero atoms constituting the ring may be one or more, for example, 2-oxazolylamino, 2-tetrahydropyranylamino and 4-pyrazylamino.

The groups having a bonding sulfur atom represented by $X^{11}$ include alkylthio, arylthio, heterocyclic thio, sulfamoyl, sulfonyl and sulfinyl groups. The alkylthio groups are those having 1 to 16 carbon atoms, preferably having 1 to 10 carbon atoms, for example, methylthio and 2-phenoxyethylthio. The arylthio groups are those having 6 to 24 carbon atoms, for example, phenylthio and 2-carboxyphenylthio. The heterocyclic thio groups are five- or six-membered, saturated or unsaturated heterocyclic thio groups having 1 to 5 carbon atoms and at least one oxygen, nitrogen or sulfur atom in which the number and type of hetero atoms constituting the ring may be one or more, for example, 2-benzothiazoylthio and 2-pyridylthio. The sulfamoyl groups are those having 0 to 16 carbon atoms, preferably having 0 to 10 carbon atoms, for example, methylsulfamoyl and phenylsulfamoyl. The sulfonyl groups are those having 1 to 16 carbon atoms, preferably having 1 to 10 carbon atoms, for example, methanesulfonyl and benzenesulfonyl. The sulfinyl groups are those having 1 to 16 carbon atoms, preferably having 1 to 10 carbon atoms, for example, methanesulfinyl and benzenesulfinyl.

These groups may further have a substituent as mentioned for $R^{11}$.

Preferably $X^{11}$ is an alkyl, carbamoyl, alkoxycarbonyl, aryloxycarbonyl, acyl, cyano, heterocyclic, alkoxy, arylxoy, sulfamoyl or sulfonyl group, more preferably an alkyl, carbamoyl, alkoxycarbonyl, heterocyclic or alkoxy group, most preferably an alkyl, carbamoyl, alkoxycarbonyl or heterocyclic group.

$R^{13}$ is a hydrogen atom, alkyl, aryl, heterocyclic, alkoxy, aryloxy, amino or hydrazine group. These groups are the same as mentioned for $R^{11}$ while they may further have a substituent as mentioned for $R^{11}$.

Preferably, $R^{13}$ is hydrogen, alkyl groups (e.g., methyl, trifluoromethyl, difluoromethyl, 2-carboxytetrafluoroethyl, pyridiniomethyl, 3-hydroxypropyl, 3-methanesulfonamidopropyl and phenylsulfonylmethyl), aralkyl groups (e.g., o-hydroxybenzyl) or aryl groups (e.g., phenyl, 3,5-dichlorophenyl, o-methanesulfonamidophenyl, o-carbamoylphenyl, 4-cyanophenyl and 2-hydroxymethylphenyl), with the hydrogen and alkyl groups being especially preferred.

$R^{13}$ may be such a group as to induce cyclization reaction to cleave a —CO—$R^{13}$ moiety from the remaining molecule to generate a cyclic structure containing the atoms of the —CO—$R^{13}$ moiety. Such examples are described in JP-A 29751/1988, for example.

$A^{11}$ and $A^{12}$ are both hydrogen atoms, or one of $A^{11}$ and $A^{12}$ is a hydrogen atom and the other is an alkylsulfonyl, arylsulfonyl or acyl group. The alkylsulfonyl groups represented by $A^{11}$ and $A^{12}$ are those having up to 20 carbon atoms, preferably up to 10 carbon atoms, for example, methanesulfonyl and trifluoromethanesulfonyl. The arylsulfonyl groups represented by $A^{11}$ and $A^{12}$ are those having up to 20 carbon atoms, preferably up to 12 carbon atoms, for example, benzenesulfonyl and benenesulfonyl substituted such that the sum of Hammette's substituent constants $\sigma_m$ may be 0 or more positive. The acyl groups are aliphatic and aromatic acyl groups having up to 20 carbon atoms, preferably up to 12 carbon atoms. The aliphatic acyl groups are normal, branched or cyclic, substituted or unsubstituted aliphatic acyl groups, exemplary substituents including halogen atoms, ether, sulfonamide, carbonamide, hydroxyl, carboxy and sulfonate groups. Acetyl and trifluoroacetyl are exemplary aliphatic acyl groups. The aromatic acyl groups are substituted or unsubstituted benzoyl groups. When substituted, the benzoyl groups are substituted such that the sum of Hammette's substituent constants $\sigma_m$ may be 0 or more positive. Most preferably, both $A^{11}$ and $A^{12}$ are hydrogen atoms.

Each of $R^{11}$ to $R^{13}$ and $X^{11}$ in formula (II) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

Each of $R^{11}$ to $R^{13}$ and $X^{11}$ in formula (II) may have incorporated therein a group capable of adsorbing to silver halide. Such adsorptive groups include alkylthio, arylthio, thiourea, thioamide, thiourethane, mercaptoalkyl, mercaptoaryl, mercapto heterocyclic (e.g., 5-mercaptotetrazole, 3-mercapto-1,2,4-triazole, 2-mercapto-1,3,4-thiadiazole, and 2-mercapto-1,3,4-oxadiazole), and five- or six-membered nitrogenous heterocyclic groups to form imino silver (e.g., benzotriazole). These groups are described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. The silver halide adsorbing groups may take the form of precursors. Such precursors are described in JP-A 285344/1990.

The compound of formula (II) may contain a plurality of hydrazino groups as substituents. In this case, the compound of formula (II) is an oligomer of hydrazino groups.

Preferred among the compounds of formula (II) are those of the following general formula (IIa):

(IIa)

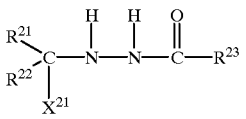

wherein each of $R^{21}$ and $R^{22}$ is a substituted or unsubstituted alkyl or phenyl group, $X^{21}$ is an alkyl, oxycarbonyl, carbamoyl or heterocyclic group, and $R^{23}$ is a hydrogen atom, alkyl, aryl, heterocyclic, alkoxy or amino group. Substituents on these groups are as described for $R^{11}$ in formula (II).

Illustrative, non-limiting, examples of the hydrazine derivative represented by formula (II) are given below.

1-1

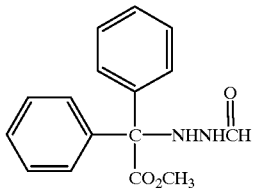

1-2

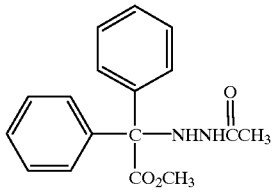

1-3

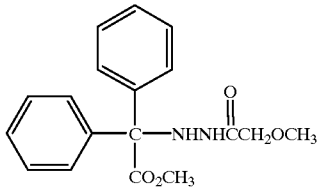

1-4

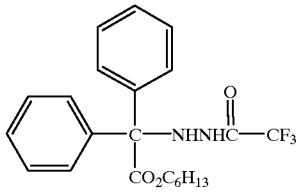

1-5

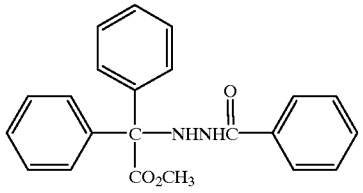

1-6

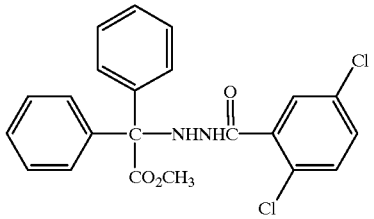

-continued
1-7
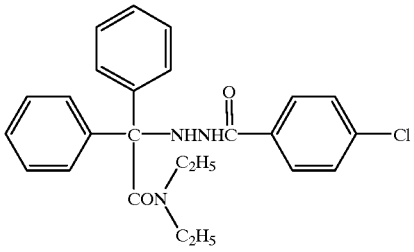
1-8
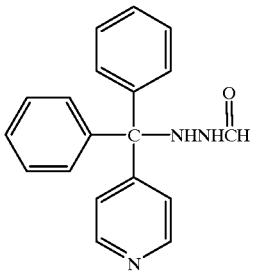
1-9
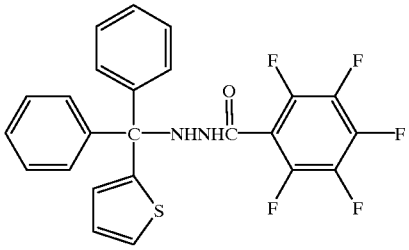
1-10
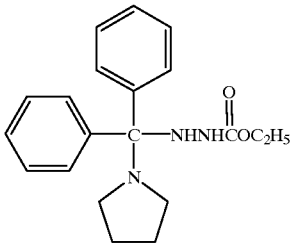
1-11
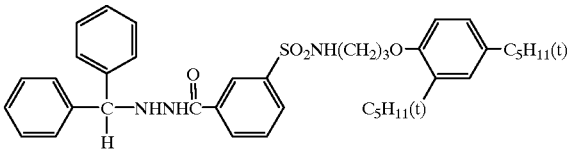
1-12
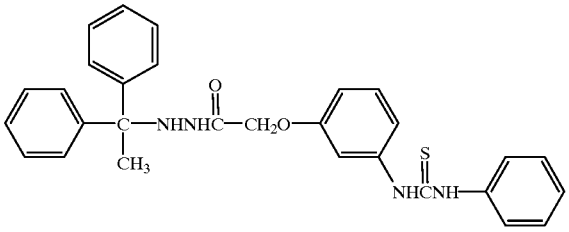
-continued
1-13
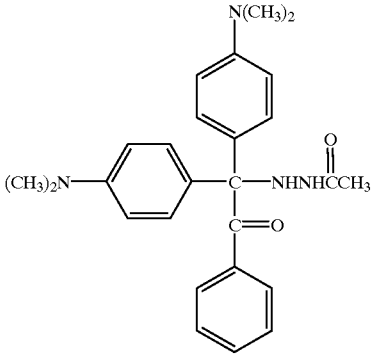
1-14
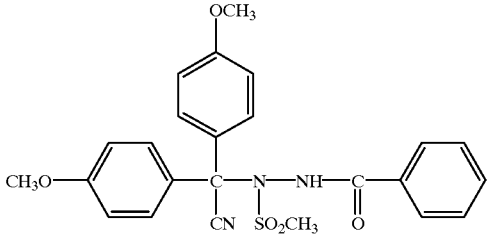
1-15
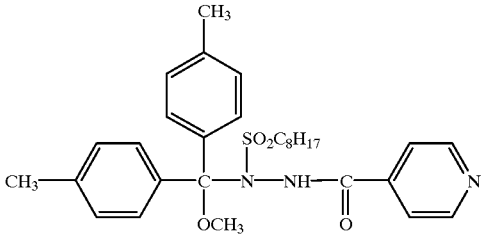
1-16
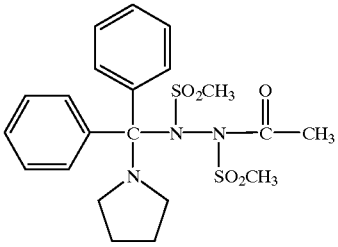
1-17
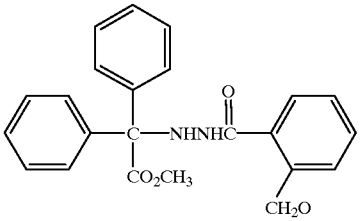

-continued 1-18

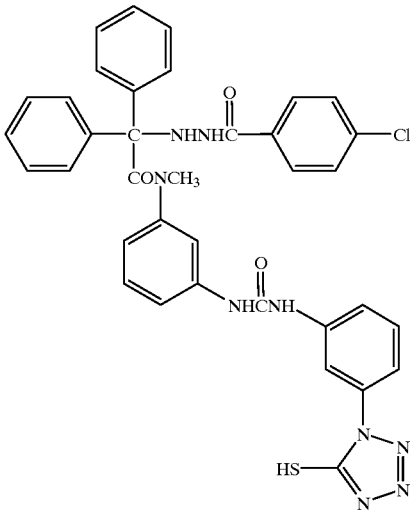

1-19

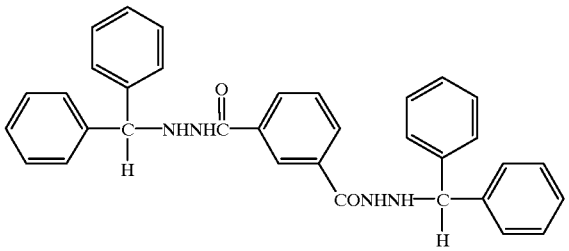

1-20

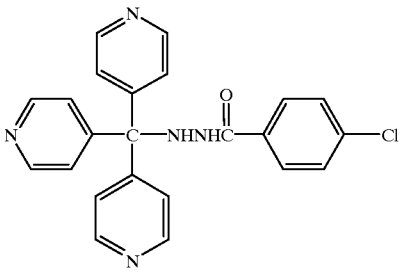

1-21

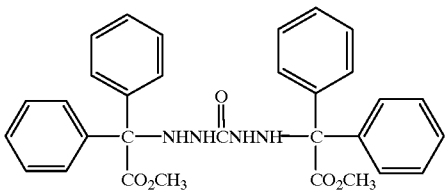

1-22

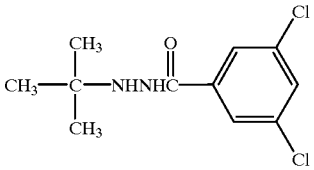

-continued 1-23

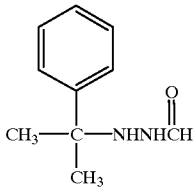

1-24

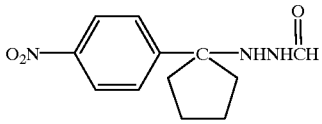

1-25

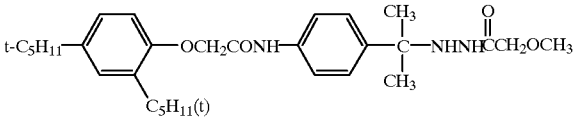

The compounds of the general formula (II) can be synthesized according to the method described in JP-A 198849/1987. More particularly, they can be synthesized by reacting $(R^{11})(R^{12})(X^{11})C—X$ with $HNA^{11}—NA^{12}—COR^{13}$ in a suitable organic solvent in the presence of a suitable base wherein X is a halogen atom or sulfonyloxy group. The solvents used herein are, for example, alcohols such as methanol, ethanol, 2-propanol and methyl cellosolve, ketones such as acetone and methyl ethyl ketone, amides such as N,N-dimethylformamide and N-methylpyrrolidone, ethers such as tetrahydrofuran and ether, esters such as ethyl acetate, and dimethylsulfoxide. The bases used herein are, for example, organic bases such as triethylamine, pyridine, dimethylaniline, and N-methylmorpholine and inorganic bases such as potassium carbonate and sodium bicarbonate. The reactant $(R^{11})(R^{12})(X^{11})C—X$ can be synthesized by halogenating (reacting with $SOCl_2$ or $PBr_3$) or sulfonylating (reacting with sulfonyl chloride) a corresponding alcohol compound wherein X is OH.

Next described are the compounds of the general formula (III):

(III)

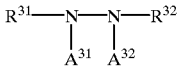

wherein $R^{32}$ is an aliphatic group, $R^{31}$ is an alkyl, aryl or heterocyclic group having at least one electron attractive or donative group, $A^{31}$ and $A^{32}$ are both hydrogen atoms, or one of $A^{31}$ and $A^{32}$ is a hydrogen atom and the other is a substituted or unsubstituted alkylsulfonyl, arylsulfonyl or acyl group.

The aliphatic group represented by $R^{32}$ in formula (III) includes, for example, substituted or unsubstituted, linear, branched or cyclic alkyl, alkenyl and alkynyl groups having 1 to 30 carbon atoms.

Where these groups have a substituent, exemplary substituents include an alkyl group, alkenyl group, alkynyl group, aryl group, heterocyclic group, quaternized nitrogen atom-bearing heterocyclic group (e.g., pyridinio), hydroxy group, alkoxy group (inclusive of groups containing recurring ethyleneoxy or propyleneoxy units), aryloxy group, acyloxy group, acyl group, alkoxycarbonyl group, aryloxycarbonyl group, carbamoyl group, urethane group, carboxyl group, imide group, amino group, carbonamide group, sulfonamide group, ureido group, thioureido group, sulfamoylamino group, semicarbazide group, thiosemicarbazide group, hydrazino group, quaternary ammonio group, (alkyl, aryl or heterocyclic) thio group, mercapto group, (alkyl or aryl)sulfonyl group, (alkyl or aryl)sulfinyl group, sulfo group, sulfamoyl group, acylsulfamoyl group, (alkyl or aryl)sulfonylureido group, (alkyl or aryl)sulfonylcarbamoyl group, halogen atom, cyano group, nitro group, phosphoric acid amide group, phosphate structure-bearing group, acyl urea structure-bearing group, selenium or tellurium atom-containing group, and tertiary or quaternary sulfonium structure-bearing group. These substituents may further have an analogous substituent.

In formula (III), $R^{32}$ is preferably alkyl. For substituted alkyl groups, the substituents are preferably aryl, heterocyclic, (alkyl or aryl)thio, cyano, alkoxy, aryloxy, alkoxycarbonyl, aryloxycarbonyl and carbamoyl groups.

Also preferably $R^{32}$ is a tri-substituted methyl group in which the substituents are preferably aryl, heterocyclic, (alkyl or aryl)thio, cyano, alkoxy, aryloxy, alkoxycarbonyl, aryloxycarbonyl and carbamoyl groups. More preferably $R^{32}$ is a methyl group having two aryl groups and one substituent selected from aryl, heterocyclic, (alkyl or aryl) thio, cyano, alkoxy, aryloxy, alkoxycarbonyl, aryloxycarbonyl and carbamoyl groups. Most preferably $R^{32}$ is a methyl group substituted with three aryl groups.

In formula (III), each of $A^{31}$ and $A^{32}$ is a hydrogen atom, or a substituted or unsubstituted alkyl or arylsulfonyl group having up to 20 carbon atoms (preferably a phenylsulfonyl group, or a phenylsulfonyl group substituted such that the sum of Hammette's substituent constants may be −0.5 or more), or substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxyl group and sulfonate group). Most preferably, both $A^{31}$ and $A^{32}$ are hydrogen atoms.

In formula (III), $R^{31}$ is an alkyl, aryl or heterocyclic group having at least one electron attractive or donative group. By the terms electron attractive and donative groups are meant substituents whose Hammette's substituent constant $\sigma_m$ has positive and negative values, respectively. More illustratively, almost all substituents except for hydrogen are relevant. Exemplary substituents include alkyl, aryl, heterocyclic, alkoxy, aryloxy, acyloxy, acyl, alkoxycarbonyl, aryloxycarbonyl, carbamoyl, carboxyl, imide, carbonamide, sulfonamide, ureido, thioureido, (alkyl, aryl or heterocyclic) thio, (alkyl or aryl)sulfonyl, sulfo, sulfamoyl, halogen, cyano, nitro, amino, and (alkyl, aryl or heterocyclic) amino groups. These substituents may further have any desired substituent.

Where $R^3$ represents a substituted group, the substituent may be the same as mentioned for $R^{32}$.

$R^{31}$ and $R^{32}$ in formula (III) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^{31}$ and $R^{32}$ in formula (III) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. The silver halide adsorbing groups may take the form of precursors. Such precursors are described in JP-A 285344/1990.

$R^{31}$ and $R^{32}$ in formula (III) may contain a plurality of hydrazino groups as substituents. In this case, the compound of formula (III) is an oligomer of hydrazino groups, examples of which are described in JP-A 86134/1989, 16938/1992 and 197091/1993.

Illustrative, non-limiting, examples of the hydrazine derivative represented by formula (III) are given below.

TABLE 7

| No. | $R^{32}$ | —N(A31)—N(A32)— | $R^{31}$ |
|---|---|---|---|
| H-1 | 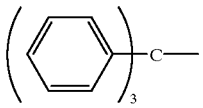 | —NHNH— | 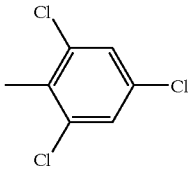 |
| H-2 | 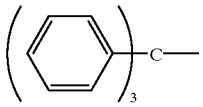 | —NHNH— | 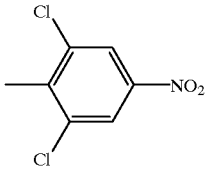 |

TABLE 7-continued
| No. | $R^{32}$ | —N—N— ($A^{31}$ $A^{32}$) | $R^{31}$ |
|---|---|---|---|
| H-3 | 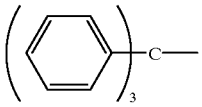 | —NHNH— | 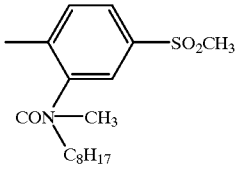 |
| H-4 | 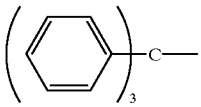 | —NHNH— | 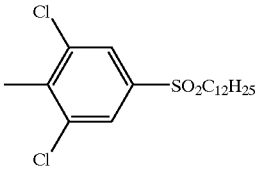 |
| H-5 | 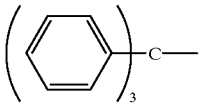 | —NHNH— | 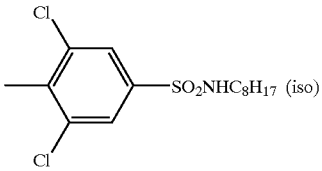 |
| H-6 | 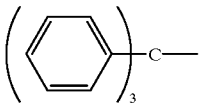 | —NHNH— | 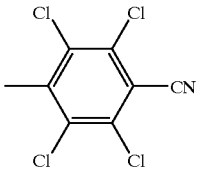 |
| H-7 | 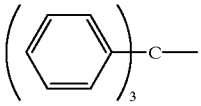 —NHNH— | 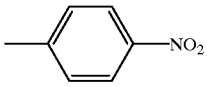 | |
| H-8 | 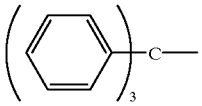 | —NHNH— | 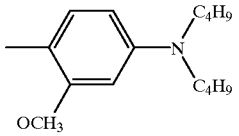 |
TABLE 8
| No. | $R^{32}$ | —N—N— ($A^{31}$ $A^{32}$) | $R^{31}$ |
|---|---|---|---|
| H-9 | 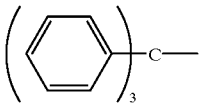 | —NHNH— | 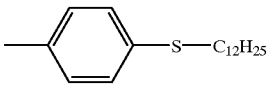 |
| H-10 | 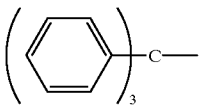 | —NHNH— | 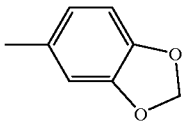 |

TABLE 8-continued
| No. | $R^{32}$ | —N—N— ($A^{31}$ $A^{32}$) | $R^{31}$ |
|---|---|---|---|
| H-11 | 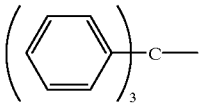 | —NHNH— | 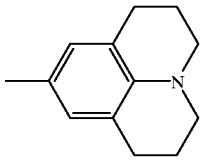 |
| H-12 | 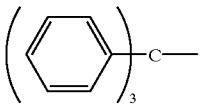 | —NHNH— | 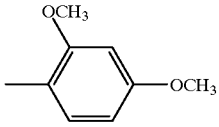 |
| H-13 | 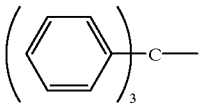 | —NHNH— | 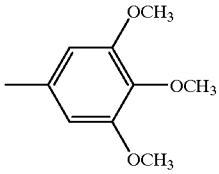 |
| H-14 | 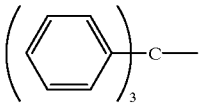 | —NHNH— | 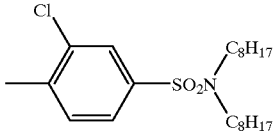 |
| H-15 | 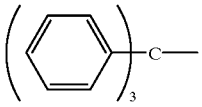 | —NHNH— | 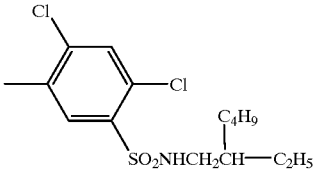 |
| H-16 | 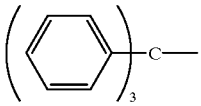 | —NHNH— | 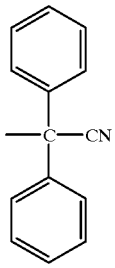 |
TABLE 9
| No. | $R^{32}$ | —N—N— ($A^{31}$ $A^{32}$) | $R^{31}$ |
|---|---|---|---|
| H-17 | 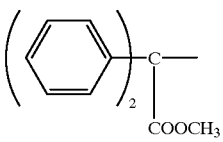 | —NHNH— | 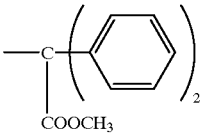 |

TABLE 9-continued
| No. | $R^{32}$ | —N—N— ($A^{31}$, $A^{32}$) | $R^{31}$ |
|---|---|---|---|
| H-18 | 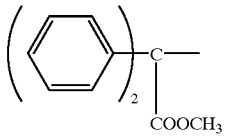 | —NHNH— | 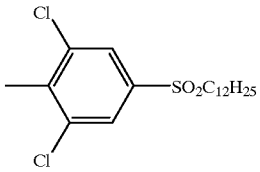 |
| H-19 | 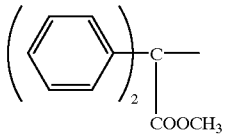 | —NHNH— | 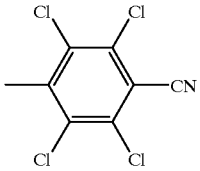 |
| H-20 | 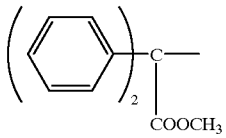 | —NHNH— | 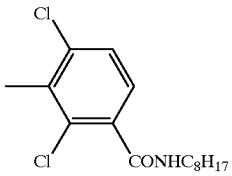 |
| H-21 | 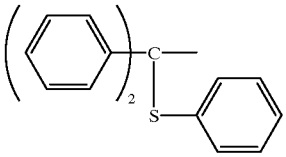 | —NHNH— | 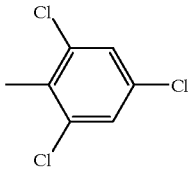 |
| H-22 | 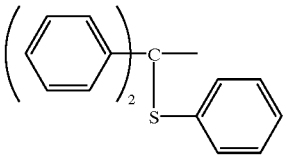 | —NHNH— | 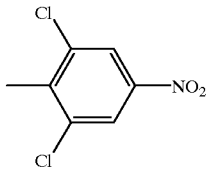 |
| H-23 | 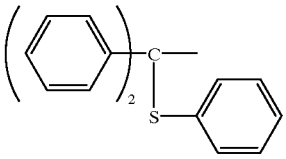 | —NHNH— | 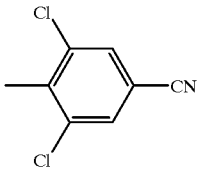 |
| H-24 | 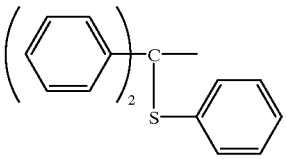 | —NHNH— | 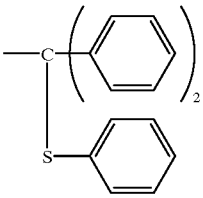 |

TABLE 10
| No. | $R^{32}$ | —N(A31)—N(A32)— | $R^{31}$ |
|---|---|---|---|
| H-25 | NC—C(CH3)2— | —NHNH— | —C(CH3)2CN |
| H-26 | 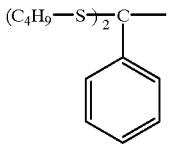 | —NHNH— | 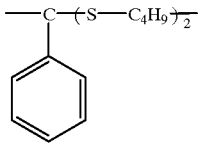 |
| H-27 | 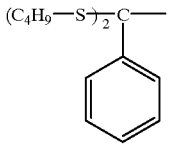 | —NHNH— | 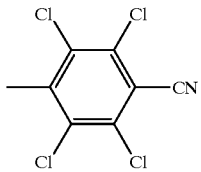 |
| H-28 | 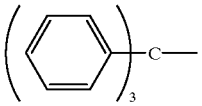 | —NHNH— | 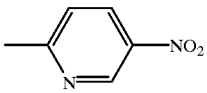 |
| H-29 | 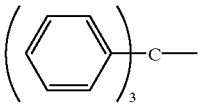 | —NHNH— | 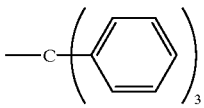 |
| H-30 | 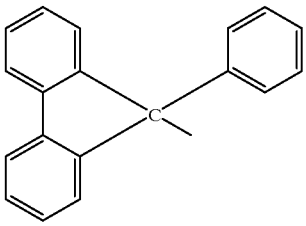 | —NHNH— | 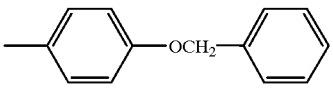 |
| H-31 | 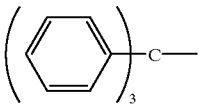 | —NH—N(COCF3)— | 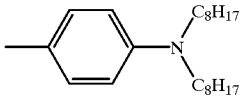 |
| H-32 | 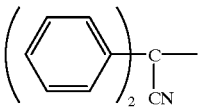 | —NHNH— | 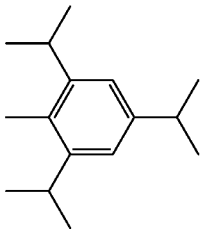 |

TABLE 11

| No | $R^{32}$ | —N(A31)—N(A32)— | $R^{31}$ |
|---|---|---|---|
| H-33 | 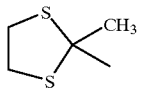 | —NHNH— | 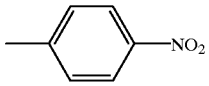 |
| H-34 | 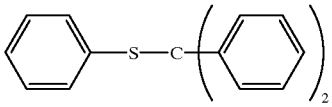 | —NH—N(COCF3)— | 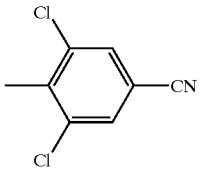 |
| H-35 | 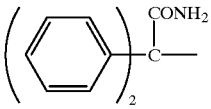 | —NHNH— | 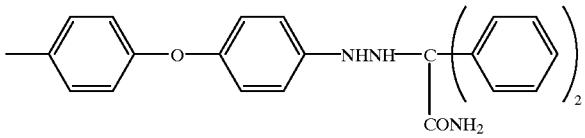 |
| H-36 | 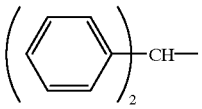 | —NHNH— | 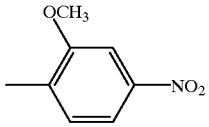 |
| H-37 | 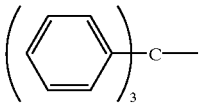 | —NHNH— | 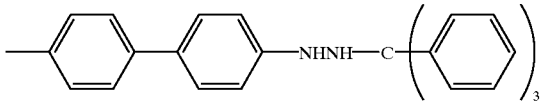 |
| H-38 | 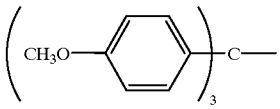 | —NHNH— | 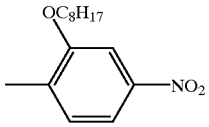 |
| H-39 | 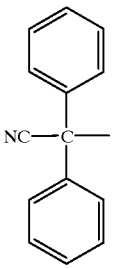 | —NHNH— | 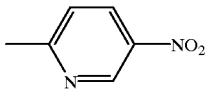 |
| H-40 | 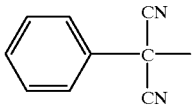 | —NHNH— | 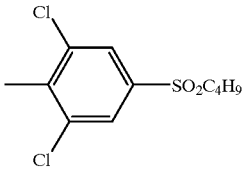 |

The compounds of the general formula (III) can be readily synthesized by well-known methods. For example, compounds H-1 and H-3 can be synthesized in the same manner as Synthesis Examples of compounds D-2 and D-39 in JP-A 5 86354/1987.

Next, the hydrazine compounds of the general formula (IV) are described.

$$A^{40}—NHNH—R^{40} \quad (IV)$$

$A^{40}$ is a heterocyclic group having at least one sulfur or oxygen atom, and $R^{40}$ is a formyl, substituted or unsubstituted acyl, sulfonyl, carbamoyl, sulfamoyl, alkoxycarbonyl, thioacyl or —(C=O)—(C=O)—$X^{40}$ group wherein $X^{40}$ is —$NR^{41}R^{42}$ or —$OR^{43}$ wherein each of $R^{41}$, $R^{42}$ and $R^{43}$ is a hydrogen atom, substituted or unsubstituted alkyl, aryl or heterocyclic group, or $R^{41}$ and $R^{42}$, taken together, may form a heterocyclic ring with the nitrogen atom.

In formula (IV), H of —NHNH—, that is, the hydrogen atom of hydrazine may be replaced by a substituent such as sulfonyl (e.g., methanesulfonyl and toluenesulfonyl), acyl (e.g., acetyl and trifluoroacetyl) and oxalyl (e.g., ethoxalyl). Such substituted compounds are encompassed within the scope of formula (IV).

Examples of the heterocyclic group represented by $A^{40}$ include thiophene, furan, benzothiophene, pyran, isobenzofuran, chromene, oxazole, and thiazole, the thiophene and furan being preferred.

Illustrative groups of $R^{40}$ are formyl, acyl (e.g., acetyl, trifluoroacetyl, α-(2,4-di-t-amylphenoxy)acetyl, methoxyacetyl, cyanoacetyl and benzoyl), sulfonyl (e.g., methylsulfonyl, toluenesulfonyl and 4-dodecyloxybenzenesulfonyl), carbamoyl (e.g., carbamoyl, dodecylcarbamoyl and dimethylcarbamoyl), sulfamoyl (e.g., sulfamoyl, butylsulfamoyl and dimethylsulfamoyl), alkoxycarbonyl (e.g., methoxycarbonyl and tetradecyloxycarbonyl), thioacyl (e.g., thioformyl and thioacetyl), —(C=O)—(C=O)—$NR^{41}R^{42}$, and —(C=O)—(C=O)—$OR^{43}$. Each of $R^{41}$, $R^{42}$ and $R^{43}$ is hydrogen, alkyl (e.g., methyl, ethyl and methoxyethyl), aryl (e.g., phenyl, p-methoxyphenyl and α-naphthyl), and heterocyclic groups (e.g., pyridyl and thienyl). Alternatively, $R^{41}$ and $R^{42}$, taken together, form a ring with the nitrogen atom, for example, a heterocyclic ring such as morpholine. Preferred groups represented by $R^{40}$ are formyl, acyl, —(C=O)—(C=O)—$NR^{41}R^{42}$, and —(C=O)—(C=O)—$OR^{43}$.

The heterocyclic groups having at least one sulfur or oxygen atom, represented by $R^{40}$, may have various substituents. Examples of the substituent which can be incorporated include halogen atoms, alkyl, aryl, alkoxy, aryloxy, acyloxy, alkylthio, arylthio, sulfonyl, alkoxycarbonyl, aryloxycarbonyl, carbamoyl, sulfamoyl, acyl, amino, alkylamino, arylamino, acylamino, sulfonamide, arylaminothiocarbonylamino, hydroxy, carboxy, sulfo, nitro and cyano groups.

The compounds of the general formula (IV) may have a nondiffusing group or a silver halide adsorption promoting group in a molecule. The nondiffusing group is preferably a ballast group commonly used in immobile photographic additives such as couplers. The ballast group is a group having at least 8 carbon atoms and relatively inert with respect to photographic properties, for example, alkyl, alkoxy, phenyl, alkylphenyl, phenoxy, and alkylphenoxy groups. The silver halide adsorption promoting groups include thiourea, thiourethane, heterocyclic thioamide, mercapto heterocyclic, and triazole groups as described in U.S. Pat. No. 4,385,108.

Typical non-limiting examples of the compound of the general formula (IV) are given below.

H-I-1

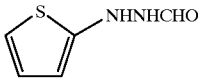

-continued

H-I-2

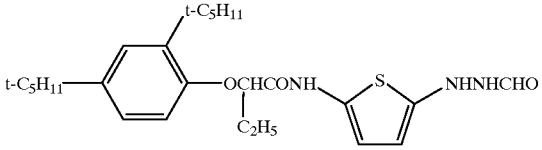

H-I-3

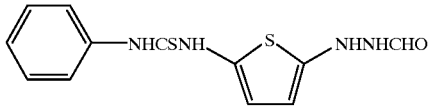

H-I-4

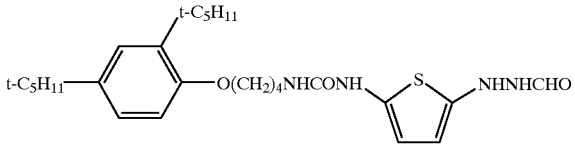

H-I-5

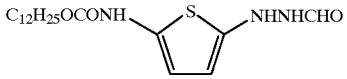

H-I-6

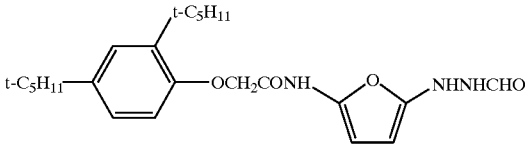

H-I-7

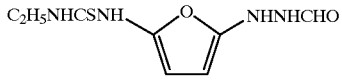

H-I-8

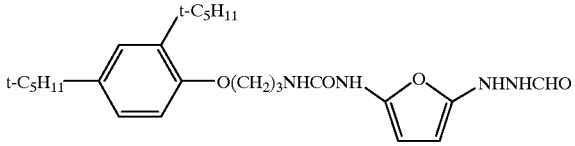

H-I-9

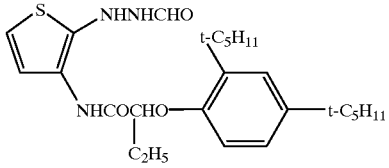

H-I-10

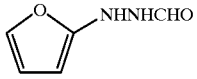

H-I-11

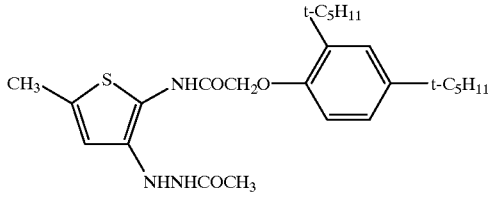

-continued
H-I-12
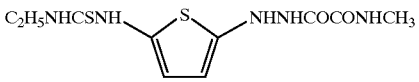
H-I-13
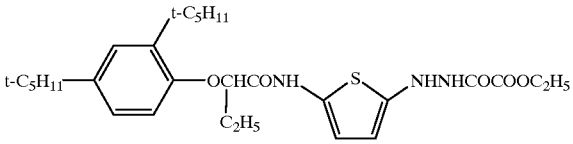
H-I-14
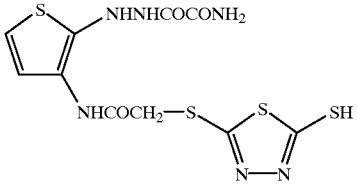
H-I-15
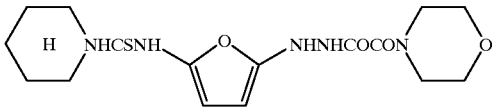
H-I-16
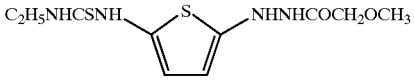
H-I-17
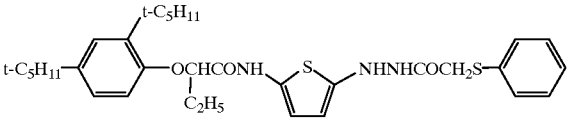
H-I-18
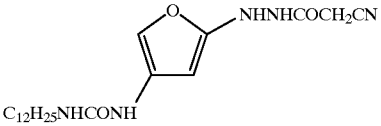
H-I-19
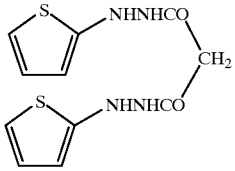
H-I-20
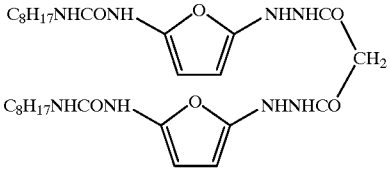
H-I-21
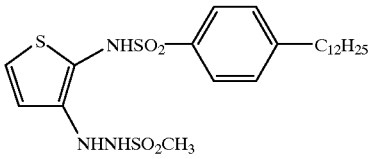
-continued
H-I-22
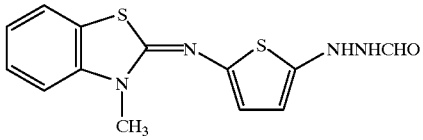
H-I-23
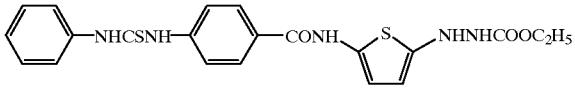
H-I-24
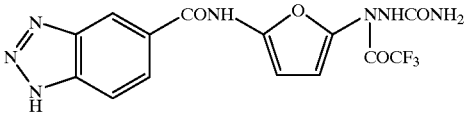
H-I-25
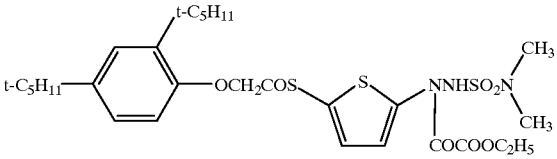
H-I-26
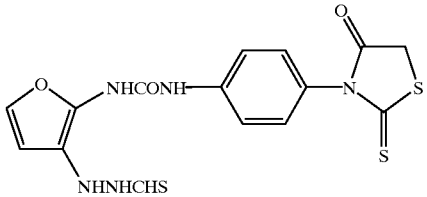
H-I-27
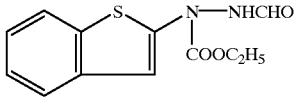
H-I-28
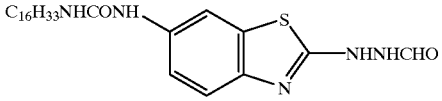
H-I-29
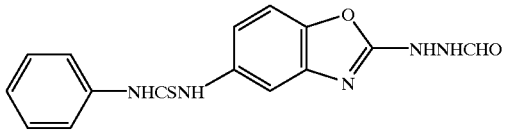
H-I-30
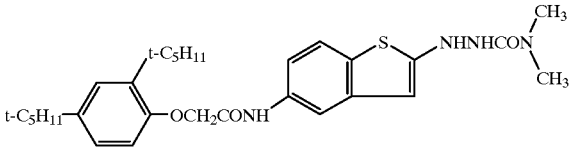
The hydrazine compounds of the general formula (V) are described.

(V)

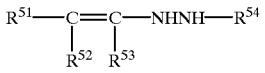

$R^{51}$ is a monovalent organic group, each of $R^{52}$ and $R^{53}$ is a hydrogen atom, halogen atom or substituted or unsubstituted alkyl group, $R^{54}$ is a formyl, substituted or unsubstituted acyl, sulfonyl, carbamoyl, sulfamoyl, alkoxycarbonyl, thioacyl or —(C═O)—(C═O)—$X^{40}$ group wherein $X^{40}$ is —$NR^{41}R^{42}$ or —$OR^{43}$ wherein each of $R^{41}$, $R^{42}$ and $R^{43}$ is a hydrogen atom, substituted or unsubstituted alkyl, aryl or heterocyclic group, or $R^{41}$ and $R^{42}$, taken together, may form a ring with the nitrogen atom, The monovalent organic residues represented by $R^{51}$ include aromatic, heterocyclic and aliphatic residues. The aromatic residues include phenyl, naphthyl, substituted phenyl and substituted naphthyl. The substituents are, for example, alkyl, alkoxy, acylhydrazino, dialkylamino, alkoxycarbonyl, cyano, carboxyl, nitro, alkylthio, hydroxy, sulfonyl, carbamoyl, halogen, acylamino, sulfonamide, and thiourea groups. Exemplary of the substituted phenyl group are 4-methylphenyl, 4-ethylphenyl, 4-oxyethylphenyl, 4-dodecylphenyl, 4-carboxyphenyl, 4-diethylaminophenyl, 4-octylaminophenyl, 4-benzylaminophenyl, 4-acetamide-2-methylphenyl, 4-(3-ethylthioureido)phenyl, 4-[2-(2,4-di-tert-butylphenoxy)butylamide]phenyl, and 4-[2-(2,4-didodecylphenoxy)butylamide]phenyl.

The heterocyclic residues represented by $R^{51}$ are, for example, five- or six-membered monocyclic or fused ring having at least one of oxygen, nitrogen, sulfur and selenium atoms, which may have a substituent. Exemplary are residues of pyrroline, pyridine, quinoline, indole, oxazole, benzoxazole, naphthoxazole, imidazole, benzimidazole, thiazoline, thiazole, benzothiazole, naphthothiazole, selenazole, benzoselenazole, and naphthoselenazole rings. These heterocyclic rings may have substituents, for example, alkyl groups such as methyl, ethyl and dodecyl, alkoxy groups such as methoxy and ethoxy, aryl groups having 6 to 18 carbon atoms such as phenyl, halogen atoms such as chloro and bromo, alkoxycarbonyl, cyano, and amide groups.

The aliphatic residues include normal and branched alkyl groups and cycloalkyl groups, which may have a substituent, as well as alkenyl and alkynyl groups. The normal and branched alkyl groups are typically those having 1 to 18 carbon atoms, for example, methyl, ethyl, isobutyl and dodecyl. The cycloalkyl groups are typically those having 3 to 10 carbon atoms, for example, cyclopropyl, cyclohexyl and adamantyl. Substituents on the alkyl and cycloalkyl groups include alkoxy (e.g., methoxy, ethoxy, propoxy and butoxy), alkoxycarbonyl, carbamoyl, hydroxyl, alkylthio, amide, acyloxy, cyano, sulfonyl, halogen atoms (e.g., chlorine, bromine, fluorine and iodine), and aryl (e.g., phenyl, halogen-substituted phenyl and alkyl-substituted phenyl). Exemplary substituted alkyl and cycloalkyl groups are 3-methoxypropyl, ethoxycarbonylmethyl, 4-chlorocyclohexyl, benzyl, p-methylbenzyl, and p-chlorobenzyl. Allyl is a typical alkenyl group and propynyl is a typical alkynyl group.

Illustrative groups of $R^{54}$ are formyl, acyl (e.g., acetyl, trifluoroacetyl, α-(2,4-di-t-amylphenoxy)acetyl, methoxyacetyl, cyanoacetyl and benzoyl), sulfonyl (e.g., methylsulfonyl, toluenesulfonyl and 4-dodecyloxybenzenesulfonyl), carbamoyl (e.g., carbamoyl, dodecylcarbamoyl and dimethylcarbamoyl), sulfamoyl (e.g., sulfamoyl, butylsulfamoyl and dimethylsulfamoyl), alkoxycarbonyl (e.g., methoxycarbonyl and tetradecyloxycarbonyl), thioacyl (e.g., thioformyl and thioacetyl), —(C═O)—(C═O)—$NR^{41}R^{42}$, and —(C═O)—(C═O)—$OR^{43}$ Each of $R^{41}$, $R^{42}$ and $R^{43}$ is hydrogen, alkyl (e.g., methyl, ethyl and methoxyethyl), aryl (e.g., phenyl, p-methoxyphenyl and a-naphthyl), and heterocyclic groups (e.g., pyridyl and thienyl). Alternatively, $R^{41}$ and $R^{42}$, taken together, form a ring with the nitrogen atom, for example, a heterocyclic ring such as morpholine. Preferred groups represented by $R^{54}$ are formyl, acyl, —(C═O)—(C═O)—$NR^{41}R^{42}$, and —(C═O)—(C═O)—$OR^{43}$.

Illustrative non-limiting examples of the compound of the general formula (V) are given below.

H-II-1

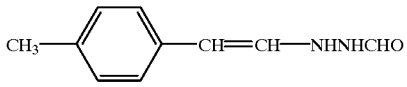

H-II-2

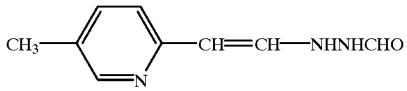

H-II-3

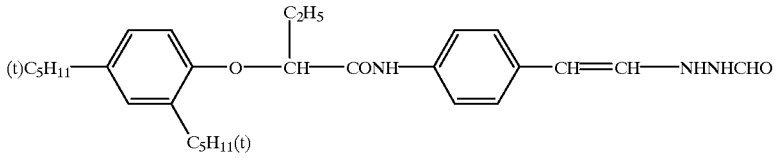

-continued
H-II-4
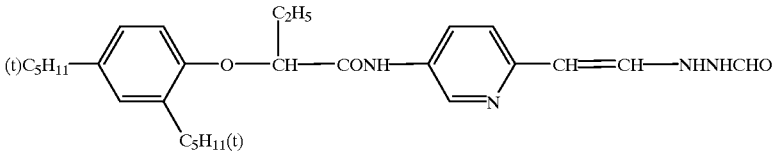
H-II-5
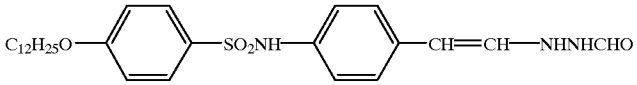
H-II-6
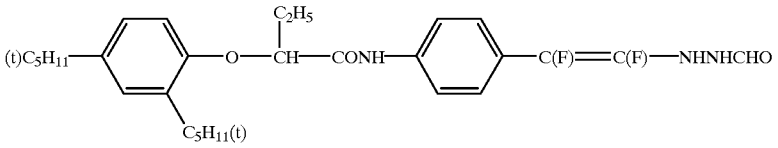
H-II-7
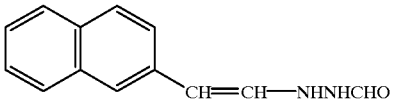
H-II-8
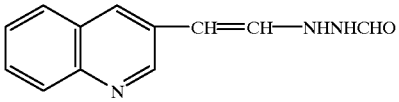
H-II-9
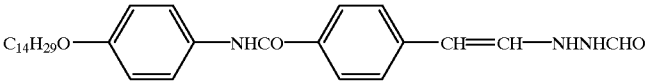
H-II-10
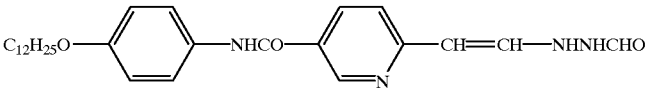
H-II-11
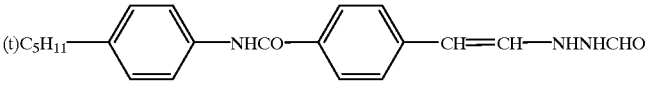
H-II-12
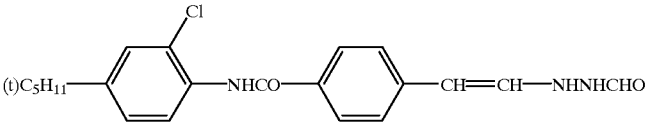
H-II-13
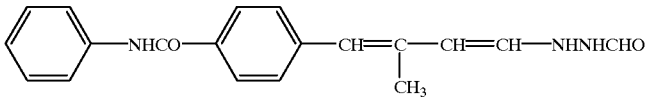
H-II-14
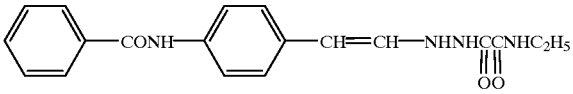
H-II-15
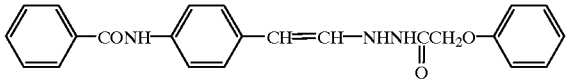

Also useful are polymeric hydrazine compounds having a structural moiety of the general formula (VI).

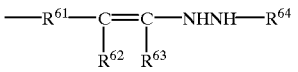

(VI)

$R^{61}$ is a divalent organic group, each of $R^{62}$ and $R^{63}$ is a hydrogen atom, halogen atom or substituted or unsubstituted alkyl group, and $R^{64}$ is a formyl, substituted or unsubstituted acyl, sulfonyl, carbamoyl, sulfamoyl, alkoxycarbonyl, thioacyl or —(C═O)—(C═O)—$X^{40}$ group wherein $X^{40}$ is —$NR^{41}R^{42}$ or —$OR^{43}$ wherein each of $R^{41}$, $R^{42}$ and $R^{43}$ is a hydrogen atom, substituted or unsubstituted alkyl, aryl or heterocyclic group, or $R^{41}$ and $R^{42}$, taken together, may form a ring with the nitrogen atom.

The monovalent organic residues represented by $R^{61}$ include aromatic, heterocyclic and aliphatic residues. The aromatic residues include phenyl, naphthyl, substituted phenyl and substituted naphthyl. The substituents are, for example, alkyl, alkoxy, acylhydrazino, dialkylamino, alkoxycarbonyl, cyano, carboxyl, nitro, alkylthio, hydroxy, sulfonyl, carbamoyl, halogen, acylamino, sulfonamide, and thiourea groups. Exemplary of the substituted phenyl group are 4-methylphenyl, 4-ethylphenyl, 4-oxyethylphenyl, 4-dodecylphenyl, 4-carboxyphenyl, 4-diethylaminophenyl, 4-octylaminophenyl, 4-benzylaminophenyl, 4-acetamide-2-methylphenyl, 4-(3-ethylthioureido)phenyl, 4-[2-(2,4-di-tert-butylphenoxy)butylamide]phenyl, and 4-[2-(2,4-didodecylphenoxy)butylamide]phenyl.

The heterocyclic residues represented by $R^{61}$ are, for example, five- or six-membered monocyclic or fused ring having at least one of oxygen, nitrogen, sulfur and selenium atoms, which may have a substituent. Exemplary are residues of pyrroline, pyridine, quinoline, indole, oxazole, benzoxazole, naphthoxazole, imidazole, benzimidazole, thiazoline, thiazole, benzothiazole, naphthothiazole, selenazole, benzoselenazole, and naphthoselenazole rings. These heterocyclic rings may have substituents, for example, alkyl groups such as methyl, ethyl and dodecyl, alkoxy groups such as methoxy and ethoxy, aryl groups having 6 to 18 carbon atoms such as phenyl, halogen atoms such as chloro and bromo, alkoxycarbonyl, cyano, and amide groups.

The aliphatic residues include normal and branched alkyl groups and cycloalkyl groups, which may have a substituent, as well as alkenyl and alkynyl groups. The normal and branched alkyl groups are typically those having 1 to 18 carbon atoms, for example, methyl, ethyl, isobutyl and dodecyl. The cycloalkyl groups are typically those having 3 to 10 carbon atoms, for example, cyclopropyl, cyclohexyl and adamantyl. Substituents on the alkyl and cycloalkyl groups include alkoxy (e.g., methoxy, ethoxy, propoxy and butoxy), alkoxycarbonyl, carbamoyl, hydroxyl, alkylthio, amide, acyloxy, cyano, sulfonyl, halogen atoms (e.g., chlorine, bromine, fluorine and iodine), and aryl (e.g., phenyl, halogen-substituted phenyl and alkylsubstituted phenyl). Exemplary substituted alkyl and cycloalkyl groups are 3-methoxypropyl, ethoxycarbonylmethyl, 4-chlorocyclohexyl, benzyl, p-methylbenzyl, and p-chlorobenzyl. Allyl is a typical alkenyl group and propynyl is a typical alkynyl group.

Illustrative groups of $R^{64}$ are formyl, acyl (e.g., acetyl, trifluoroacetyl, α-(2,4-di-t-amylphenoxy)acetyl, methoxyacetyl, cyanoacetyl and benzoyl), sulfonyl (e.g., methylsulfonyl, toluenesulfonyl and 4-dodecyloxybenzenesulfonyl), carbamoyl (e.g., carbamoyl, dodecylcarbamoyl and dimethylcarbamoyl), sulfamoyl (e.g., sulfamoyl, butylsulfamoyl and dimethylsulfamoyl), alkoxycarbonyl (e.g., methoxycarbonyl and tetradodecyloxycarbonyl), thioacyl (e.g., thioformyl and thioacetyl), —(C═O)—(C═O)—$NR^{41}R^{42}$, and —(C═O)—(C═O) —$OR^{43}$. Each of $R^{41}$, $R^{42}$ and $R^{43}$ is hydrogen, alkyl (e.g., methyl, ethyl and methoxyethyl), aryl (e.g., phenyl, p-methoxyphenyl and α-naphthyl), and heterocyclic groups (e.g., pyridyl and thienyl). Alternatively, $R^{41}$ and $R^{42}$, taken together, form a ring with the nitrogen atom, for example, a heterocyclic ring such as morpholine. Preferred groups represented by $R^{64}$ are formyl, acyl, —(C═O)—(C═O)—$NR^{41}R^{42}$, and —(C═O)—(C═O)—$OR^{43}$.

Illustrative non-limiting examples of the structural moiety of the general formula (VI) are given below.

H-III-1

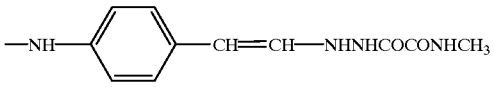

H-III-2

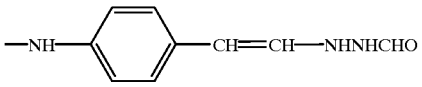

H-III-3

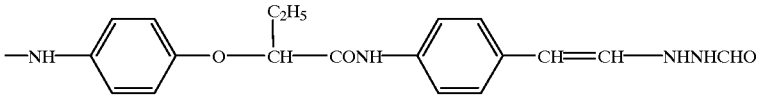

H-III-4

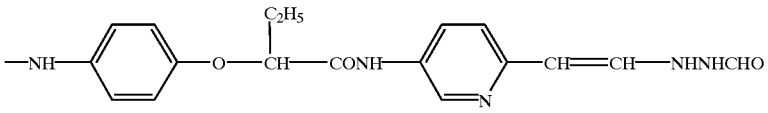

-continued
H-III-5
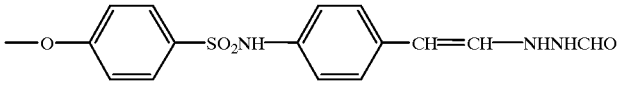
H-III-6
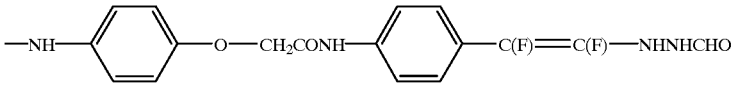
H-III-7
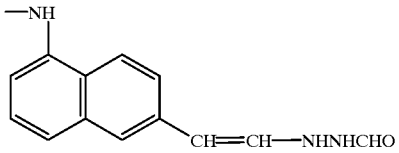
H-III-8
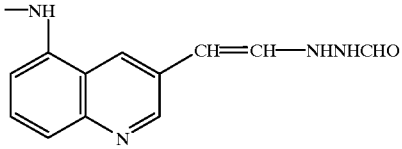
H-III-9
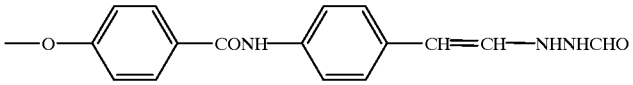
H-III-10
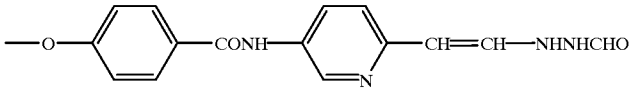
H-III-11
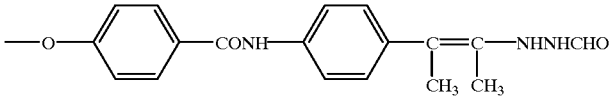
H-III-12
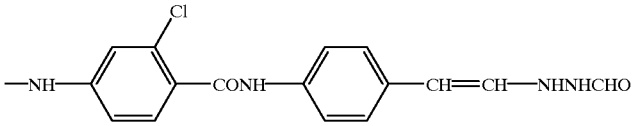
H-III-13
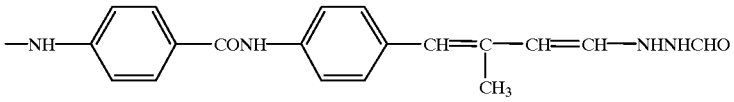
H-III-14
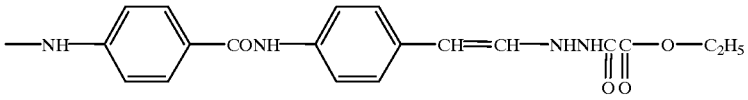
H-III-15
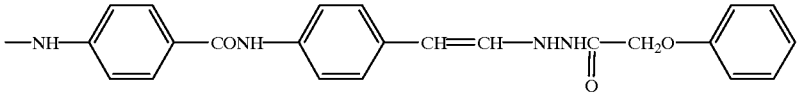

Also useful are polymeric hydrazine compounds having a structural moiety of the general formula (VII).

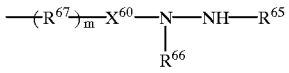

(VII)

$R^{65}$ is a hydrogen atom, formyl, substituted or unsubstituted acyl, sulfonyl, carbamoyl, sulfamoyl, alkoxycarbonyl, thioacyl or —(C=O)—(C=O)—$X^{40}$ group wherein $X^{40}$ is —$NR^{41}R^{42}$ or —$OR^{43}$ wherein each of $R^{41}$, $R^{42}$ and $R^{43}$ is a hydrogen atom, substituted or unsubstituted alkyl, aryl or heterocyclic group, or $R^{41}$ and $R^{42}$, taken together, may form a ring with the nitrogen atom, $R^{66}$ is a hydrogen atom, substituted or unsubstituted acyl, sulfonyl, carbamoyl, sulfamoyl or alkoxycarbonyl group, $R^{67}$ is a divalent organic group, X60 is a phenyl group or pyridine ring, and letter m is an integer of 0 to 6.

Illustrative groups of $R^{65}$ are hydrogen, formyl, acyl (e.g., acetyl, trifluoroacetyl, α-(2,4-di-t-amylphenoxy)acetyl and benzoyl), sulfonyl (e.g., methylsulfonyl, toluenesulfonyl and 4-dodecyloxybenzenesulfonyl), carbamoyl (e.g., carbamoyl, dodecylcarbamoyl and dimethylcarbamoyl), sulfamoyl (e.g., sulfamoyl, butylsulfamoyl and dimethylsulfamoyl), alkoxycarbonyl (e.g., methoxycarbonyl and tetradodecyloxycarbonyl), and thioacyl (e.g., thioacetyl), with the hydrogen, formyl, acyl and sulfonyl being preferred.

Illustrative groups of $R^{66}$ are hydrogen, acyl (e.g., acetyl and pivaloyl), sulfonyl (e.g., methanesulfonyl and toluenesulfonyl), and alkoxycarbonyl (e.g., methoxycarbonyl and dodecyloxycarbonyl), with the hydrogen being preferred.

Illustrative divalent organic groups of $R^{67}$ are derived from alkyl, aryl, alkoxy, aryloxy, acyloxy, alkylthio, arylthio, sulfonyl, alkoxycarbonyl, aryloxycarbonyl, carbamoyl, sulfamoyl, acyl, amino, alkylamino, arylamino, acylamino, sulfonamide, arylaminothiocarbonylamino, hydroxy, carboxy, sulfo, nitro, and cyano groups. The groups represented by $R^{65}$, $R^{66}$ and $R^{67}$ may further have a substituent, that is, substituted groups are encompassed therein.

$X^{60}$ is preferably a pyridine ring.

Letter m is an integer of 0 to 6, preferably 0 to 3.

Illustrative non-limiting examples of the structural moiety of the general formula (VII) are given below.

H-IV-1

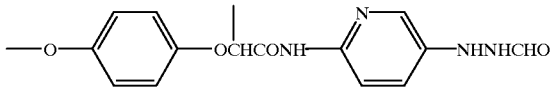

H-IV-2

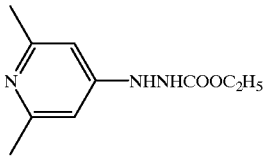

-continued

H-IV-3

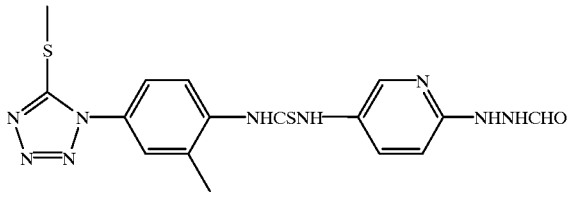

H-IV-4

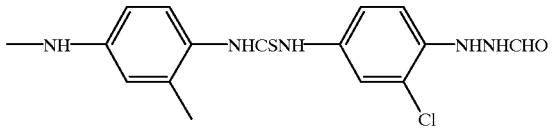

H-IV-5

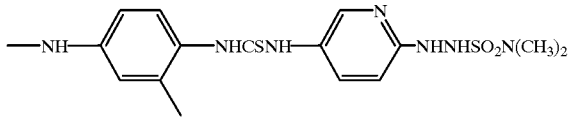

H-IV-6

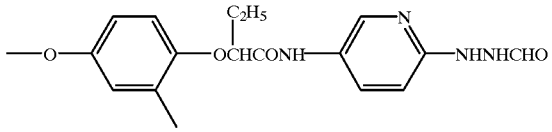

H-IV-7

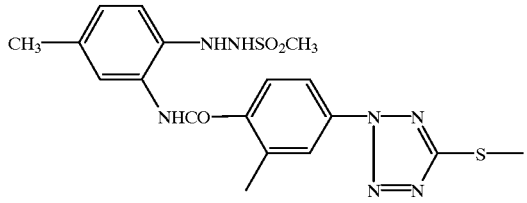

H-IV-8

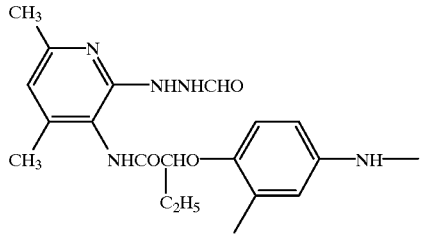

H-IV-9

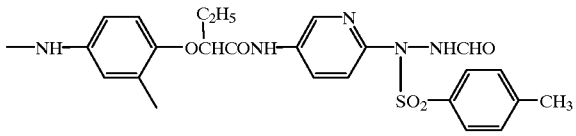

H-IV-10

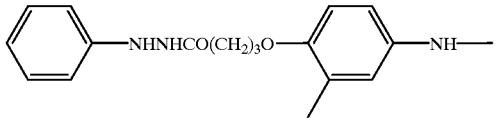

-continued

H-IV-11

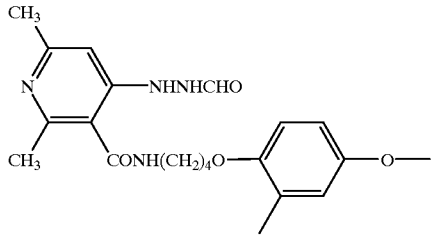

H-IV-12

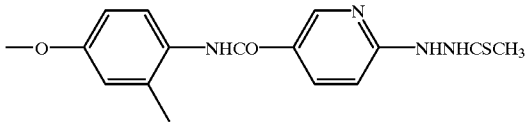

H-IV-13

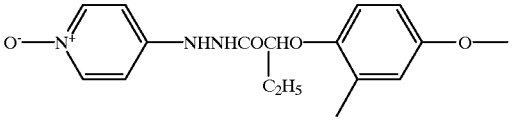

H-IV-14

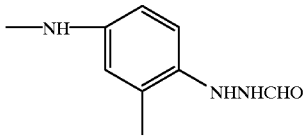

H-IV-15

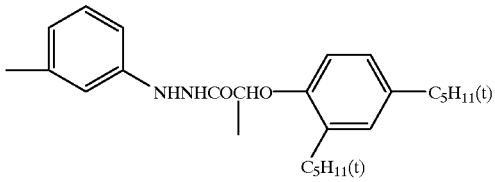

H-IV-16

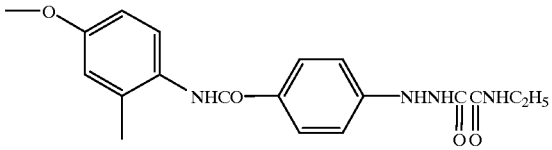

H-IV-17

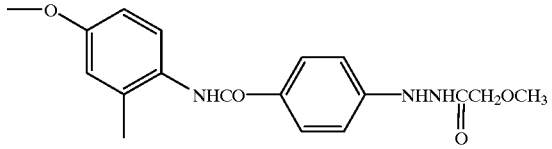

The polymers used herein are preferably those having recurring (meth)acrylic acid units. The (meth)acrylic acid polymers include homopolymers and copolymers of (meth) acrylic acid as well as homopolymers and copolymers of (meth)acrylates. Illustrative examples include homopolymers of alkyl acrylates, copolymers of an alkyl acrylate and an alkyl methacrylate, homopolymers of alkyl methacrylates, and water-insoluble addition polymers of an alkyl acrylate, alkyl methacrylate, acrylate or methacrylate with another ethylenically unsaturated polymerizable compound having at least one —CH═C<, preferably at least one $CH_2$═C<.

Examples of the (meth)acrylic acid polymer include copolymers of acrylate with vinylidene chloride, copolymers of methacrylate with vinylidene chloride, copolymers of acrylate with a vinyl ester, copolymers of methacrylate with a vinyl ester as well as copolymers of at least one of these copolymers with at least one compound selected from acrylic acid, methacrylic acid, and itaconic acid. Examples of the acrylate and methacrylate include ethyl acrylate, n-butyl acrylate, n-octyl acrylate, n-dodecyl acrylate, methyl methacrylate, n-butyl methacrylate, n-octyl methacrylate, and n-dodecyl methacrylate. Examples of the vinyl ester include vinyl acetate, vinyl propionate, vinyl acetate, and vinyl laurate. The copolymers preferably have a molecular weight of about 500 to 500,000. Illustrative examples of the homopolymer and copolymer are shown below as P-1 to P-12 although the invention is not limited thereto.

P-1

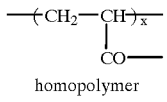

homopolymer

M~100,000

P-2

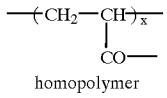

homopolymer

M~350,000

P-3

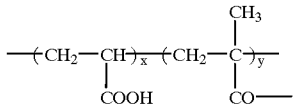

x:y = 98.5:1.5
M~150,000

P-4

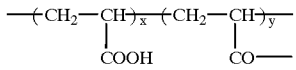

x:y = 97.3
M~200,000

P-5

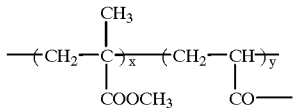

x:y = 96.4
M~100,000

P-6

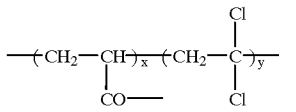

x:y = 97.3
M~160,000

P-7

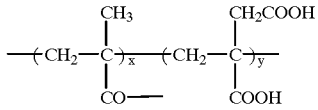

x:y = 98.2
M~40,000

P-8

-continued

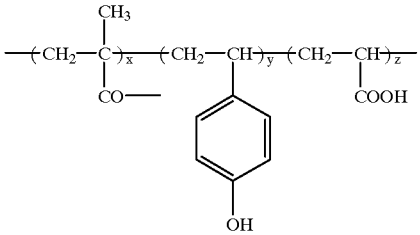

x:y:z = 40:50:10
M~150,000

P-9

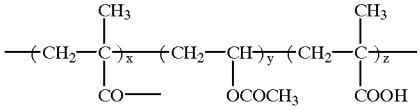

x:y:z = 70:28:2
M~500,000

P-10

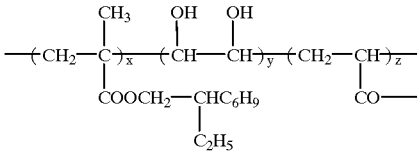

x:y:z = 85:13:2
M~800,000

P-11

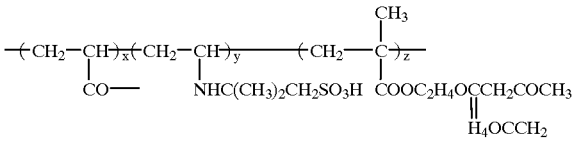

x:y:z = 78:19:3
M~300,000

P-12

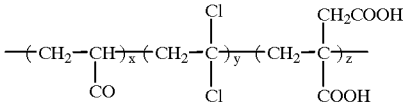

x:y:z = 80:16:4
M~100,000

In polymers P-1 to P-12, x, y and z represent mol % of respective monomer components and M is an average molecular weight. It is noted that the average molecular weight designates a number average molecular weight throughout the specification.

In general, the (meth)acrylic acid polymer should preferably contain at least 65%, more preferably 75 to 95% by weight of an alkyl acrylate or alkyl methacrylate such as ethyl acrylate, methyl acrylate, butyl acrylate, ethyl methacrylate and octyl methacrylate.

The polymer having a structural moiety of the general formula (VI) or (VII) according to the invention can be synthesized by reacting —$NH_2$ or the like of a monomer from which the structural moiety of formula (VI) or (VII) is derived with —COOH or —COCl group of a monomer and polymerizing the reaction product (polymerization reaction) or by previously synthesizing a trunk polymer and adding —$NH_2$ or the like of a monomer from which the structural moiety of formula (VI) or (VII) is derived to a side chain thereof.

The polymer of the invention can be readily synthesized by various methods such as solution polymerization, bulk polymerization and suspension polymerization.

For example, solution polymerization is generally carried out as follows. A mixture of monomers is added to a suitable solvent (e.g., ethanol, methanol and water) in a suitable concentration (usually, less than 40% by weight, preferably 10 to 25% by weight based on the solvent of the mixture). The solution is then heated in the presence of a polymerization initiator (e.g., benzoyl peroxide, azobisisobutyronitrile and ammonium persulfate) to a suitable temperature (e.g., 40 to 120° C., preferably 50 to 100° C.), thereby effecting copolymerization reaction. The reaction mixture is then poured into a medium in which the resultant water-soluble polymer is not soluble, whereby the polymer is settled out and then dried, thereby removing the unreacted mixture. The water-soluble polymer preferably has a molecular weight of 1,000 to 1,000,000, more preferably 2,000 to 200,000.

According to the invention, a polymer having a structural moiety of the general formula (VI) or (VII) in its molecule is preferably added to the photographic silver halide photosensitive material in an amount of 0.1 to 10 grams, more preferably 0.2 to 5 grams calculated as solids per square meter.

Finally, the hydrazine compound of the general formula (VIII) which can be used herein is described.

(VIII)

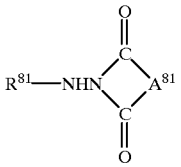

$R^{81}$ is an aromatic group, $A^{81}$ is a substituted or unsubstituted aromatic ring, and the carbon atoms of the two carbonyl groups are attached to different atoms of the aromatic ring.

More illustratively, $R^{81}$ is a substituted or unsubstituted aryl group or heterocyclic group, for example, benzene, naphthalene, pyridine, pyrimidine, imidazole, pyrazole, thiazole, benzothiazole, benzimidazole, indazole, quinoline, and isoquinoline.

$A^{81}$ is a substituted or unsubstituted aryl group or heterocyclic group, for example, benzene, naphthalene, pyridine, pyrimidine, imidazole, pyrazole, thiazole, benzothiazole, benzimidazole, indazole, quinoline, and isoquinoline. Substituents on the groups of $A^{81}$ include hydrogen, substituted or unsubstituted alkyl, aryl, alkylamino, acyl, acylamino, alkylaminoacyl, carboalkoxy, alkoxy, hydroxyl, acyloxy, carboxylate, nitro, and halogen.

Illustrative non-limiting examples of the compound of formula (VIII) are given below.

H-V-1

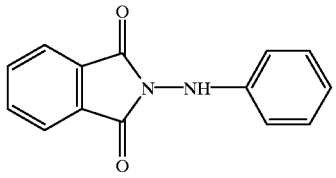

-continued
H-V-2
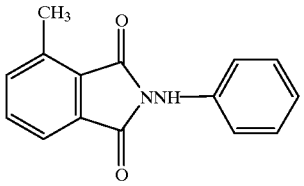
H-V-3
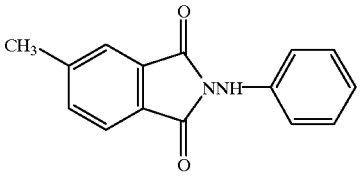
H-V-4
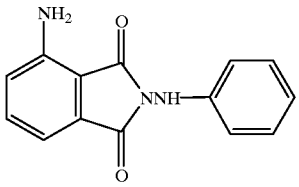
H-V-5
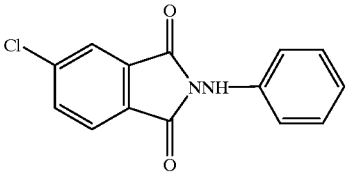
H-V-6
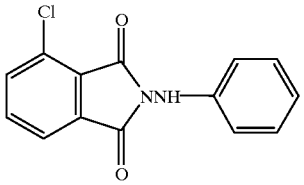
H-V-7
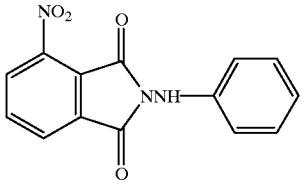
H-V-8
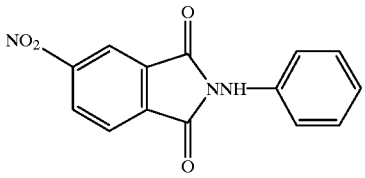
H-V-9
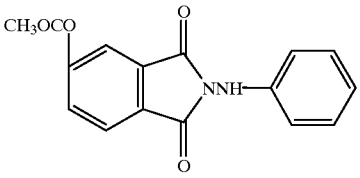
-continued
H-V-10
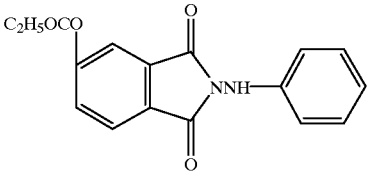
H-V-11
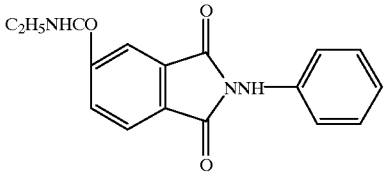
H-V-12
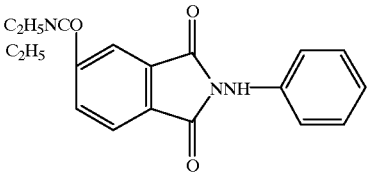
H-V-13
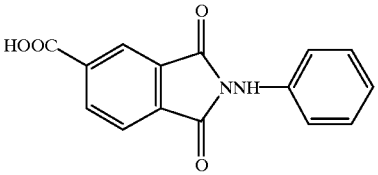
H-V-14
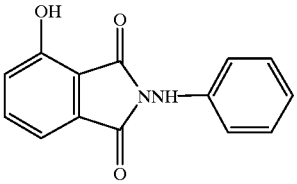
H-V-15
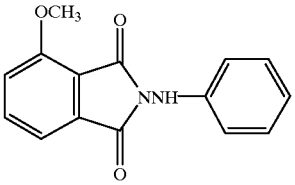
H-V-16
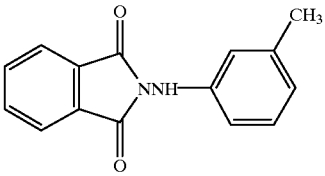
H-V-17
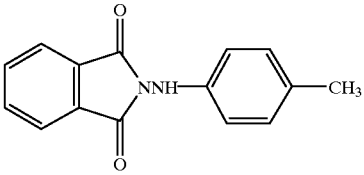

-continued
H-V-18
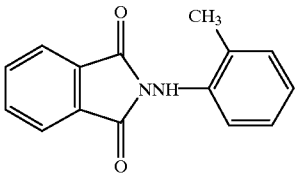
H-V-19
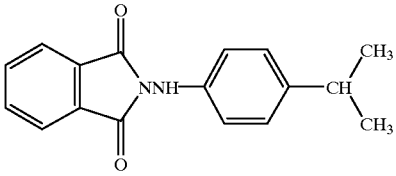
H-V-20
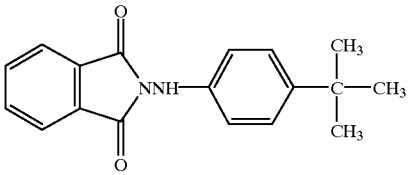
H-V-21
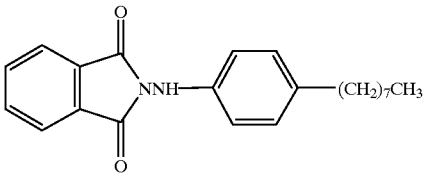
H-V-22
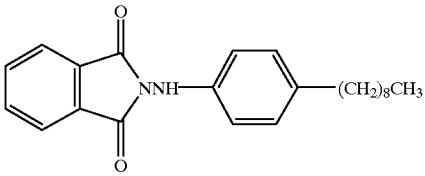
H-V-23
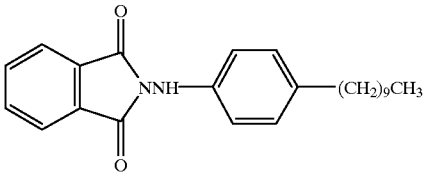
H-V-24
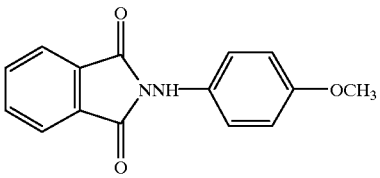
H-V-25
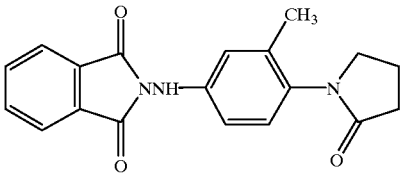
-continued
H-V-26
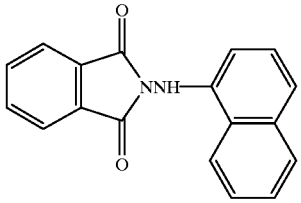
H-V-27
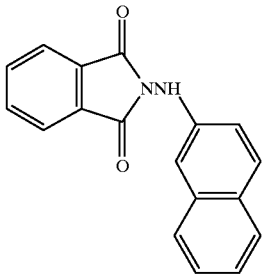
H-V-28
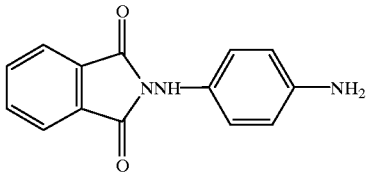
H-V-29
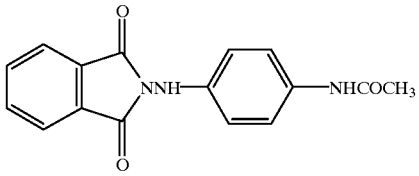
H-V-30
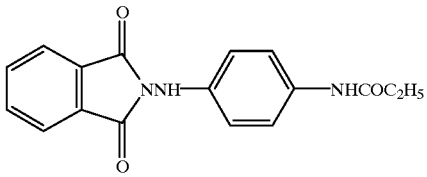
H-V-31
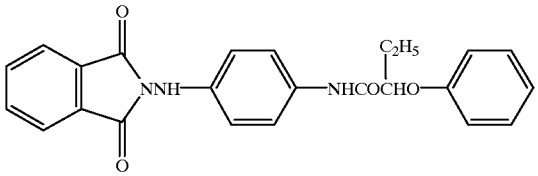
H-V-32
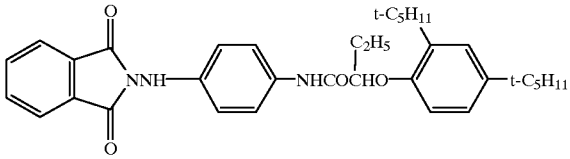

-continued
H-V-33
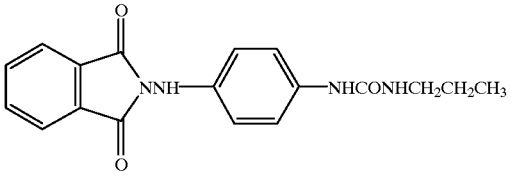
H-V-34
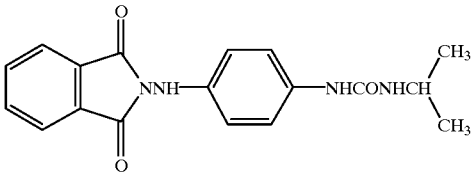
H-V-35
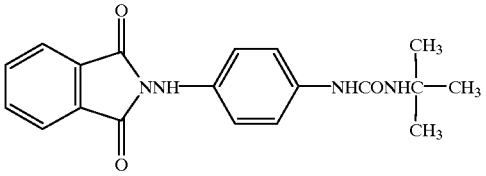
H-V-36
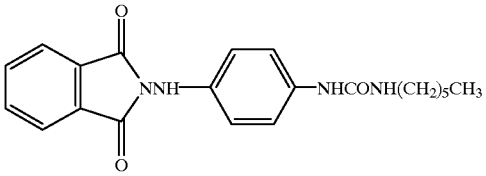
H-V-37
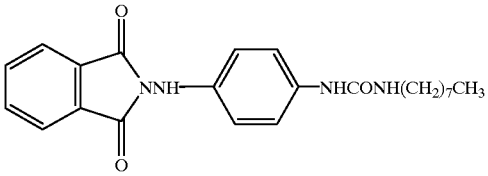
H-V-38
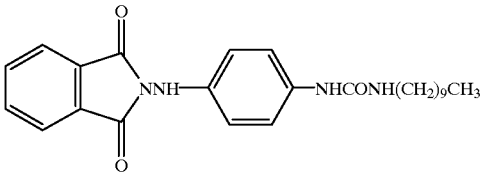
H-V-39
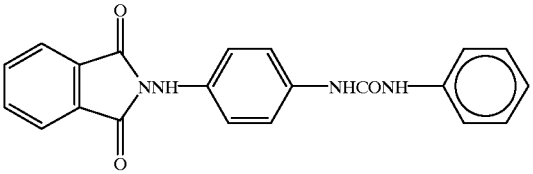
-continued
H-V-40
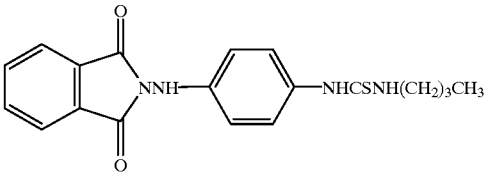
H-V-41
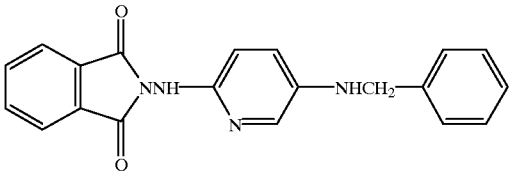
H-V-42
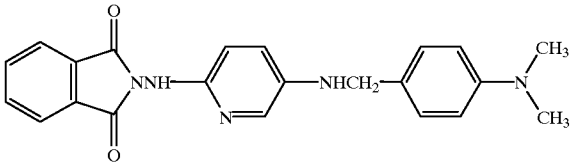
H-V-43
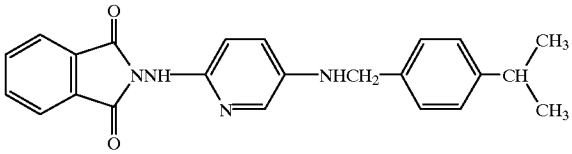
H-V-44
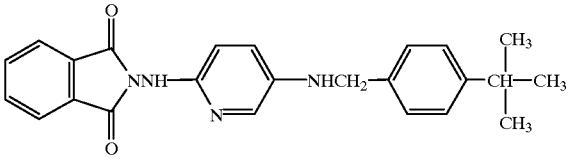
H-V-45
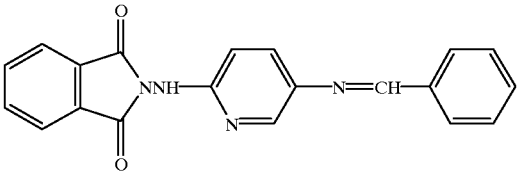
H-V-46
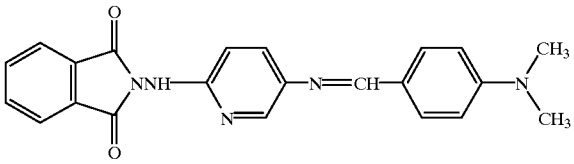
H-V-47
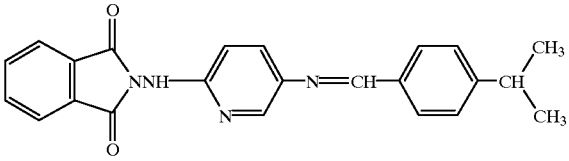

-continued

H-V-48

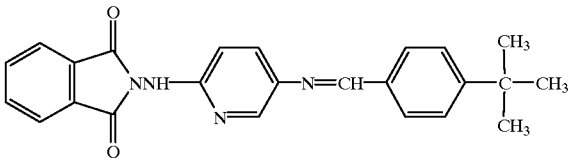

H-V-49

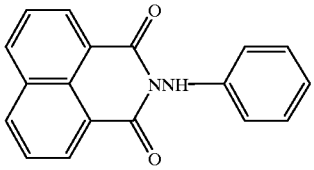

H-V-50

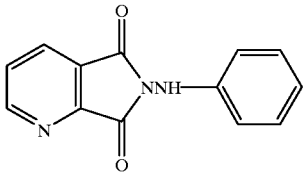

H-V-51

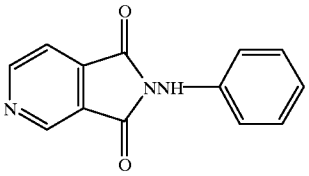

According to the invention, the hydrazine compounds of formulae (I) to (VIII) function as a nucleating agent.

According to the invention, another hydrazine derivative may be used in combination with the hydrazine compounds of formulae (I) to (VIII). Examples of the hydrazine derivative which can be used in combination include those examples described in Research Disclosure, Item 23516 (November 1983, page 346), the references cited therein, and the following patents.

| | | | |
|---|---|---|---|
| U.S. Pat. No. | 4,080,207 | 4,269,929 | 4,276,364 |
| | 4,278,748 | 4,385,108 | 4,459,347 |
| | 4,478,928 | 4,560,638 | 4,686,167 |
| | 4,912,016 | 4,988,604 | 4,994,365 |
| | 5,041,355 | 5,104,769 | |
| UKP | 2,011,391B | | |
| EP | 217,310 | 301,799 | 356,898 |
| JP-A | 179734/1985 | 170733/1986 | 270744/1986 |
| | 178246/1987 | 270948/1987 | 29751/1988 |
| | 32538/1988 | 104047/1988 | 121838/1988 |
| | 129337/1988 | 223744/1988 | 234244/1988 |
| | 234245/1988 | 234246/1988 | 294552/1988 |
| | 306438/1988 | 10233/1989 | 90439/1989 |
| | 100530/1989 | 105941/1989 | 105943/1989 |
| | 276128/1989 | 280747/1989 | 283548/1989 |
| | 283549/1989 | 285940/1989 | 2541/1990 |
| | 77057/1990 | 139538/1990 | 196234/1990 |
| | 196235/1990 | 198440/1990 | 198441/1990 |
| | 198442/1990 | 220042/1990 | 221953/1990 |
| | 221954/1990 | 285342/1990 | 285343/1998 |
| | 289843/1990 | 302750/1990 | 304550/1990 |
| | 37642/1991 | 54549/1991 | 125134/1991 |
| | 184039/1991 | 240036/1991 | 240037/1991 |
| | 259240/1991 | 280038/1991 | 282536/1991 |
| | 51143/1992 | 56842/1992 | 84134/1992 |
| | 230233/1990 | 96053/1992 | 216544/1992 |

-continued

| | | |
|---|---|---|
| 45761/1993 | 45762/1993 | 45763/1993 |
| 45764/1993 | 45765/1993 | |

Japanese Patent Application No. 94925/1993

Besides, the following hydrazine derivatives are also useful. Exemplary compounds include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; and the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (1) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; and the compounds of the general formulae (H) and (Ha) in JP-A 104426/1995, more specifically compounds H-1 to H-44 described on pages 8 to 15 of the same.

Furthermore, various hydrazine derivatives as described in "Kochi Gijutsu (Known Technology)," Mar. 22, 1991, Aztec K.K., pages 25 to 34, may be used in combination with the hydrazine derivative of the present invention.

The hydrazine derivative of the present invention may be added to either of a photosensitive layer and a non-photosensitive layer on the same side of a support, preferably to the photosensitive layer or a non-photosensitive layer disposed adjacent thereto.

The preferred amount of the hydrazine derivative of the invention added varies a little with a particular compound. The hydrazine compound of the general formula (I) or (III) is preferably added in an amount of $1\times10^{-6}$ to $1\times10^{-1}$ mol, more preferably $1\times10^{-5}$ to $5\times10^{-2}$ mol per mol of silver. The hydrazine compound of the general formula (II) is preferably added in an amount of $1\times10^{-5}$ to $1\times10^{-2}$ mol, more preferably $1\times10^{-5}$ to $5\times10^{-3}$ mol, most preferably $5\times10^{-5}$ to $1\times10^{-3}$ mol per mol of silver. The hydrazine compound of the general formula (IV), (V) or (VIII) or the hydrazine compound having a structural moiety of the general formula (VI) or (VII) is preferably added in an amount of $1\times10^{-6}$ to $1\times10^{-2}$ mol, more preferably $1\times10^{-5}$ to $5\times10^{-3}$ mol, most preferably $2\times10^{-5}$ to $5\times10^{-3}$ mol per mol of silver. Note that the amount of the hydrazine moiety is calculated in the case of a polymeric compound.

The hydrazine derivative is used as a solution in a suitable organic solvent such as alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

In the practice of the invention, indazoles (e.g., nitroindazole) are preferably used as an antifoggant in combination with the hydrazine compound of the general formula (I) or (II).

Nucleation Promoter

In the photosensitive material of the invention, a nucleation promoter is preferably added in combination with the hydrazine derivative of the invention. Useful nucleation promoters are amine derivatives, onium salts, disulfide derivatives and hydroxylamine derivatives. Examples of the onium salt type nucleation promoter are described in Japanese Patent Application No. 37053/1996.

Other examples of the nucleation promoter include the compounds described in JP-A 77783/1995, for example, compounds A-1 to A-73 described on pages 49 to 58 thereof; the compounds of chemical formulae [21], [22] and [23] described in JP-A 84331/1995, for example, the compounds described on pages 6 to 8 thereof; the compounds of general formulae [Na] and [Nb] described in JP-A 104426/1995, for example, compounds Na-1 to Na-22 and Nb-1 to Nb-12 described on pages 16 to 20 thereof; the compounds of general formulae (1), (2), (3), (4), (5), (6), and (7) described in Japanese Patent Application No. 37817/1995, for example, compounds 1-1 to 1-19, 2-1 to 2-22, 3-1 to 3-36, 4-1 to 4-5, 5-1 to 5-41, 6-1 to 6-58, and 7-1 to 7-38 described therein.

The nucleation promoter is used as a solution in a suitable organic solvent such as alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the nucleation promoter with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the nucleation promoter in powder form in water in a ball mill, colloidal mill or ultrasonic mixer.

The nucleation promoter may be added to a photosensitive layer or any non-photosensitive layer on the same side of the support as the photosensitive layer. Preferably the nucleation promoter is added to the photosensitive layer or a non-photosensitive layer disposed adjacent thereto.

Preferably the nucleation promoter is added in amounts of $1\times10^{-6}$ to $2\times10^{-2}$ mol, more preferably $1\times10^{-5}$ to $2\times10^{-2}$ mol, most preferably $2\times10^{-5}$ to $1\times10^{-2}$ mol per mol of silver.

Illustrative non-limiting examples of the nucleation promoter are given below.

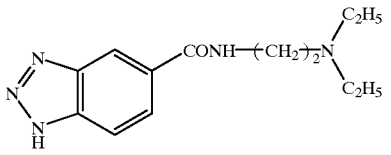

-continued

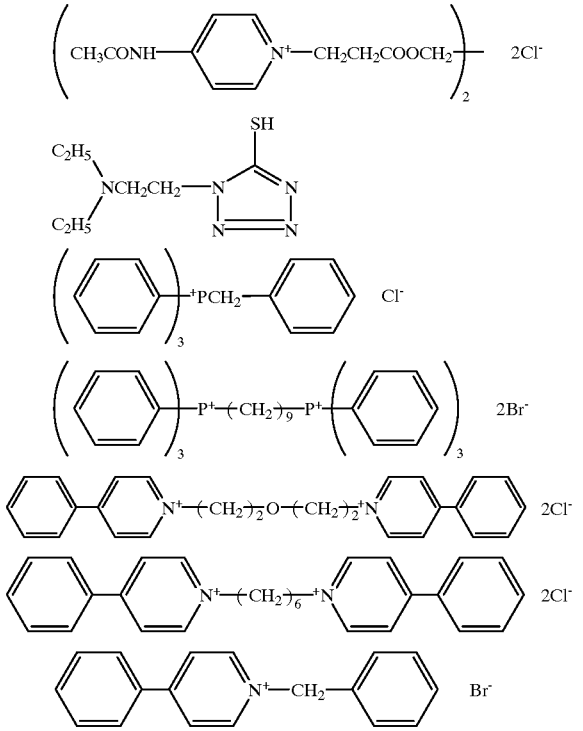

Reducing Agent

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly greater amount of about 2 to 15% by weight of that layer.

For photothermographic materials using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis-(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones.

Especially preferred reducing agents used herein are those compounds of the following formulae (R-I), (R-II), (R-III), and (R-IV).

(R-I)

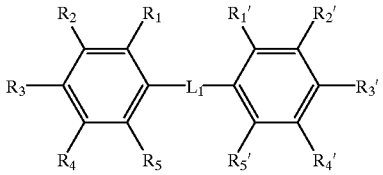

(R-II)

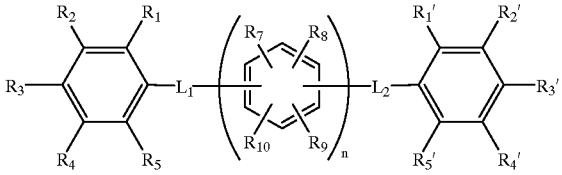

(R-III)

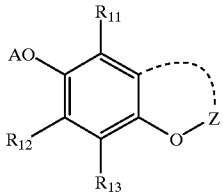

(R-IV)

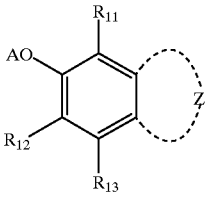

In formula (R-III), Z forms a cyclic structure represented by the following formula (Z-1) or (Z-2).

(Z-1)

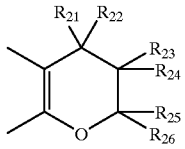

or (Z-2)

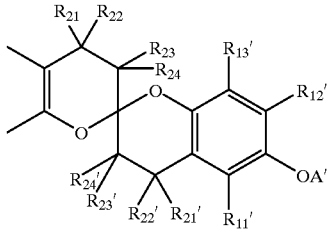

In formula (R-IV), Z forms a cyclic structure represented by the following formula (Z-3) or (Z-4).

(Z-3)

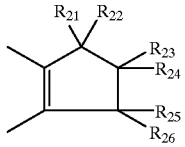

or (Z-4)

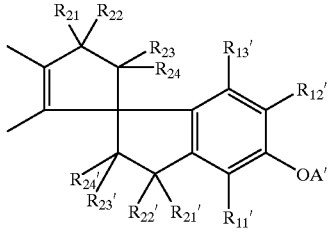

In formulae (R-I) and (R-II), each of $L_1$ and $L_2$ is a group CH—$R_6$ or CH—$R_6'$ or a sulfur atom, and n is a natural number.

Herein, R is used as a representative of $R_1$ to $R_{10}$, $R_1'$ to $R_5'$, $R_6'$, $R_{11}$ to $R_{13}$, $R_{11}'$ to $R_{13}'$, $R_{21}$ to $R_{26}$, and $R_{21}'$ to $R_{24}'$. R is a hydrogen atom, alkyl group having 1 to 30 carbon atoms, aryl group, aralkyl group, halogen atom, amino group or a substituent represented by —O—A, with the proviso that at least one of $R_1$ to $R_5$, at least one of $R_1'$ to $R_5'$, and at least one of $R_7$ to $R_{10}$ each are a group represented by —O—A. Alternatively, R groups, taken together, may form a ring. A and A' each are a hydrogen atom, alkyl group having 1 to 30 carbon atoms, acyl group having 1 to 30 carbon atoms, aryl group, phosphate group or sulfonyl group. R, A and A' may be substituted groups while typical examples of the substituent include an alkyl group (including active methine groups), nitro group, alkenyl group, alkynyl group, aryl group, heterocycle-containing group, group containing a quaternized nitrogen atom-containing heterocycle (e.g., pyridinio group), hydroxyl group, alkoxy group (including a group containing recurring ethylenoxy or propylenoxy units), aryloxy group, acyloxy group, acyl group, alkoxycarbonyl group, aryloxycarbonyl group, carbamoyl group, urethane group, carboxyl group, imido group, amino group, carbonamide group, sulfonamide group, ureido group, thioureido group, sulfamoylamino group, semicarbazide group, thiosemicarbazide group, hydrazino-containing group, quaternary ammonio-containing group, mercapto group, (alkyl, aryl or heterocyclic) thio group, (alkyl or aryl) sulfonyl group, (alkyl or aryl) sulfinyl group, sulfo group, sulfamoyl group, acylsulfamoyl group, (alkyl or aryl) sulfonylureido group, (alkyl or aryl) sulfonylcarbamoyl group, halogen atom, cyano group, phosphoric acid amide group, phosphate structure-containing group, acylurea structure-bearing group, selenium or tellurium atom-containing group, and tertiary or quaternary sulfonium structure-bearing group. The substituent on R, A and A' may be further substituted, with preferred examples of the further substituent being those groups exemplified as the substituent on R. The further substituent, in turn, may be further substituted, the still further substituent, in turn, may be further substituted, and so on. In this way, multiple substitution is acceptable while preferred substituents are those groups exemplified as the substituent on R, A and A'.

Illustrative, non-limiting, examples of the compounds represented by formulae (R-I), (R-II), (R-III) and (R-IV) are given below.

TABLE 12

| No. | $R_1$, $R_{1'}$ | $R_2$, $R_{2'}$ | $R_3$, $R_{3'}$ | $R_4$, $R_{4'}$ | $R_5$, $R_{5'}$ | $L_1$ | $R_6$ |
|---|---|---|---|---|---|---|---|
| R-I-1 | —OH | —$CH_3$ | —H | —$CH_3$ | —H | CH-R6 | —H |
| R-I-2 | —OH | —$CH_3$ | —H | —$CH_3$ | —H | CH-R6 | —$CH_3$ |
| R-I-3 | —OH | —$CH_3$ | —H | —$CH_3$ | —H | CH-R6 | —$C_3H_7$ |
| R-I-4 | —OH | —$CH_3$ | —H | —$CH_3$ | —H | CH-R6 | —$C_5H_{11}$ |
| R-I-5 | —OH | —$CH_3$ | —H | —$CH_3$ | —H | CH-R6 | —TMB |
| R-I-6 | —OH | —$CH_3$ | —H | —$CH_3$ | —H | CH-R6 | —$C_9H_{19}$ |
| R-I-7 | —OH | —$CH_3$ | —H | —$CH_3$ | —H | S | — |
| R-I-8 | —OH | —$CH_3$ | —H | —$C_2H_5$ | —H | S | — |
| R-I-9 | —OH | —$CH_3$ | —H | —$C_4H_9$ (t) | —H | S | — |
| R-I-10 | —OH | —$C_4H_9$ (t) | —H | —$CH_3$ | —H | CH-R6 | —H |
| R-I-11 | —OH | —$C_4H_9$ (t) | —H | —$CH_3$ | —H | CH-R6 | —$CH_3$ |
| R-I-12 | —OH | —$C_4H_9$ (t) | —H | —$CH_3$ | —H | CH-R6 | —TMB |
| R-I-13 | —OH | —$C_4H_9$ (t) | —H | —$C_2H_5$ | —H | CH-R6 | —Ph |
| R-I-14 | —OH | —CHex | —H | —$CH_3$ | —H | S | — |
| R-I-15 | —OH | —$C_4H_9$ (t) | —H | —$C_2H_5$ | —H | S | — |
| R-I-16 | —OH | —$C_2H_5$ | —H | —$C_4H_9$ (t) | —H | CH-R6 | —H |
| R-I-17 | —OH | —$C_2H_5$ | —H | —$C_4H_9$ (t) | —H | CH-R6 | —$CH_3$ |
| R-I-18 | —OH | —$C_2H_5$ | —H | —$C_4H_9$ (t) | —H | CH-R6 | —TMB |
| R-I-19 | —OH | —$CH_3$ | —H | —$C_4H_9$ (t) | —H | CH-R6 | —Ph |
| R-I-20 | —OH | —$CH_3$ | —Cl | —$C_4H_9$ (t) | —H | CH-R6 | —H |
| R-I-21 | —OH | —$CH_3$ | —H | —$C_4H_9$ (t) | —$OCH_3$ | CH-R6 | —H |
| R-I-22 | —H | —$C_4H_9$ (t) | —OH | —CPen | —H | CH-R6 | —H |
| R-I-23 | —H | —$C_4H_9$ (t) | —OH | —$C_4H_9$ (t) | —H | CH-R6 | —TMB |
| R-I-24 | —H | —$C_4H_9$ (t) | —OH | —H | —H | CH-R6 | —H |
| R-I-25 | —H | —$C_4H_9$ (t) | —OH | —H | —H | CH-R6 | —$C_3H_7$ |
| R-I-26 | —H | —$CH_3$ | —OH | —$C_4H_9$ (t) | —H | CH-R6 | —TMB |
| R-I-27 | —H | —$C_2H_5$ | —OH | —$C_4H_9$ (t) | —H | CH-R6 | —H |
| R-I-28 | —H | —$CH_3$ | —OH | —$C_2H_5$ | —H | CH-R6 | —TMB |
| R-I-29 | —H | —$CH_3$ | —OH | —$CH_3$ | —H | S | — |
| R-I-30 | —H | —$CH_3$ | —OH | —$CH_3$ | —Cl | S | — |
| R-I-31 | —H | —$CH_3$ | —OH | —$C_2H_5$ | —H | S | — |
| R-I-32 | —H | —$C_2H_5$ | —OH | —$C_2H_5$ | —H | S | — |
| R-I-33 | —H | —$C_2H_5$ | —OH | —$CH_3$ | —Cl | S | — |
| R-I-34 | —H | —$CH_3$ | —OH | —$C_4H_9$ (t) | —H | S | — |
| R-I-35 | —H | —CHex | —OH | —$C_4H_9$ (t) | —H | S | — |

TMB: 1,3,3-trimethylbutyl group —CH(—$CH_3$)—$CH_2$—C(—$CH_3$)$_3$
CPen: cyclopentyl group
CHex: cyclohexyl group (R-I)

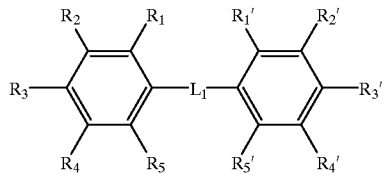

TABLE 13

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH-R6 | —H |
| R-I-37 | —OH | —$C_4H_9$ (t) | —H | —$CH_3$ | —H | —H | —$CH_3$ | —OH | —$CH_3$ | —H | CH-R6 | —H |
| R-I-38 | —OH | —$CH_3$ | —H | —$CH_3$ | —H | —H | —CHex | —OH | —$CH_3$ | —H | CH-R6 | —$CH_3$ |
| R-I-39 | —OH | —$C_4H_9$ (t) | —H | —$CH_3$ | —H | —H | —$CH_3$ | —OH | —$CH_3$ | —H | CH-R6 | —$CH_3$ |

TABLE 13-continued

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-40 | —OH | —$CH_3$ | —H | —$CH_3$ | —H | —H | —$CH_3$ | —OH | —$CH_3$ | —H | CH-R6 | —TMB |
| R-I-41 | —OH | —$C_4H_9$ (t) | —H | —$CH_3$ | —H | —H | —$CH_3$ | —OH | —$CH_3$ | —H | CH-R6 | —TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$ (t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

CHex: cyclohexyl group (R-I)

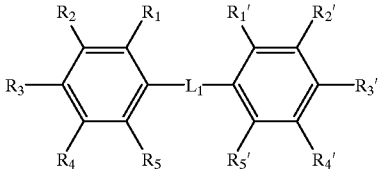

TABLE 14

| No. | $R_1$, $R_{1'}$ | $R_2$, $R_{2'}$ | $R_3$, $R_{3'}$ | $R_4$, $R_{4'}$ | $R_5$, $R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$ (t) | —H | —$CH_3$ | —H | —OH | —$CH_3$ | —$CH_3$ | —H | CH-R6 | —H | CH-R6' | —$CH_3$ | 1 |
| R-II-2 | —OH | —$CH_3$ | —H | —$CH_3$ | —H | —OH | —$C_2H_5$ | —$CH_3$ | —H | CH-R6 | —TMB | CH-R6' | —$CH_3$ | 1 |
| R-II-3 | —OH | —$C_4H_9$ (t) | —H | —$CH_3$ | —H | —OH | —$CH_3$ | —$CH_3$ | —H | CH-R6 | —H | CH-R6' | —TMB | 3 |
| R-II-4 | —OH | —$CH_3$ | —H | —$CH_3$ | —H | —OH | —$C_2H_5$ | —$CH_3$ | —H | CH-R6 | —TMB | CH-R6' | —TMB | 2 |
| R-II-5 | —H | —$C_4H_9$ (t) | —OH | —$CH_3$ | —H | —OH | —$CH_3$ | —$CH_3$ | —H | S | — | CH-R6' | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$ (t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH-R6' | —TMB | 3 |

(R-II)

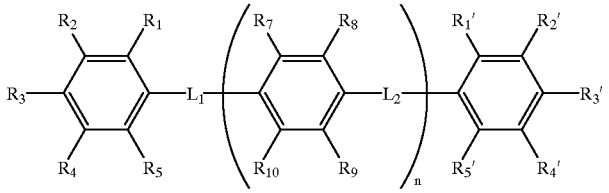

TABLE 15

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

DHP: 2,4-dihydroxyphenyl group (R-III)

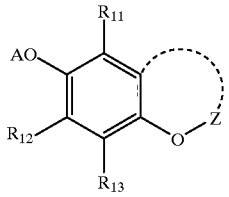

TABLE 15-continued

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|

(Z-1)

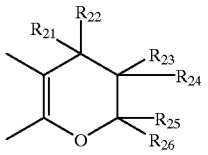

TABLE 16

| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

(R-III)

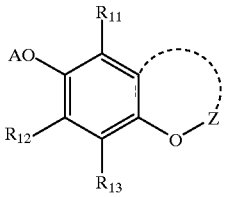

(Z-2)

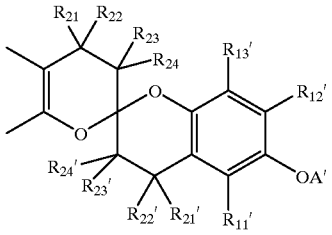

TABLE 17

| No. | Z | $R_{11}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |

(R-IV)

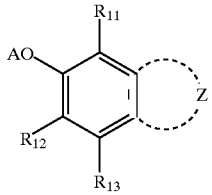

TABLE 17-continued

| No. | Z | $R_{11}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|

(Z-3)

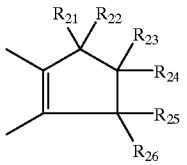

TABLE 18

| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |

(R-IV)

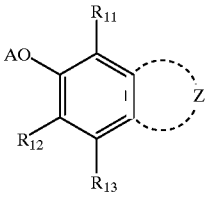

(Z-4)

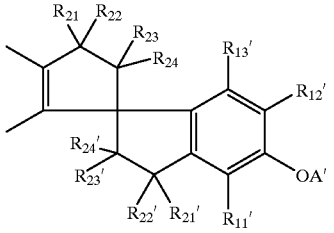

The reducing agent is preferably used in an amount of $1\times10^{-3}$ to 10 mol, more preferably $1\times10^{-2}$ to 1.5 mol per mol of silver.

The photothermographic material according to the invention is processed by a heat development process to form photographic images. As described in the preamble, such photothermographic materials are disclosed in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

The photothermographic material according to the invention preferably contains a reducible silver source (e.g., organic silver salt), a catalytic amount of a photocatalyst (e.g., silver halide), a toner for controlling the tonality of silver, and a reducing agent, typically dispersed in a binder (typically organic binder) matrix. Although the photothermographic material is stable at room temperature, it is developed merely by heating at an elevated temperature (e.g., 80° C. or higher) after exposure, that is, without a need for a processing solution. Upon heating, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

The photothermographic material of the invention has at least one photosensitive layer on a support. It is acceptable to form only a photosensitive layer on a support although it is preferred to form at least one non-photosensitive layer on the photosensitive layer. In order to control the quantity or wavelength distribution of light transmitted to the photosensitive layer, a filter layer may be formed on the same side as or on the opposite side to the photosensitive layer, or a dyestuff or pigment may be contained in the photosensitive layer. The dyestuff used to this end is preferably selected from the compounds described in Japanese Patent Application No. 11184/1995. The photosensitive layer may consist of two or more strata. Also a combination of high/low sensitivity strata or low/high sensitivity strata may be used for the adjustment of gradation.

Various additives may be added to any of the photosensitive layer, a non-photosensitive layer, and other layers. In the photothermographic material of the invention, various additives such as surfactants, antioxidants, stabilizers, plasticizers, UV absorbers, and coating aids may be used.

A binder is used to hold such additives. It is preferably transparent or semi-transparent and generally colorless.

Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1. The binder may be dispersed in water, organic solvent or emulsion to form a dispersion which is coated to form a layer.

It is sometimes advantageous to use an additive known as a "toner" for improving images in addition to the above-mentioned components. The toner is used in an amount of 0.1 to 10% by weight of the entire silver-carrying components. The toners are compounds well known in the photographic art as described in U.S. Pat. Nos. 3,080,254, 3,847,612 and 4,123,282.

As disclosed in Research Report No. 17029, exemplary toners include imides such as phthalimide; cyclic imides such as succinimide, pyrazoline-5-ones, quinazolinone, 3-phenyl-2-pyrazoline-5-one, 1-phenylurazole, quinazoline and 2,4-thiazolizinedione; naphthalimides such as N-hydroxy-1,8-naphthalimide; cobalt complexes such as cobaltic hexamine trifluoroacetate; mercaptans such as 3-mercapto-1,2,4-triazole; N-(aminomethyl) aryldicarboxyimides such as N,N-(dimethylaminomethyl) phthalimide; a combination of blocked pyrazoles, isothiuronium derivatives and certain photobleach agents such as a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl) benzothiazole; merocyanine dyes such as 3-ethyl-5-[(3-ethyl-2-benzothiazolinylidene)-1-methyl-ethylidene]-2-thio-2,4-oxazolidinedione; phthalazinone, phthalazinone derivatives or metal salts of these derivatives such as 4-(1-naphthyl)phthalazinone, 6-chlorophthalazinone, 5,7-dimethyloxyphthalazinone and 2,3-dihydro-1,4-phthalazinedione; a combination of phthalazinone with a sulfinic acid derivative such as 6-chlorophthalazinone plus sodium benzenesulfinate or 8-methylphthalazinone plus sodium p-trisulfonate; a combination of phthalazinone and phthalic acid; a combination of phthalazine (inclusive of phthalazine adducts) with at least one compound selected from maleic anhydride, phthalic acid, 2,3-naphthalenedicarboxylic acid, and o-phenylenic acid derivatives and anhydrides thereof such as phthalic acid, 4-methylphthalic acid, 4-nitro-phthalic acid and tetrachlorophthalic anhydride; quinazolinediones, benzoxazine or naphthoxazine derivatives; benzoxazine-2,4-diones such as 1,3-benzoxazine-2,4-dione; pyrimidine and asym-triazines such as 2,4-dihydroxypyrimidine; tetraazapentalene derivatives such as 3,6-dimercapto-1,4-diphenyl-1H,4H-2,3a,5,6a-tetraazapentalene. Phthalazones are the preferred toners.

Silver Halide

The silver halide which is useful as a catalytic amount of photocatalyst may be selected from photosensitive silver halides such as silver bromide, silver iodide, silver chloride, silver chlorobromide, silver iodobromide, and silver chloroiodobromide, with an iodide ion being preferably contained. The silver halide may be added to the image forming layer by any desired method whereupon the silver halide is disposed close to the reducible silver source. In general, the silver halide is contained in an amount of 0.75 to 30% by weight based on the reducible silver source. The silver halide may be prepared by converting a silver soap moiety through reaction with a halide ion, or by preforming silver halide and adding it upon generation of a soap, or a combination of these methods. The latter method is preferred.

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is preferably up to 0.20 $\mu$m, more preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, iridium, ruthenium, rhenium, osmium, cobalt, and iron. The metal complexes may be used alone or in admixture of two or more complexes of a common metal or different metals. An appropriate amount of the metal complex is 1 mmol to 10 mmol, more preferably 10 mmol to 100 $\mu$mol per mol of silver. Illustrative metal complex structures are those described in JP-A 225449/1995.

The rhodium compounds used herein are preferably water-soluble rhodium compounds. Examples include rhodium(III) halides and rhodium complex salts having halogens, amines and oxalates as a ligand, for example, hexachlororhodium (III) complex salt, hexabromorhodium (III) complex salt, hexaminerhodium(III) complex salt, and trizalatorhodium(III) complex salt. These rhodium compounds are used as a solution in water or a suitable solvent. One method often used for stabilizing a solution of a rhodium compound is by adding an aqueous solution of hydrogen halide (e.g., hydrochloric acid, hydrobromic acid, and hydrofluoric acid) or an alkali halide (e.g., KCl, NaCl, KBr, and NaBr). Instead of using water-soluble rhodium compounds, a rhodium compound can be dissolved during preparation of silver halide by adding separate silver halide grains doped with rhodium thereto. The iridium compounds used herein include hexachloroiridium, hexabromoiridium, and hexamineiridium. The ruthenium compounds used herein include hexachloro-ruthenium and pentachloronitrosilruthenium. The cobalt and iron compounds are preferably hexacyano metal complexes while illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method A using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis-(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization can also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

Organic Silver Salt

The reducible silver sources used herein are preferably silver salts of organic and hetero-organic acids containing a reducible silver ion source.

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof. Silver behenate is the preferred silver source.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2—(ethylglycolamido)- benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size. In the practice of the invention, grains should preferably have a minor axis of 0.01 $\mu$m to 0.20 $\mu$m, more preferably 0.01 $\mu$m to 0.15 $\mu$m and a major axis of 0.10 $\mu$m to 5.0 $\mu$m, more preferably 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The reducible silver source is preferably used in such amounts to give a coverage of up to 3 g/m$^2$, especially up to 2 g/m$^2$ of silver.

An antifoggant may be contained in the photosensitive material according to the invention. The most effective antifoggant was mercury ion. Use of a mercury compound as the antifoggant in photosensitive material is disclosed, for example, in U.S. Pat. No. 3,589,903. Mercury compounds, however, are undesirable from the environmental aspect. Preferred in this regard are non-mercury antifoggants as disclosed, for example, in U.S. Pat. Nos. 4,546,075 and 4,452,885 and JP-A 57234/1984.

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in UKP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Especially preferred antifoggants used herein are compounds as disclosed in U.S. Pat. Nos. 3,874,946 and 4,756,999 and heterocyclic compounds having at least one substituent represented by —C($X^1$) ($X^2$) ($X^3$) wherein $X^1$ and $X^2$ are halogen atoms such as F, Cl, Br, and I, and $X^3$ is hydrogen or halogen. Preferred examples of the heterocyclic compound are shown below.

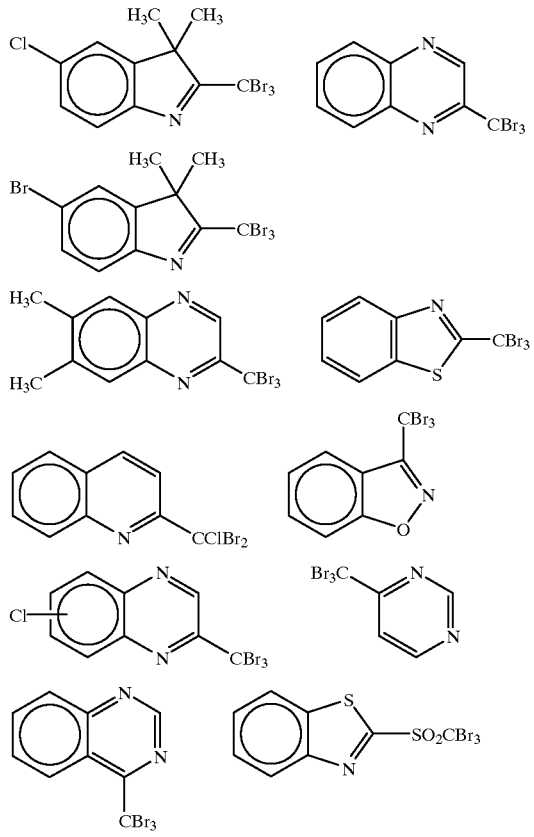

-continued

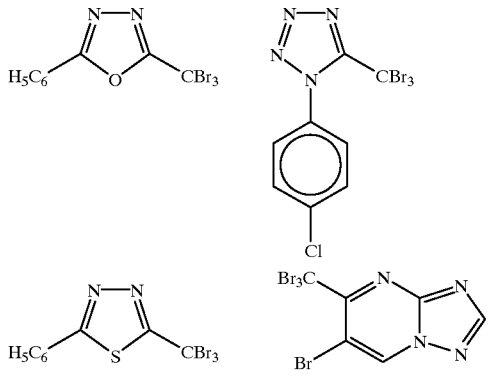

More preferred antifoggants are the heterocyclic compounds disclosed in U.S. Pat. No. 5,028,523, British Patent Application Nos. 92221383.4, 9300147.7 and 9311790.1.

The photosensitive silver halide emulsion may be spectrally sensitized to blue, green, red or infrared light of relatively long wavelength with sensitizing dyes. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes.

In the photothermographic material according to the invention, there may be used sensitizing dyes as disclosed in JP-A 159841/1988, 140335/1985, 231437/1988, 259651/1988, 304242/1988, and 15245/1988, U.S. Pat. Nos. 4,639,414, 4,740,445, 4,741,966, 4,751,175, and 4,835,096.

Useful sensitizing dyes which can be used herein are described in Research Disclosure, Item 17643 IV-A (December 1978, page 23), ibid., Item 1831 X (August 1979, page 437) and the references cited therein.

It is advantageous to select a sensitizing dye having appropriate spectral sensitivity to the spectral properties of a particular light source of various scanners.

Exemplary sensitizing dyes include (A) simple merocyanines as described in JP-A 162247/1985 and 48653/1990, U.S. Pat. No. 2,161,331, W. German Patent No. 936,071, and Japanese Patent Application No. 189532/1991 for argon laser light sources; (B) tri-nucleus cyanine dyes as described in JP-A 62425/1975, 18726/1979 and 102229/1984 and merocyanines as described in Japanese Patent Application No. 103272/1994 for He-Ne laser light sources; (C) thiacarbocyanines as described in JP-B 42172/1973, 9609/1976, 39818/1980, JP-A 284343/1987 and 105135/1990 for LED light sources and red semiconductor laser light sources; and (D) tricarbocyanines as described in JP-A 191032/1984 and 80841/1985 and 4-quinoline nucleus-containing dicarbocyanines as described in JP-A 192242/1984 and 67242/1991 (as represented by formulae (IIIa) and (IIIb) therein) for infrared semiconductor laser light sources.

These sensitizing dyes are more illustratively described. Exemplary sensitizing dyes include (A) compounds (I)-1 to (I)-8 described in JP-A 162247/1985, compounds I-1 to I-28 described in JP-A 48653/1990, compounds I-1 to I-13 described in JP-A 330434/1992, compounds of Examples 1 to 14 described in U.S. Pat. No. 2,161,331, and compounds 1 to 7 described in W. German Patent No. 936,071 for argon laser light sources; (B) compounds I-1 to I-38 described in JP-A 18726/1979, compounds I-1 to I-35 described in JP-A 75322/1994, and compounds I to I-34 described in JP-A 287338/1995 for He-Ne laser light sources; (C) dyes 1 to 20 described in JP-B 39818/1980, compounds I-1 to I-37 described in JP-A 284343/1987, and compounds I-1 to I-34 described in JP-A 287338/1995 for LED light sources; (D) compounds I-1 to I-12 described in JP-A 191032/1984, compounds I-1 to I-22 described in JP-A 80841/1985, compounds I-1 to I-29 described in JP-A 335342/1992, and compounds I-1 to I-18 described in JP-A 192242/1984 for semiconductor laser light sources; (E) compounds (1) to (19) of general formula [1] described in JP-A 45015/1980, compounds I-1 to I-97 described in Japanese Patent Application No. 346193/1995, and compounds 4-A to 4-S, 5-A to 5-Q, and 6-A to 6-T described in JP-A 242547/1994 for tungsten and xenon light sources for printing plate-forming cameras.

For combined use with the organic silver salt, an advantageous choice is made of the sensitizing dyes described in Japanese Patent Application No. 132838/1996.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization.

Useful sensitizing dyes, combinations of sensitizing dyes providing supersensitization, and compounds providing supersensitization are described in Research Disclosure, Vol. 176, 17643 (December 1978), item IV-J on page 23, JP-B 25500/1974 and 4933/1968, JP-A 19032/1984 and 192242/1984.

The sensitizing dye is added to a silver halide emulsion by dispersing the dye directly in the emulsion or by dissolving the dye in a suitable solvent or a mixture of solvents and adding the solution to the emulsion. The solvents used herein include water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/

1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye added varies with the shape, size and halogen composition of silver halide grains, the method and extent of chemical sensitization, and the type of antifoggant although the amount is generally $4\times10^{-6}$ to $8\times10^{-3}$ mol per mol of silver halide. Where silver halide grains have a size of 0.2 to 1.3 $\mu$m, the amount of the sensitizing dye added is preferably $2\times10^{-7}$ to $3.5\times10^{-6}$ mol, more preferably $6.5\times10^{-7}$ to $2.0\times10^{-6}$ mol per square meter of the surface area of silver halide grains.

In the photothermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

In the photosensitive layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in UKP 955,061 may be added as a plasticizer and lubricant.

According to the invention, a hardener may be used in various layers including a photosensitive layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

In the practice of the invention, a surfactant may be used for the purposes of improving coating and electric charging properties. The surfactant used herein may be nonionic, anionic or cationic or a fluorinated one. Examples include fluorinated polymer surfactants as described in JP-A 170950/1987 and U.S. Pat. No. 5,382,504, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 1,000 to 10,000 seconds, especially 2,000 to 10,000 seconds is preferred.

For the exposure of photothermographic photosensitive material according to the invention, the use of an Ar laser (488 nm), He-Ne laser (633 nm), red semiconductor laser (670 nm) and infrared semiconductor laser (780 and 830 nm) is preferred.

In the photothermographic material of the invention, a dye may be contained for the purpose of preventing halation, irradiation, and safe light fogging.

For Ar lasers, He—Ne lasers, and red semiconductor lasers, a dye is preferably added so as to provide an absorbance of at least 0.3, more preferably at least 0.6, most preferably at least 0.8 at an exposure wavelength in the range of 400 to 750 nm. For an infrared semiconductor laser, a dye is preferably added so as to provide an absorbance of at least 0.3, more preferably at least 0.6, most preferably at least 0.8 at an exposure wavelength in the range of 750 to 1500 nm. The dyes may be used alone or in admixture of two or more. The dye preferably has an absorbance of less than 0.5, more preferably less than 0.2 in the visible region of 300 to 700 nm after heat development.

The dyes used herein may be any compounds which have absorption in the desired wavelength range and sufficiently low absorption in the visible region and provide a desired absorbance spectral profile. Exemplary compounds are described in U.S. Pat. No. 5,380,635, JP-A 13295/1995, 68539/1990 (pages 13 to 14), and 24539/1991 (pages 14 to 16).

For anti-halation and anti-irradiation purposes, the dye is preferably added to a photosensitive layer on a support, a non-photosensitive layer between the photosensitive layer and the support, or a non-photosensitive layer on the support remote from the photosensitive layer. For the purpose of preventing safe light fogging, the dye is preferably added to a protective layer or a non-photosensitive layer on the support remote from the photosensitive layer.

The photothermographic material of the present invention is preferably in the form of a one-side photosensitive material having at least one photosensitive layer containing a silver halide emulsion on one surface of a support and a back layer on the other surface thereof.

In the practice of the invention, a matte agent may be added to the one-side photosensitive material for improving feed efficiency. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, ureaformaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the backing layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

According to the invention, the photothermographic emulsion can be coated on a wide variety of supports. Typical supports include paper, synthetic paper, paper laminated with synthetic resins (e.g., polyethylene, polypropylene and polystyrene), plastic films (e.g., polyethylene terephthalate, polycarbonate, polyimide, nylon, and cellulose triacetate), metal sheets (e.g., aluminum, aluminum alloy, zinc, iron and copper), and paper and plastic films having such metals laminated or evaporated thereon. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The support may be either transparent or opaque, preferably transparent.

When plastic film is passed through a photothermographic processor, the film experiences dimensional shrinkage or expansion. When the photosensitive material is intended for printing purposes, this dimensional shrinkage or expansion gives rise to a serious problem for precision multi-color printing. Therefore, the invention favors the use of a film experiencing a minimal dimensional change. Exemplary materials are styrene polymers having a syndiotactic structure and heat-treated polyethylene. Also useful are materials having a high glass transition temperature, for example, polyether ethyl ketone, polystyrene, polysulfone, polyether sulfone, and polyarylate.

A backside resistive heating layer as described in U.S. Pat. Nos. 4,460,681 and 4,374,921 may be used in a photothermographic image system according to the present invention.

The photosensitive material of the invention may have an antistatic or electroconductive layer, for example, a layer containing soluble salts (e.g., chlorides and nitrates), a metallized layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate photosensitive material.

EXAMPLE

Examples of the present invention are given below by way of illustration and not by way of limitation.

The trade names used in Examples have the following meaning.

CAB 171-15S: cellulose acetate butyrate by Eastman Chemical Products, Inc.

Denka Butyral: polyvinyl butyral by Denki Kagaku Kogyo K.K.

Megafax F-176P: fluorinated surfactant by Dai-Nihon Ink Chemical Industry K.K.

Sildex: spherical silica by Dokai Chemical K.K.

Sumidur N3500: polyisocyanate by Sumitomo-Bayern Urethane K.K.

Example 1

Preparation of Organic Acid Silver Salt Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a 1.2 wt % butyl acetate solution of polyvinyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% butanone solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Preparation of Emulsion Layer Coating Solution A

Various chemicals were added to the above-prepared organic acid silver salt emulsion as follows. It is noted that the amounts of chemicals added are expressed per mol of silver. With stirring at 25° C., 10 mg of sodium phenylthiosulfonate, 75 mg of sensitizing dye A, 2 grams of 2-mercapto-5-methylbenzimidazole, 1 gram of 2-mercapto-5-methylbenzothiazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 4.5 grams of 4,6-ditrichloromethyl-2-phenyltriazine, 2 grams of disulfide compound A, 160 grams of 1,1-bis(2-hydroxy-3,5-dimethylphenyl)-3,5,5-trimethylhexane, 15 grams of phthalazine, 5 grams of tetrachlorophthalic acid, an amount of a hydrazine derivative as reported in Table 19, 1.1 grams of Megafax F-176P, 590 grams of 2-butanone and 10 grams of methyl isobutyl ketone.

Sensitizing Dye A

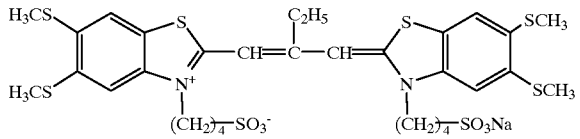

Disulfide Compound A

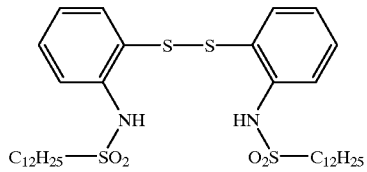

Preparation of Emulsion Surface Protective Layer Coating Solution A

A coating solution was prepared by dissolving 75 grams of CAB 171-15S, 5.7 grams of 4-methylphthalic acid, 1.5 grams of tetrachlorophthalic anhydride, 10 grams of 2-tribromomethylsulfonylbenzothiazole, 2 grams of phthalazone, 0.3 grams of Megafax F-176P, 2 grams of Sildex H31 (spherical silica having a mean particle size of 3 μm), and 5 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl isocyanate in 6 grams of ethyl acetate were added to the solution to complete the coating solution.

dye A

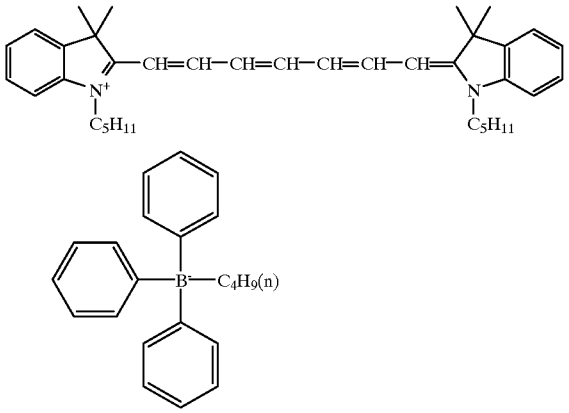

Onto a polyethylene terephthalate film having a moisture-proof undercoat containing vinylidene chloride on either surface, the back layer coating solution was applied so as to provide an optical density of 0.7 at 633 nm.

Preparation of Coated Sample

Onto the thus prepared support, the emulsion layer coating solution was applied in a coverage of 2 g/m$^2$of silver. The emulsion surface protective layer coating solution was then applied onto the emulsion layer to form a protective layer having a dry thickness of 5 $\mu$m.

Photoarahic Property Test

The photographic material samples were exposed by means of a He—Ne light source color scanner SG-608 by Dai-Nihon Screen K.K. and heated for development at 115° C. for 25 seconds on a heat drum. A halide lamp was operated to illuminate light to the developed samples for 15 seconds. The resulting images were determined for Dmax and sensitivity (S, an inversion of a ratio of an exposure dose providing a density higher by 1.5 than Dmin) by a densitometer. Gradation (γ) is the gradient of a straight line connecting points of density 0.3 and 3.0 on a characteristic curve. The results are shown in Table 19.

Pepper Fog Test

An unexposed photosensitive material was developed on a heat drum at 120° C. for 60 seconds whereupon the number of black pepper spots was visually counted and rated on a five-point scale with point "5" for the best quality and point "1" for the worst quality. Point "3" is a practically acceptable limit and points "2" and "1" are practically unacceptable. The results are shown in Table 19.

TABLE 19

| | Compound | Amount (mol/ Mol Ag) | Dmax | Sensitivity | γ | Pepper fog rating |
|---|---|---|---|---|---|---|
| 1* | | | 2.5 | 0.80 | 3.6 | 5 |
| 2* | A-1 | $9 \times 10^{-3}$ | 4.9 | 1.49 | 13.3 | 1 |
| 3* | A-2 | $9 \times 10^{-3}$ | 4.8 | 1.47 | 13.4 | 1 |
| 4 | 1 | $7 \times 10^{-3}$ | 4.9 | 1.49 | 13.1 | 5 |
| 5 | 2 | $7 \times 10^{-3}$ | 4.8 | 1.47 | 13.2 | 5 |
| 6 | 3 | $7 \times 10^{-3}$ | 4.9 | 1.48 | 13.0 | 5 |

TABLE 19-continued

| | Compound | Amount (mol/ Mol Ag) | Dmax | Sensitivity | γ | Pepper fog rating |
|---|---|---|---|---|---|---|
| 7 | 5 | $7 \times 10^{-3}$ | 4.9 | 1.49 | 13.4 | 5 |
| 8 | 7 | $7 \times 10^{-3}$ | 4.9 | 1.47 | 13.1 | 5 |
| 9 | 10 | $7 \times 10^{-3}$ | 4.6 | 1.41 | 12.8 | 4 |
| 10 | 14 | $7 \times 10^{-3}$ | 4.6 | 1.42 | 12.9 | 4 |
| 11 | 19 | $7 \times 10^{-3}$ | 4.8 | 1.47 | 13.4 | 5 |
| 12 | 28 | $7 \times 10^{-3}$ | 4.9 | 1.43 | 12.7 | 4 |
| 13 | 29 | $7 \times 10^{-3}$ | 4.9 | 1.49 | 13.5 | 5 |
| 14 | 31 | $7 \times 10^{-3}$ | 4.9 | 1.45 | 13.5 | 5 |
| 15 | 42 | $7 \times 10^{-3}$ | 4.9 | 1.48 | 13.5 | 5 |

*comparison

Note that compounds A-1 and A-2 are described in U.S. Pat. No. 5,496,695 and have the following formulae.

compound A-1

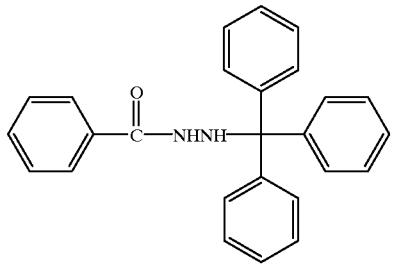

compound A-2

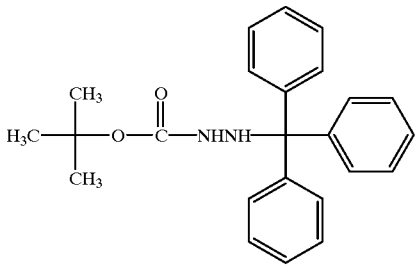

It is evident that photothermographic materials using hydrazine compounds within the scope of the invention satisfy all the requirements of high Dmax, high contrast and pepper fog.

Example 2

Preparation of Silver Halide Grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_4[Fe(CN)_6]$ were added over 10 minutes by a controlled double jet method while maintaining the solution at pAg 7.7. Note that $[Fe(CN)_6{}^{4-}]$ was added in an amount of $3\times10^{-5}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 $\mu$m, a coefficient of variation of projected area of 8%, and a {100} plane ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of Organic Acid Silver Emulsion B

A mixture of 10.6 grams of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a 1/2 solvent mixture of butyl acetate and isopropyl alcohol was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining a silver behenate emulsion of needle grains having a mean minor diameter of 0.04 μm, a mean major diameter of 1 μm and a coefficient of variation of 30%.

Preparation of Emulsion Layer Coating Solution B

Various chemicals were added to the above-prepared organic acid silver salt emulsion B as follows. It is noted that the amounts of chemicals added are expressed per mol of silver. With stirring at 25° C., 10 mg of sodium phenylthiosulfonate, 85 mg of sensitizing dye A, 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. Then, with stirring, 4 grams of 4,6-ditrichloromethyl-2-phenyltriazine, 2 grams of disulfide compound A, 170 grams of 1,1-bis(2-hydroxy-3,5-dimethylphenyl)-3,5,5-trimethylhexane, 5 grams of tetrachlorophthalic acid, 15 grams of phthalazine, an amount of a hydrazine derivative as reported in Table 20, 1.1 grams of Megafax F-176P, 590 grams of 2-butanone and 10 grams of methyl isobutyl ketone were added.

Emulsion Surface Protective Layer Coating Solution

A coating solution was prepared by dissolving 75 grams of CAB 171-15S, 5.7 grams of 4-methylphthalic acid, 1.5 grams of tetrachlorophthalic anhydride, 8 grams of 5 -tribromomethylsulfonyl-2-methylthiadiazole, 6 grams of 2-tribromomethylsulfonylbenzothiazole, 3 grams of phthalazine, 0.3 grams of Megafax F-176P, 2 grams of Sildex H31 (spherical silica having a mean particle size 3 μm), and 6 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl isocyanate in 6 grams of ethyl acetate were added to the solution to complete the coating solution.

Onto a polyethylene terephthalate film having a moisture-proof undercoat containing vinylidene chloride on either surface, the back layer coating solution was applied so as to provide an optical density of 0.7 at 633 nm.

It is noted that sensitizing dye A, disulfide compound A, and dye A used herein are as identified in Example 1.

Preparation of Coated Sample

Onto the thus prepared support, the emulsion layer coating solution was applied in a coverage of 2 g/m$^2$ of silver. The emulsion surface protecting layer coating solution was then applied onto the emulsion layer to form a protective layer having a dry thickness of 5 μm.

The samples were evaluated for photographic properties and pepper fog as in Example 1. The results are shown in Table 20.

TABLE 20

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-1 | $9 \times 10^{-3}$ | 4.9 | 1.47 | 13.1 | 1 |
| 3* | A-2 | $9 \times 10^{-3}$ | 4.8 | 1.45 | 13.2 | 1 |
| 4 | 1 | $7 \times 10^{-3}$ | 4.9 | 1.47 | 12.9 | 5 |
| 5 | 2 | $7 \times 10^{-3}$ | 4.8 | 1.45 | 13.0 | 5 |
| 6 | 3 | $7 \times 10^{-3}$ | 4.9 | 1.46 | 12.8 | 5 |
| 7 | 5 | $7 \times 10^{-3}$ | 4.9 | 1.47 | 13.2 | 5 |
| 8 | 7 | $7 \times 10^{-3}$ | 4.9 | 1.45 | 12.9 | 5 |
| 9 | 10 | $7 \times 10^{-3}$ | 4.6 | 1.39 | 12.7 | 4 |
| 10 | 14 | $7 \times 10^{-3}$ | 4.6 | 1.40 | 12.8 | 4 |
| 11 | 19 | $7 \times 10^{-3}$ | 4.8 | 1.45 | 13.2 | 5 |
| 12 | 28 | $7 \times 10^{-3}$ | 4.9 | 1.41 | 12.6 | 4 |
| 13 | 29 | $7 \times 10^{-3}$ | 4.9 | 1.47 | 13.3 | 5 |
| 14 | 31 | $7 \times 10^{-3}$ | 4.9 | 1.43 | 13.3 | 5 |
| 15 | 42 | $7 \times 10^{-3}$ | 4.9 | 1.46 | 13.3 | 5 |

*comparison

Note that compounds A-1 and A-2 are described in U.S. Pat. No. 5,496,695 and shown at the end of Table 19.

It is evident that photothermographic materials using hydrazine compounds within the scope of the invention satisfy all the requirements of high Dmax, high contrast and pepper fog.

Example 3

Preparation of Organic Acid Silver Salt Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a 1.2 wt % butyl acetate solution of polyvinyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% 2-butanone solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.05 m, a mean major diameter of 1.2 μm, and a coefficient of variation of 25%.

Preparation of Emulsion Layer Coating Solution A

Various chemicals were added to the above-prepared organic acid silver salt emulsion as follows. It is noted that the amounts of chemicals added are expressed per mol of silver. With stirring at 25° C., 10 mg of sodium phenylthiosulfonate, 75 mg of sensitizing dye A, 2 grams of 2-mercapto-5-methylbenzimidazole, 1 gram of 2-mercapto-5-methylbenzothiazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 4.5 grams of 4,6-ditrichloromethyl-2-phenyltriazine, 2 grams of disulfide compound A, 160 grams of 1,1-bis(2-hydroxy-3,5-dimethylphenyl)-3,5,5-trimethylhexane, 15 grams of phthalazine, 5 grams of tetrachlorophthalic acid, an amount of a hydrazine derivative as reported in Table 21, 1.1 grams of Megafax F-176P, 590 grams of 2-butanone and 10 grams of methyl isobutyl ketone.

Preparation of Emulsion Surface Protective Layer Coating Solution A

A coating solution was prepared by dissolving 75 grams of CAB 171-15S, 5.7 grams of 4-methylphthalic acid, 1.5 grams of tetrachlorophthalic anhydride, 10 grams of 2-tribromomethylsulfonylbenzothiazole, 2 grams of phthalazone, 0.3 grams of Megafax F-176P, 2 grams of Sildex H31 (spherical silica having a mean particle size of 3 μm), and 5 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl isocyanate in 6 grams of ethyl acetate were added to the solution to complete the coating solution.

Onto a polyethylene terephthalate film having a moisture-proof undercoat containing vinylidene chloride on either surface, the back layer coating solution was applied so as to provide an optical density of 0.7 at 633 nm.

Preparation of Coated Sample

Onto the thus prepared support, the emulsion layer coating solution was applied in a coverage of 2 g/m$^2$ of silver. The emulsion surface protective layer coating solution was then applied onto the emulsion layer to form a protective layer having a dry thickness of 5 μm.

Photographic Property Test

The photographic material samples were exposed by means of a He—Ne light source color scanner SG-608 by Dai-Nihon Screen K.K. and heated for development at 115° C. for 25 seconds on a heat drum. A halide lamp was operated to illuminate light to the developed samples for 15 seconds. The resulting images were determined for Dmax and sensitivity (S, an inversion of a ratio of an exposure dose providing a density higher by 1.5 than Dmin) by a densitometer. Gradation (γ) is the gradient of a straight line connecting points of density 0.3 and 3.0 on a characteristic curve. The results are shown in Table 21.

Pepper Fog Test

An unexposed photosensitive material was developed on a heat drum at 120° C. for 60 seconds whereupon the number of black pepper spots was visually counted and rated on a five-point scale with point "5" for the best quality and point "1" for the worst quality. Point "3" is a practically acceptable limit and points "2" and "1" are practically unacceptable. The results are shown in Table 21.

It is noted that the compounds used in Example 3 have the following structure.

TABLE 21

| Sample No. | compound | Amount (mol/mol Ag) | $D_{max}$ | Sensitivity | γ | Pepper fog rating |
|---|---|---|---|---|---|---|
| 1* | | | 2.5 | 0.80 | 3.6 | 5 |
| 2* | A-1 | $9 \times 10^{-3}$ | 4.9 | 1.49 | 13.3 | 1 |
| 3* | A-2 | $9 \times 10^{-3}$ | 4.8 | 1.47 | 13.4 | 1 |
| 4 | 1-1 | $8 \times 10^{-3}$ | 4.9 | 1.49 | 13.1 | 5 |
| 5 | 1-3 | $8 \times 10^{-3}$ | 4.8 | 1.50 | 13.3 | 5 |
| 6 | 1-5 | $8 \times 10^{-3}$ | 4.9 | 1.48 | 13.0 | 5 |
| 7 | 1-7 | $8 \times 10^{-3}$ | 4.9 | 1.49 | 13.4 | 5 |
| 8 | 1-8 | $8 \times 10^{-3}$ | 4.9 | 1.47 | 13.1 | 5 |
| 9 | 1-11 | $9 \times 10^{-3}$ | 4.6 | 1.41 | 12.8 | 4 |
| 10 | 1-12 | $9 \times 10^{-3}$ | 4.6 | 1.42 | 12.9 | 4 |
| 11 | 1-17 | $8 \times 10^{-3}$ | 4.8 | 1.47 | 13.4 | 5 |
| 12 | 1-19 | $9 \times 10^{-3}$ | 4.9 | 1.40 | 12.7 | 4 |
| 13 | 1-21 | $3 \times 10^{-3}$ | 4.9 | 1.49 | 13.5 | 5 |
| 14 | 1-22 | $8 \times 10^{-3}$ | 4.9 | 1.48 | 13.2 | 5 |

*comparison

Note that compounds A-1 and A-2 are described in U.S. Pat. No. 5,496,695 and shown at the end of Table 19.

It is evident that photothermographic materials using hydrazine compounds within the scope of the invention satisfy all the requirements of high Dmax, high contrast and suppressed pepper fog.

Example 4

Preparation of Silver Halide Grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_4[Fe(CN)_6]$ were added over 10 minutes by a controlled double jet method while maintaining the solution at pAg 7.7. Note that $[Fe(CN)_6]^{4-}$ was added in an amount of $3\times10^{-5}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 μm, a coefficient of variation of projected area of 8%, and a {100} plane ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of Organic Acid Silver Emulsion B

A mixture of 10.6 grams of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 5 ml of 1N tetrachlorophthalic acid was added thereto, and with more vigorous stirring, 0.13 gram of N-bromosuccinimide was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a 1/2 solvent mixture of butyl acetate and isopropyl alcohol was added. To the thus obtained gel-like mixture of organic acid silver and silver halide, 7.8 grams of polyvinyl butyral (Denka Butyral #4000-2) and 57 grams of isopropyl alcohol were added. The mixture was dispersed by a homogenizer, obtaining a silver behenate emulsion of needle grains having a mean minor diameter of 0.04 μm, a mean major diameter of 1 μm and a coefficient of variation of 30%.

Preparation of Emulsion Layer Coating Solution B

Various chemicals were added to the above-prepared organic acid silver salt emulsion B as follows. It is noted that the amounts of chemicals added are expressed per mol of silver. With stirring at 25° C., 10 mg of sodium phenylthiosulfonate, 85 mg of sensitizing dye A, 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. Then, with stirring, 4 grams of 4,6-ditrichloromethyl-2-phenyltriazine, 2 grams of disulfide compound A, 170 grams of 1,1-bis(2-hydroxy-3,5-dimethylphenyl)-3,5,5-trimethylhexane, 5 grams of tetrachlorophthalic acid, 15 grams of phthalazine, an amount of a hydrazine derivative as reported in Table 22, 1.1 grams of Megafax F-176P, 590 grams of 2-butanone and 10 grams of methyl isobutyl ketone were added.

Emulsion Surface Protective Layer Coating Solution

A coating solution was prepared by dissolving 75 grams of CAB 171-15S, 5.7 grams of 4-methylphthalic acid, 1.5 grams of tetrachlorophthalic anhydride, 8 grams of 5-tribromomethylsulfonyl-2-methylthiadiazole, 6 grams of 2-tribromomethylsulfonylbenzothiazole, 3 grams of phthalazone, 0.3 grams of Megafax F-176P, 2 grams of Sildex H31 (spherical silica having a mean particle size 3 μm), and 6 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl isocyanate in 6 grams of ethyl acetate were added to the solution to complete the coating solution.

Onto a polyethylene terephthalate film having a moisture-proof undercoat containing vinylidene chloride on either surface, the back layer coating solution was applied so as to provide an optical density of 0.7 at 633 nm.

It is noted that sensitizing dye A, disulfide compound A, and dye A used herein are as identified in Example 3.

Preparation of Coated Sample

Onto the thus prepared support, the emulsion layer coating solution was applied in a coverage of 2 g/m$^2$ of silver. The emulsion surface protecting layer coating solution was then applied onto the emulsion layer to form a protective layer having a dry thickness of 5 μm.

The samples were evaluated for photographic properties and pepper fog as in Example 3. The results are shown in Table 22.

TABLE 22

| Sample No. | compound | Amount (mol/mol Ag) | $D_{max}$ | Sensitivity | γ | Pepper fog rating |
|---|---|---|---|---|---|---|
| 1* | | | 2.5 | 0.80 | 3.6 | 5 |
| 2* | A-1 | $9 \times 10^{-3}$ | 4.9 | 1.50 | 13.4 | 1 |
| 3* | A-2 | $9 \times 10^{-3}$ | 4.8 | 1.48 | 13.5 | 1 |
| 4 | 1-1 | $8 \times 10^{-3}$ | 4.9 | 1.50 | 13.2 | 5 |
| 5 | 1-3 | $8 \times 10^{-3}$ | 4.8 | 1.51 | 13.4 | 5 |
| 6 | 1-5 | $8 \times 10^{-3}$ | 4.9 | 1.49 | 13.1 | 5 |
| 7 | 1-7 | $8 \times 10^{-3}$ | 4.9 | 1.50 | 13.5 | 5 |
| 8 | 1-8 | $8 \times 10^{-3}$ | 4.9 | 1.48 | 13.2 | 5 |
| 9 | 1-11 | $9 \times 10^{-3}$ | 4.6 | 1.42 | 12.9 | 4 |
| 10 | 1-12 | $9 \times 10^{-3}$ | 4.6 | 1.43 | 13.0 | 4 |
| 11 | 1-17 | $8 \times 10^{-3}$ | 4.8 | 1.48 | 13.5 | 5 |
| 12 | 1-19 | $9 \times 10^{-3}$ | 4.9 | 1.41 | 12.8 | 4 |
| 13 | 1-21 | $3 \times 10^{-3}$ | 4.9 | 1.50 | 13.6 | 5 |
| 14 | 1-22 | $8 \times 10^{-3}$ | 4.8 | 1.47 | 13.3 | 5 |

*comparison
Note that compounds A-1 and A-2 are described in U.S. Pat. No. 5,496,695 and shown at the end of Table 19.

It is evident that photothermographic materials using hydrazine compounds within the scope of the invention satisfy all the requirements of high Dmax, high contrast and suppressed pepper fog.

Example 5

Preparation of Organic Acid Silver Salt Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a 1.2 wt % butyl acetate solution of polyvinyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% 2-butanone solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Preparation of Emulsion Layer Coating Solution A

Various chemicals were added to the above-prepared organic acid silver salt emulsion as follows. It is noted that the amounts of chemicals added are expressed per mol of silver. With stirring at 25° C., 10 mg of sodium phenylthiosulfonate, 75 mg of sensitizing dye A, 2 grams of 2-mercapto-5-methylbenzimidazole, 1 gram of 2-mercapto-5-methylbenzothiazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 4.5 grams of 4,6-ditrichloromethyl-2-phenyltriazine, 2 grams of disulfide compound A, 160 grams of 1,1-bis(2-hydroxy-3,5-dimethylphenyl)-3,5,5-trimethylhexane, 15 grams of phthalazine, 5 grams of tetrachlorophthalic acid, an amount of a hydrazine derivative as reported in Table 23, 1.1 grams of Megafax F-176P, 590 grams of 2-butanone and 10 grams of methyl isobutyl ketone.

Sensitizing Dye A

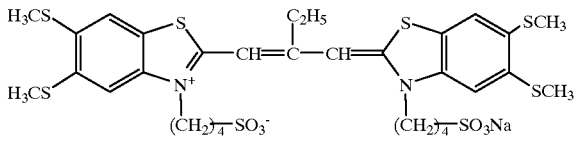

Disulfide Compound A

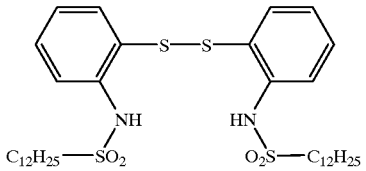

Preparation of Emulsion Surface Protective Layer Coating Solution A

A coating solution was prepared by dissolving 75 grams of CAB 171-15S, 1.5 grams of tetrachlorophthalic anhydride, 10 grams of 2-tribromomethylsulfonylbenzothiazole, 2 grams of phthalazone, 0.3 grams of Megafax F-176P, 2 grams of Sildex H31 (spherical silica having a mean particle size of 3 μm), and 5 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl isocyanate in 6 grams of ethyl acetate were added to the solution to complete the coating solution.

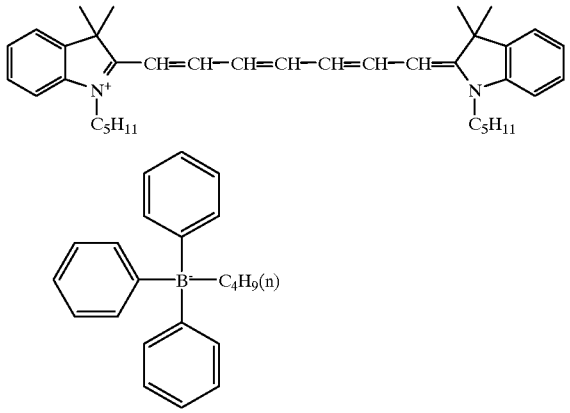

Onto a polyethylene terephthalate film having a moisture-proof undercoat containing vinylidene chloride on either surface, the back layer coating solution was applied so as to provide an optical density of 0.7 at 633 nm.

Preparation of Coated Sample

Onto the thus prepared support, the emulsion layer coating solution was applied in a coverage of 2 g/m$^2$ of silver. The emulsion surface protective layer coating solution was then applied onto the emulsion layer to form a protective layer having a dry thickness of 5 μm.

Photographic Property Test

The photographic material samples were exposed by means of a He—Ne light source color scanner SG-608 by Dai-Nihon Screen K.K. and heated for development at 115° C. for 25 seconds on a heat drum. A halide lamp was operated to illuminate light to the developed samples for 15 seconds. The resulting images were determined for Dmax and sensitivity (S, an inversion of a ratio of an exposure dose providing a density higher by 1.5 than Dmin) by a densitometer. Gradation (γ) is the gradient of a straight line connecting points of density 0.3 and 3.0 on a characteristic curve. The results are shown in Table 23.

Pepper Fog Test

An unexposed photosensitive material was developed on a heat drum at 120° C. for 60 seconds whereupon the number of black pepper spots was visually counted and rated on a five-point scale with point "5" for the best quality and point "1" for the worst quality. Point "3" is a practically acceptable limit and points "2" and "1" are practically unacceptable. The results are shown in Table 23.

TABLE 23

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-1 | $9 \times 10^{-3}$ | 4.9 | 1.47 | 13.4 | 1 |
| 3* | A-2 | $9 \times 10^{-3}$ | 4.8 | 1.45 | 13.5 | 1 |
| 4 | H-1 | $7 \times 10^{-3}$ | 4.9 | 1.47 | 13.2 | 5 |
| 5 | H-2 | $7 \times 10^{-3}$ | 4.8 | 1.45 | 13.3 | 5 |
| 6 | H-4 | $7 \times 10^{-3}$ | 4.9 | 1.46 | 13.1 | 5 |
| 7 | H-6 | $7 \times 10^{-3}$ | 4.9 | 1.47 | 13.5 | 5 |
| 8 | H-7 | $7 \times 10^{-3}$ | 4.9 | 1.45 | 13.2 | 5 |
| 9 | H-10 | $7 \times 10^{-3}$ | 4.6 | 1.39 | 12.9 | 4 |
| 10 | H-11 | $7 \times 10^{-3}$ | 4.6 | 1.40 | 13.0 | 4 |
| 11 | H-14 | $7 \times 10^{-3}$ | 4.8 | 1.45 | 13.5 | 5 |
| 12 | H-17 | $7 \times 10^{-3}$ | 4.9 | 1.41 | 12.8 | 4 |
| 13 | H-19 | $7 \times 10^{-3}$ | 4.9 | 1.47 | 13.6 | 5 |
| 14 | H-21 | $7 \times 10^{-3}$ | 4.9 | 1.43 | 13.6 | 5 |
| 15 | H-24 | $7 \times 10^{-3}$ | 4.9 | 1.46 | 13.6 | 5 |
| 16 | H-26 | $7 \times 10^{-3}$ | 4.6 | 1.45 | 13.1 | 4 |
| 17 | H-32 | $7 \times 10^{-3}$ | 4.6 | 1.39 | 13.5 | 5 |
| 18 | H-40 | $7 \times 10^{-3}$ | 4.8 | 1.40 | 13.2 | 5 |

*comparison

Note that compound A-1 and A-2 are described in U.S. Pat. No. 5,496,695 and shown at the end of Table 19.

It is evident that photothermographic materials using hydrazine compounds within the scope of the invention satisfy all the requirements of high Dmax, high contrast and pepper fog.

Example 6

Preparation of Silver Halide Grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_4[Fe(CN)_6]$ were added over 10 minutes by a controlled double jet method while maintaining the solution at pAg 7.7. Note that $[Fe(CN)_6]^{4-}$ was added in an amount of $3\times10^{-5}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 μm, a coefficient of variation of projected area of 8%, and a {100} plane ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of Organic Acid Silver Emulsion B

A mixture of 10.6 grams of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a 1/2 solvent mixture of butyl acetate and isopropyl alcohol was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining a silver behenate emulsion of needle grains having a mean minor diameter of 0.04 μm, a mean major diameter of 1 μm and a coefficient of variation of 30%.

Preparation of Emulsion Layer Coating Solution B

Various chemicals were added to the above-prepared organic acid silver salt emulsion B as follows. It is noted that the amounts of chemicals added are expressed per mol of silver. With stirring at 25° C., 10 mg of sodium phenylthiosulfonate, 85 mg of sensitizing dye A, 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. Then, with stirring, 4 grams of 4,6-ditrichloromethyl-2-phenyltriazine, 2 grams of disulfide compound A, 170 grams of 1,1-bis(2-hydroxy-3,5-dimethylphenyl)-3,5,5-trimethylhexane, 5 grams of tetrachlorophthalic acid, 15 grams of phthalazine, an amount of a hydrazine derivative as reported in Table 24, 1.1 grams of Megafax F-176P, 590 grams of 2-butanone and 10 grams of methyl isobutyl ketone were added.

Emulsion Surface Protective Layer Coating Solution

A coating solution was prepared by dissolving 75 grams of CAB 171-15S, 5.7 grams of 4-methylphthalic acid, 1.5 grams of tetrachlorophthalic anhydride, 8 grams of 5-tribromomethylsulfonyl-2-methylthiadiazole, 6 grams of 2-tribromomethylsulfonylbenzothiazole, 3 grams of phthalazine, 0.3 grams of Megafax F-176P, 2 grams of Sildex H31 (spherical silica having a mean particle size 3 μm), and 6 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl isocyanate in 6 grams of ethyl acetate were added to the solution to complete the coating solution.

Onto a polyethylene terephthalate film having a moisture-proof undercoat containing vinylidene chloride on either surface, the back layer coating solution was applied so as to provide an optical density of 0.7 at 633 nm.

It is noted that sensitizing dye A, disulfide compound A, and dye A used herein are as identified in Example 5.

Preparation of Coated Sample

Onto the thus prepared support, the emulsion layer coating solution was applied in a coverage of 2 g/m$^2$ of silver. The emulsion surface protecting layer coating solution was then applied onto the emulsion layer to form a protective layer having a dry thickness of 5 $\mu$m.

The samples were evaluated for photographic properties and pepper fog as in Example 5. The results are shown in Table 24.

TABLE 24

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-1 | $9 \times 10^{-3}$ | 4.9 | 1.45 | 13.2 | 1 |
| 3* | A-2 | $9 \times 10^{-3}$ | 4.8 | 1.43 | 13.3 | 1 |
| 4 | H-1 | $7 \times 10^{-3}$ | 4.9 | 1.45 | 13.0 | 5 |
| 5 | H-2 | $7 \times 10^{-3}$ | 4.8 | 1.43 | 13.1 | 5 |
| 6 | H-4 | $7 \times 10^{-3}$ | 4.9 | 1.44 | 12.9 | 5 |
| 7 | H-6 | $7 \times 10^{-3}$ | 4.9 | 1.45 | 13.3 | 5 |
| 8 | H-7 | $7 \times 10^{-3}$ | 4.9 | 1.43 | 13.0 | 5 |
| 9 | H-10 | $7 \times 10^{-3}$ | 4.6 | 1.37 | 12.7 | 4 |
| 10 | H-11 | $7 \times 10^{-3}$ | 4.6 | 1.38 | 12.8 | 4 |
| 11 | H-14 | $7 \times 10^{-3}$ | 4.8 | 1.43 | 13.3 | 5 |
| 12 | H-17 | $7 \times 10^{-3}$ | 4.9 | 1.39 | 12.6 | 4 |
| 13 | H-19 | $7 \times 10^{-3}$ | 4.9 | 1.45 | 13.4 | 5 |
| 14 | H-21 | $7 \times 10^{-3}$ | 4.9 | 1.41 | 13.4 | 5 |
| 15 | H-24 | $7 \times 10^{-3}$ | 4.9 | 1.44 | 13.4 | 5 |
| 16 | H-26 | $7 \times 10^{-3}$ | 4.6 | 1.43 | 12.9 | 4 |
| 17 | H-32 | $7 \times 10^{-3}$ | 4.6 | 1.37 | 13.3 | 5 |
| 18 | H-40 | $7 \times 10^{-3}$ | 4.8 | 1.38 | 13.0 | 5 |

*comparison

Note that compounds A-1 and A-2 are described in U.S. Pat. No. 5,496,695 and shown at the end of Table 19.

It is evident that photothermographic materials using hydrazine compounds within the scope of the invention satisfy all the requirements of high Dmax, high contrast and pepper fog.

Example 7

Preparation of Organic Acid Silver Salt Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide (C-12) was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a 1.2 wt % butyl acetate solution of polyvinyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% 2-butanone solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.05 $\mu$m, a mean major diameter of 1.2 $\mu$m, and a coefficient of variation of 25%.

Preparation of Emulsion Layer Coating Solution A

Various chemicals were added to the above-prepared organic acid silver salt emulsion as follows. It is noted that the amounts of chemicals added are expressed per mol of silver. With stirring at 25° C., 10 mg of sodium phenylthiosulfonate, 75 mg of sensitizing dye A, 2 grams of 2-mercapto-5-methylbenzimidazole (C-1), 1 gram of 2-mercapto-5-methylbenzothiazole (C-2), 21.5 grams of 4-chlorobenzophenone-2-carboxylic acid (C-3), 580 grams of 2-butanone, and 220 grams of dimethylformamide were added to the emulsion, which was allowed to stand for 3 hours. With stirring, there were further added 4.5 grams of 4,6-ditrichloromethyl-2-phenyltriazine (C-4), 2 grams of disulfide compound A, 160 grams of 1,1-bis(2-hydroxy-3,5-dimethylphenyl)-3,5,5-trimethylhexane (C-5), 15 grams of phthalazine (C-6), 5 grams of tetrachlorophthalic acid (C-7), an amount of a hydrazine derivative as reported in Table 25, 1.1 grams of Megafax F-176P, 590 grams of 2-butanone and 10 grams of methyl isobutyl ketone.

Preparation of Emulsion Surface Protective Layer Coating Solution A

A coating solution was prepared by dissolving 75 grams of CAB 171-15S, 5.7 grams of 4-methylphthalic acid (C-8), 1.5 grams of tetrachlorophthalic anhydride (C-9), 10 grams of 2-tribromomethylsulfonylbenzothiazole (C-10), 2 grams of phthalazone (C-11), 0.3 grams of Megafax F-176P, 2 grams of Sildex H31 (spherical silica having a mean particle size of 3 $\mu$m), and 5 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 $\mu$m), 0.2 gram of Sildex H51 (spherical silica having a mean particle size 5 $\mu$m), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl isocyanate in 6 grams of ethyl acetate were added to the solution to complete the coating solution.

Onto a polyethylene terephthalate film having a moisture-proof undercoat containing vinylidene chloride on either surface, the back layer coating solution was applied so as to provide an optical density of 0.7 at 633 nm.

Preparation of Coated Sample

Onto the thus prepared support, the emulsion layer coating solution was applied in a coverage of 2 g/m$^2$ of silver. The emulsion surface protective layer coating solution was then applied onto the emulsion layer to form a protective layer having a dry thickness of 5 $\mu$m.

Note that the compounds used herein have the following structure.

(C-1)
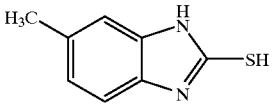
(C-2)
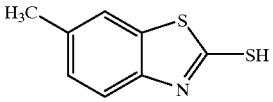
(C-3)
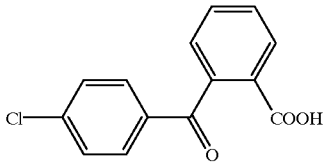
(C-4)
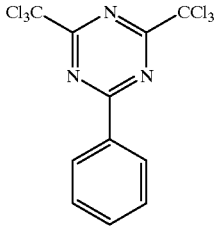
(C-5)
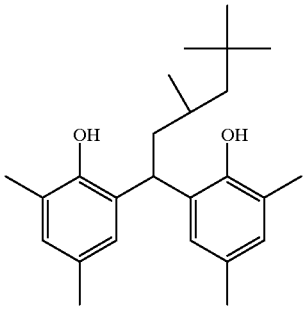
(C-6)
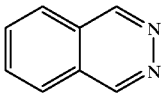
(C-7)
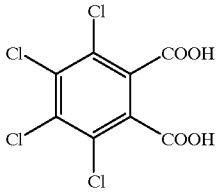
(C-8)
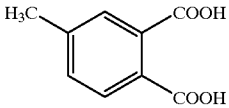
-continued
(C-9)
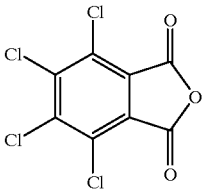
(C-10)
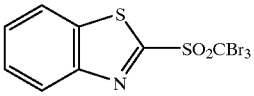
(C-11)
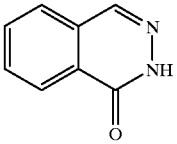
(C-12)
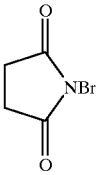
(C-13)
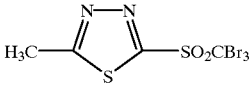
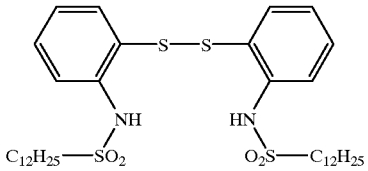
disulfide compound A
Sensitizing Dye A
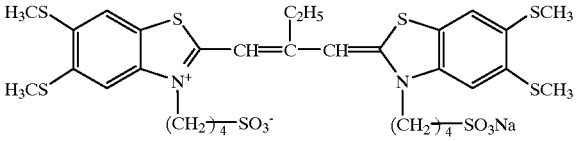
Dye A
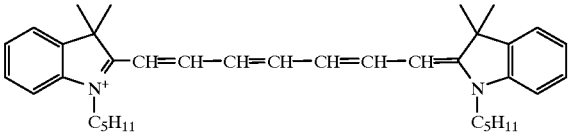

-continued

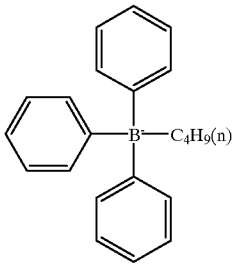

Photographic Property Test

The photographic material samples were exposed by means of a He—Ne light source color scanner SG-608 by Dai-Nihon Screen K.K. and heated for development at 115° C. for 25 seconds on a heat drum. A halide lamp was operated to illuminate light to the developed samples for 15 seconds. The resulting images were determined for Dmax and sensitivity (S, an inversion of a ratio of an exposure dose providing a density higher by 1.5 than Dmin) by a densitometer. Gradation (γ) is the gradient of a straight line connecting points of density 0.3 and 3.0 on a characteristic curve. The results are shown in Table 25.

Pepper Fog Test

An unexposed photosensitive material was developed on a heat drum at 120° C. for 60 seconds whereupon the number of black pepper spots was visually counted and rated on a five-point scale with point "5" for the best quality and point "1" for the worst quality. Point "3" is a practically acceptable limit and points "2" and "1" are practically unacceptable. The results are shown in Table 25.

TABLE 25

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-3 | $5 \times 10^{-3}$ | 4.9 | 1.47 | 13.2 | 1 |
| 3 | H-I-1 | $6 \times 10^{-3}$ | 4.8 | 1.45 | 13.3 | 5 |
| 4 | H-I-3 | $6 \times 10^{-3}$ | 4.9 | 1.47 | 13.0 | 5 |
| 5 | H-I-5 | $6 \times 10^{-3}$ | 4.8 | 1.48 | 13.2 | 5 |
| 6 | H-I-8 | $8 \times 10^{-3}$ | 4.9 | 1.46 | 12.9 | 5 |
| 7 | H-I-10 | $8 \times 10^{-3}$ | 4.9 | 1.47 | 13.3 | 5 |
| 8 | H-I-12 | $6 \times 10^{-3}$ | 4.9 | 1.45 | 13.0 | 5 |
| 9 | H-I-14 | $6 \times 10^{-3}$ | 4.6 | 1.39 | 12.7 | 4 |
| 10 | H-I-15 | $8 \times 10^{-3}$ | 4.6 | 1.40 | 12.8 | 4 |
| 11 | H-I-19 | $3 \times 10^{-3}$ | 4.8 | 1.45 | 13.3 | 5 |
| 12 | H-I-20 | $3.5 \times 10^{-3}$ | 4.9 | 1.38 | 12.6 | 4 |
| 13 | H-I-26 | $7 \times 10^{-3}$ | 4.9 | 1.47 | 13.4 | 5 |
| 14 | H-I-28 | $7 \times 10^{-3}$ | 4.9 | 1.49 | 13.3 | 5 |

*comparison

Note that compound A-3 has the following formula.

A-3

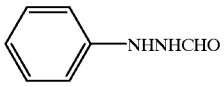

It is evident that photothermographic materials using hydrazine compounds within the scope of the invention satisfy all the requirements of high Dmax, high contrast and pepper fog.

Example 8

Preparation of Silver Halide Grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_4[Fe(CN)_6]$ were added over 10 minutes by a controlled double jet method while maintaining the solution at pAg 7.7. Note that $[Fe(CN)_6]^{4-}$ was added in an amount of $3\times10^{-5}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 μm, a coefficient of variation of projected area of 8%, and a {100} plane ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of Organic Acid Silver Emulsion B

A mixture of 10.6 grams of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide (C-12) was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a 1/2 solvent mixture of butyl acetate and isopropyl alcohol was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining a silver behenate emulsion of needle grains having a mean minor diameter of 0.04 μm, a mean major diameter of 1 μm and a coefficient of variation of 30%.

Preparation of Emulsion Layer Coating Solution B

Various chemicals were added to the above-prepared organic acid silver salt emulsion B as follows. It is noted that the amounts of chemicals added are expressed per mol of silver. With stirring at 250° C., 10 mg of sodium phenylthiosulfonate, 85 mg of sensitizing dye A, 2 grams of 2-mercapto-5-methylbenzimidazole (C-1), 21.5 grams of 4-chlorobenzophenone-2-carboxylic acid (C-3), 580 grams of 2-butanone, and 220 grams of dimethylformamide were added to the emulsion, which was allowed to stand for 3 hours. Then, with stirring, 4 grams of 4,6-ditrichloromethyl-2-phenyltriazine (C-4), 2 grams of disulfide compound A, 170 grams of 1,1-bis(2-hydroxy-3,5-dimethylphenyl)-3,5,5-trimethylhexane (C-5), 5 grams of tetrachlorophthalic acid (C-7), 15 grams of phthalazine (C-6), an amount of a hydrazine derivative as reported in Table 26, 1.1 grams of Megafax F-176P, 590 grams of 2-butanone and 10 grams of methyl isobutyl ketone were added.

Emulsion Surface Protective Layer Coating Solution

A coating solution was prepared by dissolving 75 grams of CAB 171-15S, 5.7 grams of 4-methylphthalic acid (C-8), 1.5 grams of tetrachlorophthalic anhydride (C-9), 8 grams of 5-tribromomethylsulfonyl-2-methylthiadiazole (C-13), 6 grams of 2-tribromomethylsulfonylbenzothiazole (C-10), 3 grams of phthalazone (C-11), 0.3 grams of Megafax F-176P, 2 grams of Sildex H31 (spherical silica having a mean particle size 3 μm), and 6 grams of Sumidur N3500 in 3,070 grams of 2-butanone and 30 grams of ethyl acetate.

Preparation of Back-coated Support

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. A solution of 420 mg of dye A in 10 grams of methanol and 20 grams of acetone and a solution of 0.8 gram of 3-isocyanatomethyl-3,5,5-trimethylhexyl aisocyanate in 6 grams of ethyl acetate were added to the solution to complete the coating solution.

Onto a polyethylene terephthalate film having a moisture-proof undercoat containing vinylidene chloride on either surface, the back layer coating solution was applied so as to provide an optical density of 0.7 at 633 nm.

It is noted that sensitizing dye A, disulfide compound A, and dye A used herein are as identified in Example 7.

Preparation of Coated Sample

Onto the thus prepared support, the emulsion layer coating solution was applied in a coverage of 2 g/m$^2$ of silver. The emulsion surface protecting layer coating solution was then applied onto the emulsion layer to form a protective layer having a dry thickness of 5 μm.

The samples were evaluated for photographic properties and pepper fog as in Example 7. The results are shown in Table 26.

TABLE 26

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-3 | $5 \times 10^{-3}$ | 4.9 | 1.49 | 13.3 | 1 |
| 3 | H-I-1 | $6 \times 10^{-3}$ | 4.8 | 1.47 | 13.4 | 5 |
| 4 | H-I-3 | $6 \times 10^{-3}$ | 4.9 | 1.49 | 13.1 | 5 |
| 5 | H-I-5 | $6 \times 10^{-3}$ | 4.8 | 1.50 | 13.3 | 5 |
| 6 | H-I-8 | $8 \times 10^{-3}$ | 4.9 | 1.48 | 13.0 | 5 |
| 7 | H-I-10 | $8 \times 10^{-3}$ | 4.9 | 1.49 | 13.4 | 5 |
| 8 | H-I-12 | $6 \times 10^{-3}$ | 4.9 | 1.47 | 13.1 | 5 |
| 9 | H-I-14 | $6 \times 10^{-3}$ | 4.6 | 1.41 | 12.8 | 4 |
| 10 | H-I-15 | $8 \times 10^{-3}$ | 4.6 | 1.42 | 12.9 | 4 |
| 11 | H-I-19 | $3 \times 10^{-3}$ | 4.8 | 1.47 | 13.4 | 5 |
| 12 | H-I-20 | $3.5 \times 10^{-3}$ | 4.9 | 1.40 | 12.7 | 4 |
| 13 | H-I-26 | $7 \times 10^{-3}$ | 4.9 | 1.49 | 13.5 | 5 |
| 14 | H-I-28 | $7 \times 10^{-3}$ | 4.9 | 1.51 | 13.4 | 5 |

*comparison
Note that compound A-3 is shown at the end of Table 25.

It is evident that photothermographic materials using hydrazine compounds within the scope of the invention satisfy all the requirements of high Dmax, high contrast and pepper fog.

Example 9

Samples were prepared as in Example 7 except that the hydrazine compound was replaced by those described in Table 27.

The samples were evaluated for photographic properties and pepper fog as in Example 7. The results are shown in Table 27.

TABLE 27

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-4 | $5 \times 10^{-3}$ | 4.9 | 1.47 | 13.2 | 1 |
| 3 | H-II-1 | $6.5 \times 10^{-3}$ | 4.8 | 1.46 | 13.3 | 5 |
| 4 | H-II-2 | $6.5 \times 10^{-3}$ | 4.9 | 1.47 | 13.0 | 5 |
| 5 | H-II-3 | $6.5 \times 10^{-3}$ | 4.8 | 1.48 | 13.2 | 5 |
| 6 | H-II-4 | $6.5 \times 10^{-3}$ | 4.9 | 1.46 | 12.9 | 5 |
| 7 | H-II-5 | $6.5 \times 10^{-3}$ | 4.9 | 1.47 | 13.2 | 5 |
| 8 | H-II-6 | $6.5 \times 10^{-3}$ | 4.9 | 1.49 | 13.6 | 5 |
| 9 | H-II-7 | $6.5 \times 10^{-3}$ | 4.6 | 1.40 | 12.7 | 4 |
| 10 | H-II-8 | $6.5 \times 10^{-3}$ | 4.6 | 1.42 | 12.8 | 4 |
| 11 | H-II-9 | $6.5 \times 10^{-3}$ | 4.8 | 1.45 | 13.3 | 5 |
| 12 | H-II-10 | $6.5 \times 10^{-3}$ | 4.9 | 1.38 | 12.6 | 4 |
| 13 | H-II-11 | $6.5 \times 10^{-3}$ | 4.9 | 1.47 | 13.4 | 5 |
| 14 | H-II-12 | $6.5 \times 10^{-3}$ | 4.9 | 1.49 | 13.3 | 5 |
| 15 | H-II-13 | $6.5 \times 10^{-3}$ | 4.8 | 1.46 | 13.2 | 5 |
| 16 | H-II-14 | $6 \times 10^{-3}$ | 5.0 | 1.50 | 14.0 | 5 |
| 17 | H-II-15 | $6 \times 10^{-3}$ | 5.0 | 1.51 | 14.1 | 5 |

*comparison
Note that compound A-4 has the following structure.
A-4

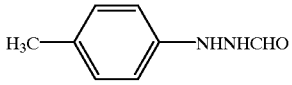

It is evident that photothermographic materials using hydrazine compounds within the scope of the invention satisfy all the requirements of high Dmax, high contrast and pepper fog.

Example 10

Samples were prepared as in Example 8 except that the hydrazine compound was replaced by those described in Table 28.

The samples were evaluated for photographic properties and pepper fog as in Example 7. The results are shown in Table 28.

TABLE 28

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-4 | $5 \times 10^{-3}$ | 4.9 | 1.50 | 13.4 | 1 |
| 3* | H-II-1 | $6.5 \times 10^{-3}$ | 4.8 | 1.49 | 13.5 | 5 |
| 4 | H-II-2 | $6.5 \times 10^{-3}$ | 4.9 | 1.50 | 13.2 | 5 |
| 5 | H-II-3 | $6.5 \times 10^{-3}$ | 4.8 | 1.51 | 13.4 | 5 |
| 6 | H-II-4 | $6.5 \times 10^{-3}$ | 4.9 | 1.49 | 13.1 | 5 |
| 7 | H-II-5 | $6.5 \times 10^{-3}$ | 4.9 | 1.50 | 13.5 | 5 |
| 8 | H-II-6 | $6.5 \times 10^{-3}$ | 4.9 | 1.52 | 13.9 | 5 |
| 9 | H-II-7 | $6.5 \times 10^{-3}$ | 4.6 | 1.43 | 12.9 | 4 |
| 10 | H-II-8 | $6.5 \times 10^{-3}$ | 4.6 | 1.45 | 13.0 | 4 |
| 11 | H-II-9 | $6.5 \times 10^{-3}$ | 4.8 | 1.48 | 13.5 | 5 |
| 12 | H-II-10 | $6.5 \times 10^{-3}$ | 4.9 | 1.41 | 12.8 | 4 |
| 13 | H-II-11 | $6.5 \times 10^{-3}$ | 4.9 | 1.50 | 13.6 | 5 |
| 14 | H-II-12 | $6.5 \times 10^{-3}$ | 4.9 | 1.52 | 13.5 | 5 |
| 15 | H-II-13 | $6.5 \times 10^{-3}$ | 4.8 | 1.49 | 13.5 | 5 |
| 16 | H-II-14 | $6 \times 10^{-3}$ | 5.0 | 1.53 | 14.3 | 5 |
| 17 | H-II-15 | $6 \times 10^{-3}$ | 5.0 | 1.54 | 14.4 | 5 |

*comparison
Note that compound A-4 is shown at the end of table 27.

It is evident that photothermographic materials using hydrazine compounds within the scope of the invention satisfy all the requirements of high Dmax, high contrast and pepper fog.

Example 11

Samples were prepared as in Example 7 except that the hydrazine compound was replaced by those described in Table 29.

The samples were evaluated for photographic properties and pepper fog as in Example 7. The results are shown in Table 29.

TABLE 29

| | Compound | | Amount | | | | Pepper |
|---|---|---|---|---|---|---|---|
| | Hydrazine | Poly-mer | (g/Mol Ag) | Dmax | Sensi-tivity | γ | fog rating |
| 1* | | | | 2.5 | 0.80 | 3.6 | 5 |
| 2* | A-5 | | 2.0 | 4.9 | 1.40 | 13.1 | 1 |
| 3 | H-III-1 | P-1 | 3.0 | 4.8 | 1.39 | 13.2 | 5 |
| 4 | H-III-5 | P-1 | 3.0 | 4.9 | 1.40 | 12.9 | 5 |
| 5 | H-III-6 | P-1 | 3.0 | 4.8 | 1.41 | 13.1 | 5 |
| 6 | H-III-7 | P-5 | 3.0 | 4.9 | 1.39 | 12.8 | 5 |
| 7 | H-III-10 | P-5 | 3.0 | 4.9 | 1.40 | 13.2 | 5 |
| 8 | H-III-13 | P-5 | 3.0 | 4.9 | 1.42 | 13.6 | 5 |
| 9 | H-III-14 | P-5 | 3.0 | 4.6 | 1.33 | 12.6 | 4 |
| 10 | H-III-15 | P-5 | 3.0 | 4.6 | 1.35 | 12.7 | 4 |
| 11 | H-IV-1 | P-1 | 3.0 | 4.8 | 1.38 | 13.2 | 5 |
| 12 | H-IV-3 | P-1 | 3.0 | 4.9 | 1.31 | 12.5 | 4 |
| 13 | H-IV-6 | P-1 | 3.0 | 4.9 | 1.40 | 13.3 | 5 |
| 14 | H-IV-10 | P-5 | 3.0 | 4.9 | 1.42 | 13.2 | 5 |
| 15 | H-IV-13 | P-5 | 3.0 | 4.8 | 1.39 | 13.2 | 5 |
| 16 | H-IV-16 | P-5 | 3.0 | 5.0 | 1.43 | 14.0 | 5 |
| 17 | H-IV-17 | P-5 | 3.0 | 5.0 | 1.44 | 14.1 | 5 |

*comparison
Note that compound A-5 has the following structure.
A-5

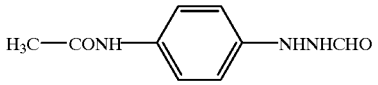

It is evident that photothermographic materials using hydrazine compounds within the scope of the invention satisfy all the requirements of high Dmax, high contrast and pepper fog.

Example 12

Samples were prepared as in Example 8 except that the hydrazine compound was replaced by those described in Table 30.

The samples were evaluated for photographic properties and pepper fog as in Example 7. The results are shown in Table 30.

TABLE 30

| | Compound | | Amount | | | | Pepper |
|---|---|---|---|---|---|---|---|
| | Hydrazine | Poly-mer | (g/Mol Ag) | Dmax | Sensi-tivity | γ | fog rating |
| 1* | | | | 2.5 | 0.80 | 3.6 | 5 |
| 2* | A-5 | | 2.0 | 4.9 | 1.40 | 13.1 | 1 |
| 3 | H-III-1 | P-1 | 3.0 | 4.9 | 1.42 | 13.3 | 1 |
| 4 | H-III-5 | P-1 | 3.0 | 4.8 | 1.41 | 13.4 | 5 |
| 5 | H-III-6 | P-1 | 3.0 | 4.9 | 1.42 | 13.1 | 5 |
| 6 | H-III-7 | P-5 | 3.0 | 4.8 | 1.43 | 13.3 | 5 |

TABLE 30-continued

| | Compound | | Amount | | | | Pepper |
|---|---|---|---|---|---|---|---|
| | Hydrazine | Poly-mer | (g/Mol Ag) | Dmax | Sensi-tivity | γ | fog rating |
| 7 | H-III-10 | P-5 | 3.0 | 4.9 | 1.41 | 13.0 | 5 |
| 8 | H-III-13 | P-5 | 3.0 | 4.9 | 1.42 | 13.4 | 5 |
| 9 | H-III-14 | P-5 | 3.0 | 4.9 | 1.44 | 13.8 | 5 |
| 10 | H-III-15 | P-5 | 3.0 | 4.6 | 1.35 | 12.8 | 4 |
| 11 | H-IV-1 | P-1 | 3.0 | 4.6 | 1.37 | 12.9 | 4 |
| 12 | H-IV-3 | P-1 | 3.0 | 4.8 | 1.40 | 13.4 | 5 |
| 13 | H-IV-6 | P-1 | 3.0 | 4.9 | 1.33 | 12.7 | 4 |
| 14 | H-IV-10 | P-5 | 3.0 | 4.9 | 1.42 | 13.5 | 5 |
| 15 | H-IV-13 | P-5 | 3.0 | 4.9 | 1.44 | 13.4 | 5 |
| 16 | H-IV-16 | P-5 | 3.0 | 4.8 | 1.41 | 13.4 | 5 |
| 17 | H-IV-17 | P-5 | 3.0 | 5.0 | 1.45 | 14.2 | 5 |

*comparison
Note that compound A-5 is shown at the end of Table 29.

It is evident that photothermographic materials using hydrazine compounds within the scope of the invention satisfy all the requirements of high Dmax, high contrast and pepper fog.

Example 13

Samples were prepared as in Example 7 except that the hydrazine compound was replaced by those described in Table 31.

The samples were evaluated for photographic properties and pepper fog as in Example 7. The results are shown in Table 31.

TABLE 31

| | Compound | Amount (mol/ Mol Ag) | Dmax | Sensitivity | γ | Pepper fog rating |
|---|---|---|---|---|---|---|
| 1* | | | 2.5 | 0.80 | 3.6 | 5 |
| 2* | A-6 | $7 \times 10^{-3}$ | 4.9 | 1.45 | 13.4 | 1 |
| 3 | H-V-1 | $8 \times 10^{-3}$ | 4.8 | 1.44 | 13.5 | 5 |
| 4 | H-V-3 | $8 \times 10^{-3}$ | 4.9 | 1.45 | 13.2 | 5 |
| 5 | H-V-8 | $8 \times 10^{-3}$ | 4.8 | 1.46 | 13.4 | 5 |
| 6 | H-V-10 | $8 \times 10^{-3}$ | 4.9 | 1.44 | 13.1 | 5 |
| 7 | H-V-12 | $8 \times 10^{-3}$ | 4.9 | 1.45 | 13.4 | 5 |
| 8 | H-V-14 | $8 \times 10^{-3}$ | 4.9 | 1.47 | 13.8 | 5 |
| 9 | H-V-16 | $8 \times 10^{-3}$ | 4.6 | 1.38 | 12.9 | 4 |
| 10 | H-V-20 | $8 \times 10^{-3}$ | 4.6 | 1.40 | 13.0 | 4 |
| 11 | H-V-23 | $8 \times 10^{-3}$ | 4.8 | 1.43 | 13.5 | 5 |
| 12 | H-V-24 | $8 \times 10^{-3}$ | 4.9 | 1.36 | 12.8 | 4 |
| 13 | H-V-26 | $8 \times 10^{-3}$ | 4.9 | 1.45 | 13.6 | 5 |
| 14 | H-V-28 | $8 \times 10^{-3}$ | 4.9 | 1.47 | 13.5 | 5 |
| 15 | H-V-35 | $8 \times 10^{-3}$ | 4.8 | 1.44 | 13.4 | 5 |
| 16 | H-V-39 | $8 \times 10^{-3}$ | 5.0 | 1.48 | 14.2 | 5 |
| 17 | H-V-44 | $8 \times 10^{-3}$ | 5.0 | 1.49 | 14.3 | 5 |
| 18 | H-V-48 | $8 \times 10^{-3}$ | 4.8 | 1.49 | 14.0 | 4 |

*comparison
Note that compound A-6 has the following structure.
A-6

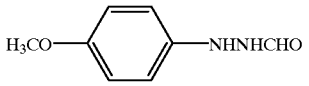

It is evident that photothermographic materials using hydrazine compounds within the scope of the invention satisfy all the requirements of high Dmax, high contrast and pepper fog.

Example 14

Samples were prepared as in Example 8 except that the hydrazine compound was replaced by those described in Table 32.

The samples were evaluated for photographic properties and pepper fog as in Example 7. The results are shown in Table 32.

TABLE 32

| | Compound | Amount (mol/Mol Ag) | Dmax | Sensitivity | γ | Pepper fog rating |
|---|---|---|---|---|---|---|
| 1* | | | 2.5 | 0.80 | 3.6 | 5 |
| 2* | A-6 | $7 \times 10^{-3}$ | 4.9 | 1.48 | 13.6 | 1 |
| 3 | H-V-1 | $8 \times 10^{-3}$ | 4.8 | 1.46 | 13.7 | 5 |
| 4 | H-V-3 | $8 \times 10^{-3}$ | 4.9 | 1.48 | 13.4 | 5 |
| 5 | H-V-8 | $8 \times 10^{-3}$ | 4.8 | 1.49 | 13.6 | 5 |
| 6 | H-V-10 | $8 \times 10^{-3}$ | 4.9 | 1.47 | 13.3 | 5 |
| 7 | H-V-12 | $8 \times 10^{-3}$ | 4.9 | 1.48 | 13.6 | 5 |
| 8 | H-V-14 | $8 \times 10^{-3}$ | 4.9 | 1.49 | 14.1 | 5 |
| 9 | H-V-16 | $8 \times 10^{-3}$ | 4.6 | 1.40 | 13.1 | 4 |
| 10 | H-V-20 | $8 \times 10^{-3}$ | 4.6 | 1.42 | 13.2 | 4 |
| 11 | H-V-23 | $8 \times 10^{-3}$ | 4.8 | 1.46 | 13.7 | 5 |
| 12 | H-V-24 | $8 \times 10^{-3}$ | 4.9 | 1.38 | 13.0 | 4 |
| 13 | H-V-26 | $8 \times 10^{-3}$ | 4.9 | 1.48 | 13.8 | 5 |
| 14 | H-V-28 | $8 \times 10^{-3}$ | 4.9 | 1.50 | 13.7 | 5 |
| 15 | H-V-35 | $8 \times 10^{-3}$ | 4.8 | 1.46 | 13.6 | 5 |
| 16 | H-V-39 | $8 \times 10^{-3}$ | 5.0 | 1.50 | 14.5 | 5 |
| 17 | H-V-44 | $8 \times 10^{-3}$ | 5.0 | 1.51 | 14.6 | 5 |
| 18 | H-V-48 | $8 \times 10^{-3}$ | 4.8 | 1.49 | 14.3 | 4 |

*comparison
Note that compound A-6 is shown at the end of Table 31.

It is evident that photothermographic materials using hydrazine compounds within the scope of the invention satisfy all the requirements of high Dmax, high contrast and pepper fog.

There has been described a printing plate-forming photosensitive material featuring high Dmax and good image quality and processable on a fully dry basis without a need for wet process.

What is claimed is:

1. A photothermographic material comprising an organic silver salt, a silver halide, a hindered phenol reducing agent, and at least one hydrazine derivative of the formula (I):

(I)

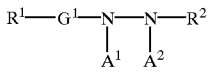

wherein $R^2$ is an aliphatic group, $G^1$ is selected from the group consisting of —COCO—, —$SO_2$—, —SO—, —P(=O)(—$R^3$)—, thiocarbonyl and iminomethylene, $R^1$ is selected from the group consisting of an alkyl, aryl, heterocyclic, alkoxy, aryloxy, amino, alkylamino, arylamino, heterocyclic amino, and hydrazino group, with the proviso that $R^1$ is not an unsubstituted arylamino group when $G^1$ is a thiocarbonyl group, $A^1$ and $A^2$ are both hydrogen atoms, or one of $A^1$ and $A^2$ is a hydrogen atom and the other is a substituted or unsubstituted alkylsulfonyl, arylsulfonyl or acyl group, and $R^3$ is selected from the group consisting of an alkyl, aryl, heterocyclic, alkoxy, aryloxy, amino, alkylamino, arylamino, heterocyclic amino, and hydrazino group.

2. The photothermographic material of claim 1 wherein the reducing agent is the compounds represented by the formulae (R-I) to (R-IV), (R-I)

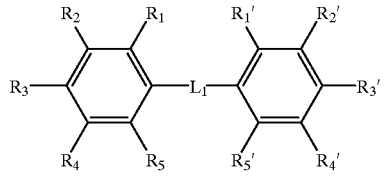

(R-II)

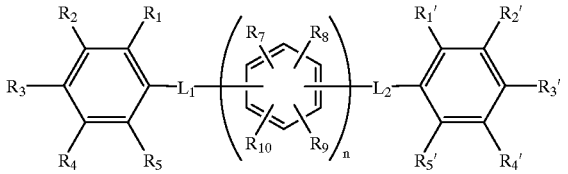

(R-III)

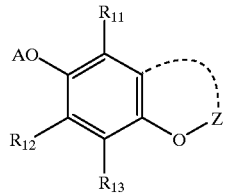

(R-IV)

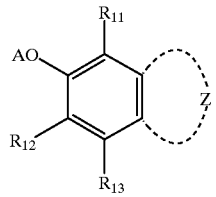

wherein each of $L_1$ and $L_2$ is a group CH—$R_6$ or CH—$R_{6'}$ or a sulfur atom, and n is a natural number, Z in formula (R-III) forms a cyclic structure represented by the following formula (Z-1) or (Z-2), and Z in formula (R-IV) forms a cyclic structure represented by the following formula (Z-3) or (Z-4), (Z-1)

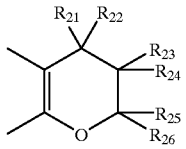

-continued (Z-2)

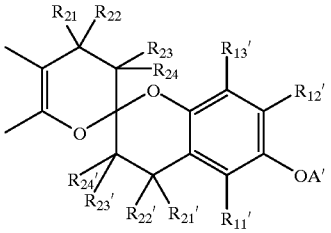

(Z-3)

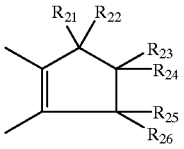

(Z-4)

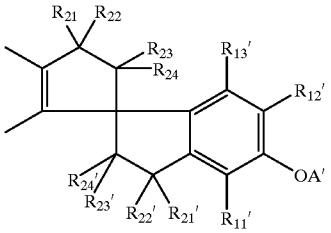

each of $R_1$ to $R_5$, $R_6$, $R_{1'}$ to $R_{5'}$, $R_{6'}$, $R_7$ to $R_{10}$, $R_{11}$ to $R_{13}$, $R_{11'}$ to $R_{13'}$, $R_{21}$ to $R_{26}$, and $R_{21'}$ to $R_{24'}$ is a hydrogen atom, an alkyl group having 1 to 30 carbon atoms, an aryl group, an aralkyl group, a halogen atom, an amino group or a substituent represented by —O—A, with the proviso that at least one of $R_1$ to $R_5$, at least one of $R_{1'}$ to $R_{5'}$, and at least one of $R_7$ to $R_{10}$ each are a group represented by —O—A, and alternatively, $R_1$ to $R_5$, $R_6$, $R_{1'}$ to $R_{5'}$, $R_{6'}$, $R_7$ to $R_{10}$, $R_{11}$ to $R_{13}$, $R_{11'}$ to $R_{13'}$, $R_{21}$ to $R_{26}$, and $R_{21'}$ to $R_{24'}$, taken together, may form a ring, and A and A' are each a hydrogen atom, an alkyl group having 1 to 30 carbon atoms, an acyl group having 1 to 30 carbon atoms, an aryl group, a phosphate group or a sulfonyl group.

3. The photothermographic material of claim 1 wherein the organic silver salt is a silver salt of a carboxylic acid.

4. The photothermographic material of claim 3 wherein the carboxylic acid is an aliphatic carboxylic acid.

5. The photothermographic material of claim 3, wherein the carboxylic acid is an aromatic carboxylic acid.

6. The photothermographic material of claim 1 having a gradient γ of more than 12.8 after heat development.

7. A photothermographic material comprising an organic silver salt, a silver halide, a hindered phenol reducing agent, and at least one hydrazine derivative of the formula (II):

(II)

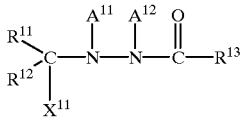

wherein $R^{11}$ and $R^{12}$ are independently an aryl or an aromatic heterocyclic group, $X^{11}$ is selected from the group consisting of a hydrogen atom, alkyl, alkenyl, alkynyl, acyl, oxycarbonyl, carbamoyl, heterocyclic, cyano, a group having a bonding oxygen atom, a group having a bonding nitrogen atom, and a group having a bonding sulfur atom, $R^{13}$ is selected from the group consisting of a hydrogen atom, alkyl, aryl, heterocyclic alkyoxy, aryloxy, amino and hydrazine group, and $A^{11}$ and $A^{12}$ are both hydrogen atoms, or one of $A^{11}$ and $A^{12}$ is a hydrogen atom and the other is an alkylsulfonyl, arylsulfonyl or acyl group.

8. The photothermographic material of claim 7 wherein the reducing agent is the compounds represented by the formulae (R-I) to (R-IV), (R-I)

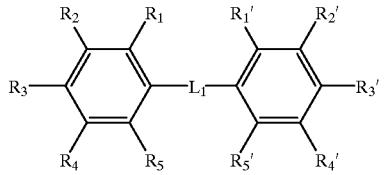

(R-II)

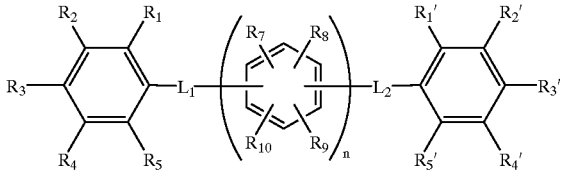

(R-III)

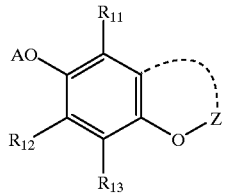

(R-IV)

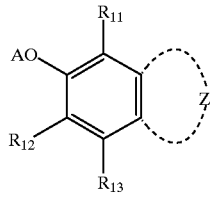

wherein each of $L_1$ and $L_2$ is a group CH—$R_6$ or CH—$R_{6'}$ or a sulfur atom, and n is a natural number, Z in formula (R-III) forms a cyclic structure represented by the following formula (Z-1) or (Z-2), and Z in formula (R-IV) forms a cyclic structure represented by the following formula (Z-3) or (Z-4), (Z-1)

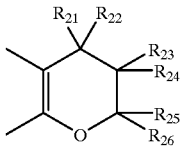

-continued (Z-2)

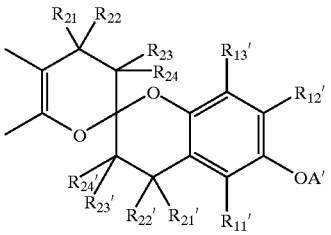

(Z-3)

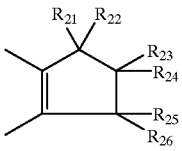

(Z-4)

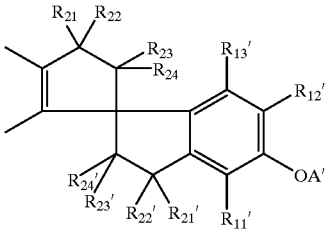

each of $R_1$ to $R_5$, $R_6$, $R_{1'}$ to $R_{5'}$, $R_{6'}$, $R_7$ to $R_{10}$, $R_{11}$ to $R_{13}$, $R_{11'}$ to $R_{13'}$, $R_{21}$ to $R_{26}$, and $R_{21'}$ to $R_{24'}$ is a hydrogen atom, an alkyl group having 1 to 30 carbon atoms, an aryl group, an aralkyl group, a halogen atom, an amino group or a substituent represented by —O—A, with the proviso that at least one of $R_1$ to $R_5$, at least one of $R_{1'}$ to $R_{5'}$, and at least one of $R_7$ to $R_{10}$ each are a group represented by —O—A, and alternatively, $R_1$ to $R_5$, $R_6$, $R_{1'}$ to $R_{5'}$, $R_{6'}$, $R_7$ to $R_{10}$, $R_{11}$ to $R_{13}$, $R_{11'}$ to $R_{13'}$, $R_{21}$ to $R_{26}$, and $R_{21'}$ to $R_{24'}$, taken together, may form a ring, and A and A' are each a hydrogen atom, an alkyl group having 1 to 30 carbon atoms, an acyl group having 1 to 30 carbon atoms, an aryl group, a phosphate group or a sulfonyl group.

9. The photothermographic material of claim 7 wherein the organic silver salt is a silver salt of a carboxylic acid.

10. The photothermographic material of claim 9 wherein the carboxylic acid is an aliphatic carboxylic acid.

11. The photothermographic material of claim 9, wherein the carboxylic acid is an aromatic carboxylic acid.

12. The photothermographic material of claim 7 having a gradient γ of more than 5 after heat development.

13. A photothermographic material comprising an organic silver salt, a silver halide, a hindered phenol reducing agent, and at least one hydrazine derivative of the following formulae (IV) to (VIII);

hydrazine derivative of the formula (IV):

$$A^{40}—NHNH—R^{40} \quad (IV)$$

wherein $A^{40}$ is a heterocyclic group having at least one sulfur or oxygen atom, and $R^{40}$ is selected from the group consisting of a formyl, substituted or unsubstituted acyl, sulfonyl, carbamoyl, sulfamoyl, alkoxycarbonyl, thioacyl, and —(C=O)—(C=O) —$X^{40}$ group wherein $X^{40}$ is —$NR^{41}R^{42}$ or —$OR^{43}$ wherein $R^{41}$, $R^{42}$ and $R^{43}$ are independently selected from the group consisting of a hydrogen atom, substituted or unsubstituted alkyl, aryl and heterocyclic group, or $R^{41}$ and $R^{42}$, taken together, may form a ring with the nitrogen atom, hydrazine derivative of the formula (V):

$$R^{51}—\underset{\underset{R^{52}}{|}}{C}=\underset{\underset{R^{53}}{|}}{C}—NHNH—R^{54} \quad (V)$$

wherein $R^{51}$ is a monovalent organic group, each of $R^{52}$ and $R^{53}$ is a hydrogen atom, halogen atom or substituted or unsubstituted alkyl group, $R^{54}$ is selected from the group consisting of a formyl, substituted or unsubstituted acyl, sulfonyl, carbamoyl, sulfamoyl, alkoxycarbonyl, thioacyl, and —(c=O)—(C=O)—$X^{40}$ group wherein $X^{40}$ is —$NR^{41}R^{42}$ or —$OR^{43}$ wherein $R^{41}$, $R^{42}$ and $R^{43}$ are independently selected from the group consisting of a hydrogen atom, substituted or unsubstituted alkyl, aryl and heterocyclic group, or $R^{41}$ and $R^{42}$, taken together, may form a ring with the nitrogen atom, hydrazine derivative having a structural moiety of the formula (VI):

$$R^{61}—\underset{\underset{R^{62}}{|}}{C}=\underset{\underset{R^{63}}{|}}{C}—NHNH—R^{64} \quad (VI)$$

wherein $R^{61}$ is a divalent organic group, each of $R^{62}$ and $R^{63}$ is a hydrogen atom, halogen atom or substituted or unsubstituted alkyl group, $R^{64}$ is selected from the group consisting of a formyl, substituted or unsubstituted acyl, sulfonyl, carbamoyl, sulfamoyl, alkoxycarbonyl, thioacyl, and —(C=O)—(C=O) —$X^{40}$ group wherein $X^{40}$ is —$NR^{41}R^{42}$ or —$OR^{43}$ wherein $R^{41}$, $R^{42}$ and $R^{43}$ are independently selected from the group consisting of a hydrogen atom, substituted or unsubstituted alkyl, aryl and heterocyclic group, or $R^{41}$ and $R^{42}$, taken together, may form a ring with the nitrogen atom;

hydrazine derivative having a structural moiety of the formula (VII):

$$—(R^{67})_m—X^{60}—\underset{\underset{R^{66}}{|}}{N}—NH—R^{65} \quad (VII)$$

wherein $R^{65}$ is selected from the group consisting of a hydrogen atom, formyl, substituted or unsubstituted acyl, sulfonyl, carbamoyl, sulfamoyl, alkyoxycarbonyl, thioacyl, and —(C=O)—(C=O) —$X^{40}$ group wherein $X^{40}$ is —$NR^{41}R^{42}$ or —$OR^{43}$ wherein $R^{41}$, $R^{42}$ and $R^{43}$ are independently selected from the group consisting of a hydrogen atom, substituted or unsubstituted alkyl, aryl and heterocyclic group, or $R^{41}$ and $R^{42}$, taken together, may form a ring with the nitrogen atom, $R^{66}$ is selected from the group consisting of a hydrogen atom, substituted or unsubstituted acyl, sulfonyl, carbamoyl, sulfamoyl, and alkoxycarbonyl group, $R^{67}$ is a divalent organic group, $X^{60}$ is a phenyl group or pyridine ring, and letter m is an integer of 0 to 6; and hydrazine derivative of the formula (VIII):

(VIII)

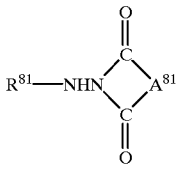

wherein $R^{81}$ is an aromatic group, $A^{81}$ is a substituted or unsubstituted aromatic ring, and the carbon atoms of the two carbonyl groups are attached to different atoms of the aromatic ring.

14. The photothermographic material of claim 13 wherein the reducing agent is the compounds represented by the formulae (R-I) to (R-IV), (R-I)

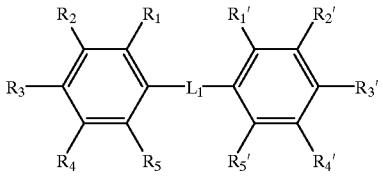

(R-II)

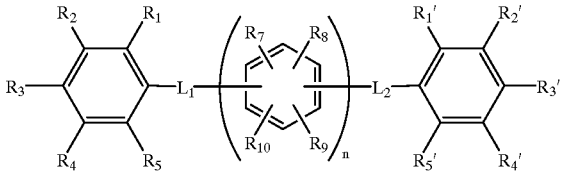

(R-III)

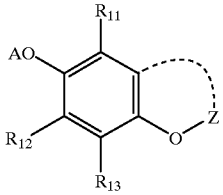

(R-IV)

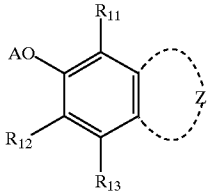

wherein each of $L_1$ and $L_2$ is a group CH—$R_6$ or CH—$R_{6'}$ or a sulfur atom, and n is a natural number, Z in formula (R-III) forms a cyclic structure represented by the following formula (Z-1) or (Z-2), and Z in formula (R-IV) forms a cyclic structure represented by the following formula (Z-3) or (Z-4), (Z-1)

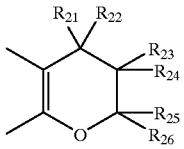

(Z-2)

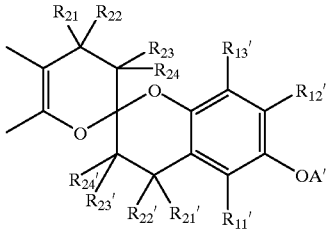

(Z-3)

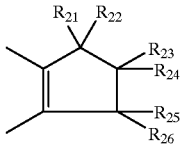

(Z-4)

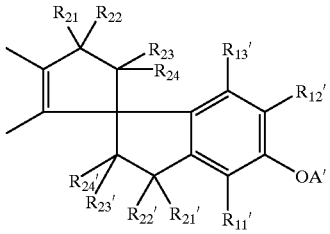

each of $R_1$ to $R_5$, $R_6$, $R_{1'}$ to $R_{5'}$, $R_{6'}$, $R_7$ to $R_{10}$, $R_{11}$ to $R_{13}$, $R_{11'}$ to $R_{13'}$, $R_{21}$ to $R_{26}$, and $R_{21'}$ to $R_{24'}$ is a hydrogen atom, an alkyl group having 1 to 30 carbon atoms, an aryl group, an aralkyl group, a halogen atom, an amino group or a substituent represented by —O—A, with the proviso that at least one of $R_1$ to $R_5$, at least one of $R_{1'}$ to $R_{5'}$, and at least one of $R_7$ to $R_{10}$ each are a group represented by —O—A, and alternatively, $R_1$ to $R_5$, $R_6$, $R_{1'}$ to $R_{5'}$, $R_{6'}$, $R_7$ to $R_{10}$, $R_{11}$ to $R_{13}$, $R_{11'}$ to to $R_{13'}$, $R_{21}$ to $R_{26}$, and $R_{21'}$ to $R_{24'}$, taken together, may form a ring, and A and A' are each a hydrogen atom, an alkyl group having 1 to 30 carbon atoms, an acyl group having 1 to 30 carbon atoms, an aryl group, a phosphate group or a sulfonyl group.

15. The photothermographic material of claim 13 wherein the organic silver salt is a silver salt of a carboxylic acid.

16. The photothermographic material of claim 15 wherein the carboxylic acid is an aliphatic carboxylic acid.

17. The photothermographic material of claim 15 wherein the carboxylic acid is an aromatic carboxylic acid.

18. The photothermographic material of claim 13 having a gradient γ of more than 5 after heat development.

19. A photothermographic material comprising an organic silver salt, a silver halide, a hindered phenol reducing agent, and at least one hydrazine derivative of the formulae (III):

(III)

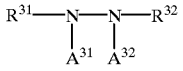

wherein $R^{32}$ is an aliphatic group, $R^{31}$ is an alkyl, aryl or heterocyclic group having at least one electron attractive or donative group, $A^{31}$ and $A^{32}$ are both hydrogen atoms, or one of $A^{31}$ and $A^{32}$ is a hydrogen atom and the other is a substituted or unsubstituted alkylsulfonyl, arylsulfonyl or acyl group.

20. The photothermographic material of claim 19 wherein the reducing agent is the compounds represented by the formulae (R-I) to (R-IV), (R-I)

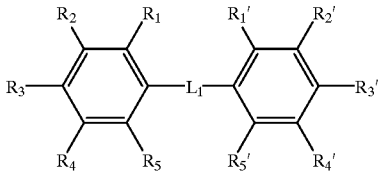

(R-II)

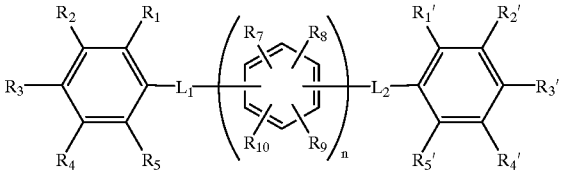

(R-III)

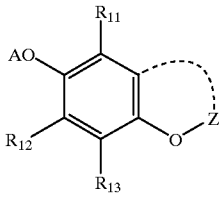

(R-IV)

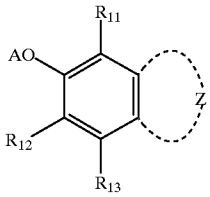

wherein each of $L_1$ and $L_2$ is a group CH—$R_6$ or CH—$R_{6'}$ or a sulfur atom, and n is a natural number, Z in formula (R-III) forms a cyclic structure represented by the following formula (Z-1) or (Z-2), and Z in formula (R-IV) forms a cyclic structure represented by the following formula (Z-3) or (Z-4), (Z-1)

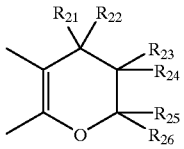

(Z-2)

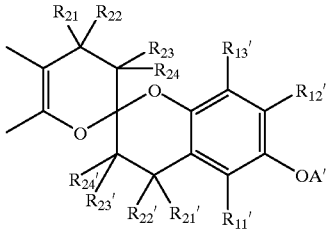

(Z-3)

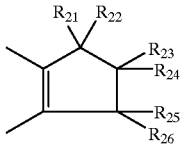

(Z-4)

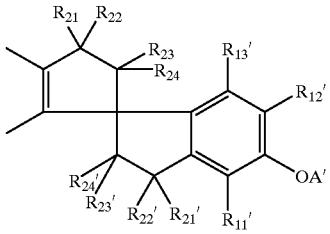

each of $R_1$ to $R_5$, $R_6$, $R_{1'}$ to $R_{5'}$, $R_{6'}$, $R_7$ to $R_{10}$, $R_{11}$ to $R_{13}$, $R_{11'}$ to $R_{13'}$, $R_{21}$ to $R_{26}$, and $R_{21'}$ to $R_{24'}$ is a hydrogen atom, an alkyl group having 1 to 30 carbon atoms, an aryl group, an aralkyl group, a halogen atom, an amino group or a substituent represented by —O—A, with the proviso that at least one of $R_1$ to $R_5$, at least one of $R_{1'}$ to $R_{5'}$, and at least one of $R_7$ to $R_{10}$ each are a group represented by —O—A, and alternatively, $R_1$ to $R_5$, $R_6$, $R_{1'}$ to $R_{5'}$, $R_{6'}$, $R_7$ to $R_{10}$, $R_{11}$ to $R_{13}$, $R_{11'}$ to $R_{13'}$, $R_{21}$ to $R_{26}$, and $R_{21'}$ to $R_{24'}$, taken together, may form a ring, and A and A' are each a hydrogen atom, an alkyl group having 1 to 30 carbon atoms, an acyl group having 1 to 30 carbon atoms, an aryl group, a phosphate group or a sulfonyl group.

21. The photothermographic material of claim 19 wherein the organic silver salt is a silver salt of a carboxylic acid.

22. The photothermographic material of claim 21 wherein the carboxylic acid is an aliphatic carboxylic acid.

23. The photothermographic material of claim 21 wherein the carboxylic acid is an aromatic carboxylic acid.

24. The photothermographic material of claim 19 having a gradient γ of more than 5 after heat development.

* * * * *